US005583397A

United States Patent [19]

Ogawa

[11] Patent Number: 5,583,397

[45] Date of Patent: Dec. 10, 1996

[54] STROBE APPARATUS WITH COLOR TEMPERATURE CONTROL

[75] Inventor: Kimiaki Ogawa, Tokyo, Japan

[73] Assignee: Asahi Kogaku Kogyo Kabushiki Kaisha, Tokyo, Japan

[21] Appl. No.: 325,158

[22] Filed: Oct. 20, 1994

[30] Foreign Application Priority Data

| | | | |
|---|---|---|---|
| Oct. 20, 1993 | [JP] | Japan | 5-285902 |
| Oct. 20, 1993 | [JP] | Japan | 5-285903 |
| Oct. 21, 1993 | [JP] | Japan | 5-285699 |
| Oct. 25, 1993 | [JP] | Japan | 5-288610 |
| Nov. 5, 1993 | [JP] | Japan | 5-301200 |

[51] Int. Cl.[6] ..... H05B 37/02

[52] U.S. Cl. ..... 315/151; 315/155; 315/159; 315/241 S; 348/223; 348/226; 348/227

[58] Field of Search ..... 315/151–155, 315/159, 241 P, 241 S, 294, 324; 354/132, 145.1; 358/29, 41, 43; 348/223, 226, 227, 371

[56] References Cited

U.S. PATENT DOCUMENTS

| | | | |
|---|---|---|---|
| 3,864,565 | 2/1975 | Kawasaki | 250/214 P |
| 4,485,336 | 11/1984 | Yoshiyama et al. | 315/241 P |
| 4,827,332 | 5/1989 | Miyake et al. | 358/29 |
| 4,847,680 | 7/1989 | Okino | 358/29 |
| 4,853,600 | 8/1989 | Zeltner et al. | 315/241 P |
| 5,132,825 | 7/1992 | Hiyadera | 359/85 |

FOREIGN PATENT DOCUMENTS

| | | |
|---|---|---|
| 58-149033 | 9/1983 | Japan . |
| 63-80691 | 4/1988 | Japan . |
| 63-115484 | 5/1988 | Japan . |
| 63-115486 | 5/1988 | Japan . |
| 6-308586 | 11/1994 | Japan . |

*Primary Examiner*—Robert Pascal
*Assistant Examiner*—Haissa Philogene
*Attorney, Agent, or Firm*—Greenblum & Bernstein P.L.C.

[57] ABSTRACT

A strobe apparatus having a light emitter which emits strobe light and a color temperature converter for varying a color temperature of the strobe light emitted from the light emitter. The apparatus includes a first color temperature detector for detecting a color temperature of the strobe light after being reflected from an object, a second color temperature detector for detecting a color temperature of ambient light reflected from the object, and a color temperature controller. The color temperature controller controls the color temperature of the strobe light detected by the first color temperature detector, so that the color temperature of the strobe light incident upon the object to be photographed is substantially identical to the color temperature of the ambient light detected by the second color temperature detector.

41 Claims, 53 Drawing Sheets

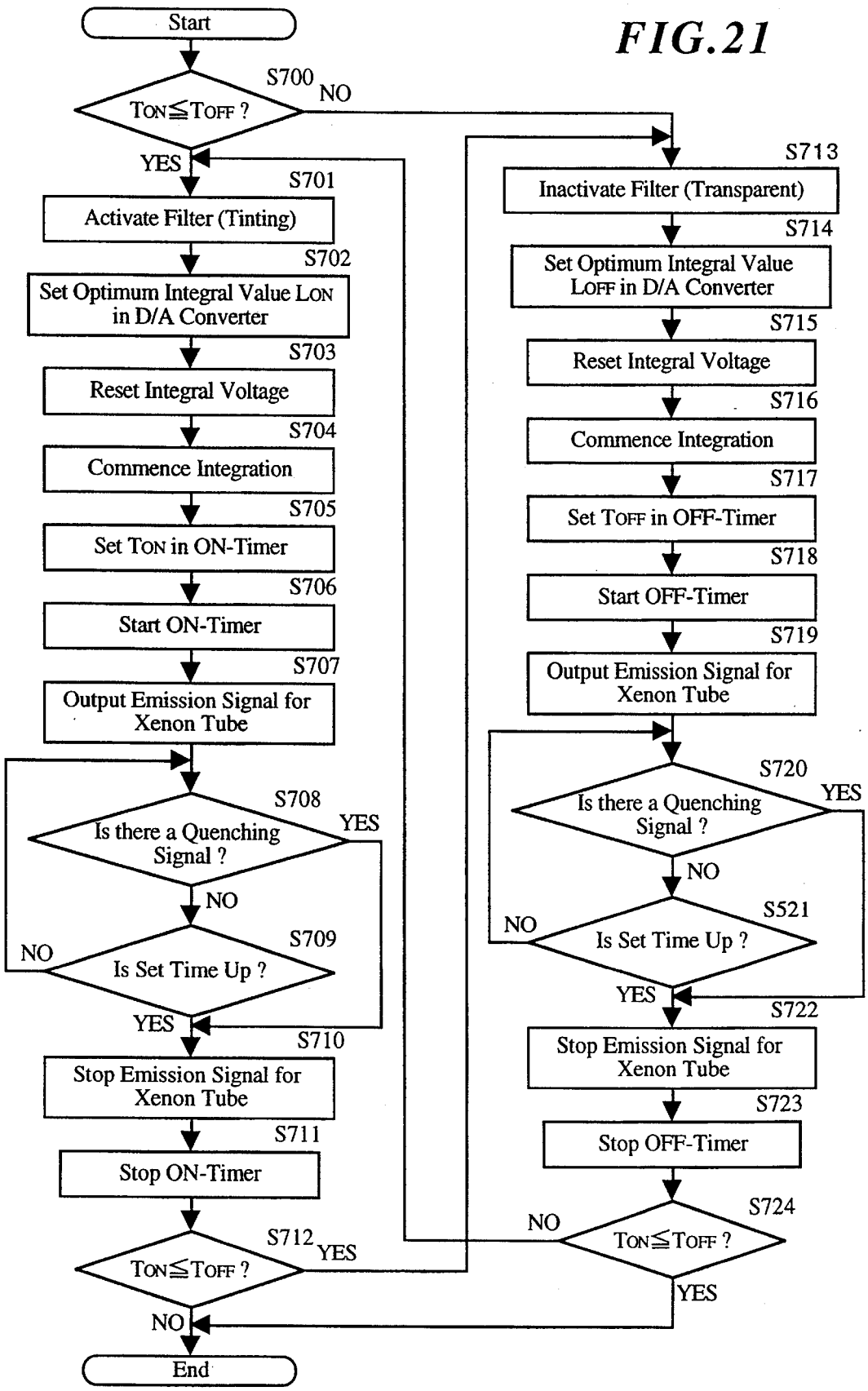
FIG.21
Start
S700
TON≦TOFF ?
NO
YES
S701
Activate Filter (Tinting)
S702
Set Optimum Integral Value LON in D/A Converter
S703
Reset Integral Voltage
S704
Commence Integration
S705
Set TON in ON-Timer
S706
Start ON-Timer
S707
Output Emission Signal for Xenon Tube
S708
Is there a Quenching Signal ?
YES
NO
S709
Is Set Time Up ?
NO
YES
S710
Stop Emission Signal for Xenon Tube
S711
Stop ON-Timer
S712
TON≦TOFF ?
YES
NO
End
S713
Inactivate Filter (Transparent)
S714
Set Optimum Integral Value LOFF in D/A Converter
S715
Reset Integral Voltage
S716
Commence Integration
S717
Set TOFF in OFF-Timer
S718
Start OFF-Timer
S719
Output Emission Signal for Xenon Tube
S720
Is there a Quenching Signal ?
YES
NO
S521
Is Set Time Up ?
NO
YES
S722
Stop Emission Signal for Xenon Tube
S723
Stop OFF-Timer
S724
TON≦TOFF ?
NO
YES

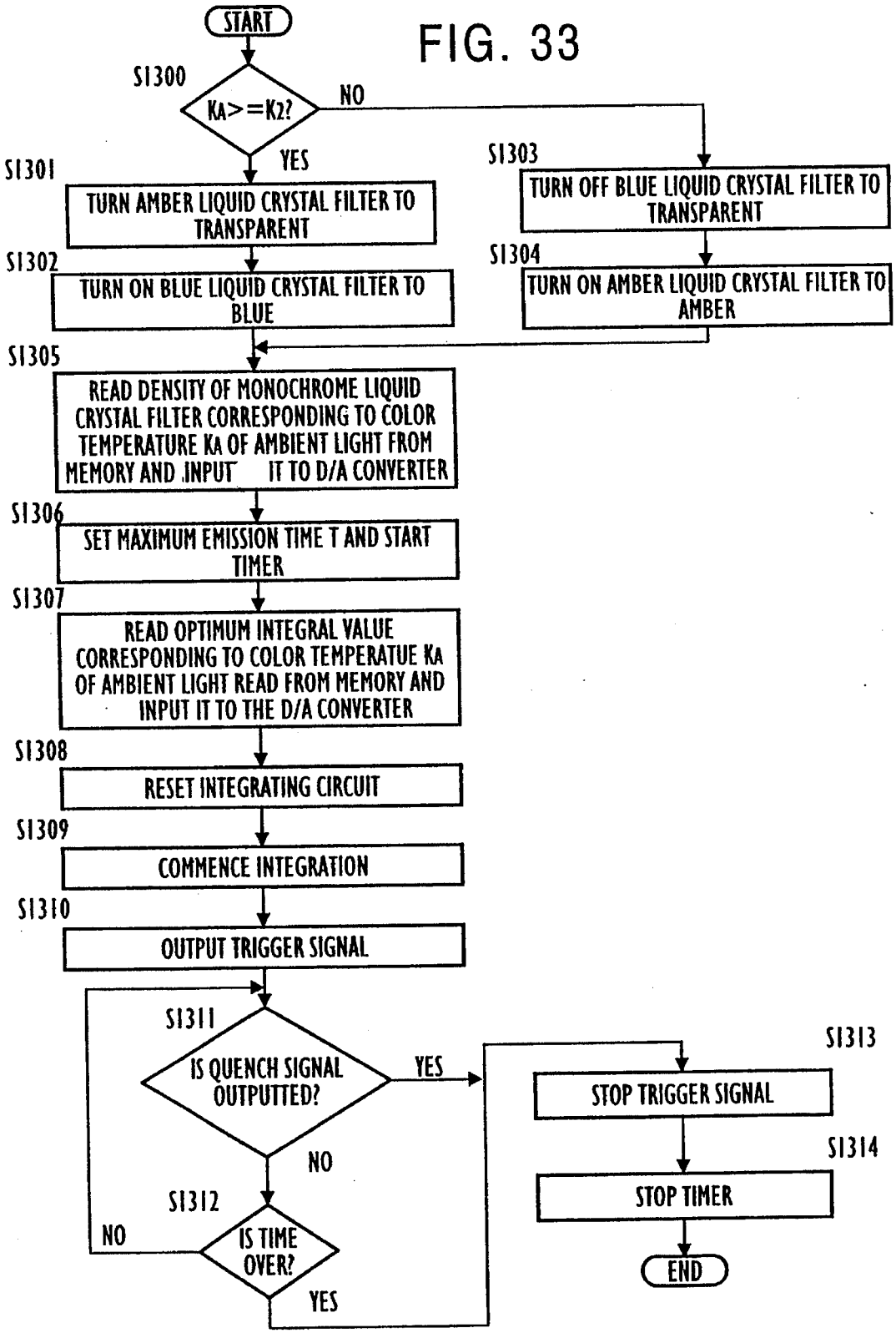
FIG. 33
START
S1300
KA>=K2?
NO
YES
S1301
TURN AMBER LIQUID CRYSTAL FILTER TO TRANSPARENT
S1302
TURN ON BLUE LIQUID CRYSTAL FILTER TO BLUE
S1303
TURN OFF BLUE LIQUID CRYSTAL FILTER TO TRANSPARENT
S1304
TURN ON AMBER LIQUID CRYSTAL FILTER TO AMBER
S1305
READ DENSITY OF MONOCHROME LIQUID CRYSTAL FILTER CORRESPONDING TO COLOR TEMPERATURE KA OF AMBIENT LIGHT FROM MEMORY AND INPUT IT TO D/A CONVERTER
S1306
SET MAXIMUM EMISSION TIME T AND START TIMER
S1307
READ OPTIMUM INTEGRAL VALUE CORRESPONDING TO COLOR TEMPERATUE KA OF AMBIENT LIGHT READ FROM MEMORY AND INPUT IT TO THE D/A CONVERTER
S1308
RESET INTEGRATING CIRCUIT
S1309
COMMENCE INTEGRATION
S1310
OUTPUT TRIGGER SIGNAL
S1311
IS QUENCH SIGNAL OUTPUTTED?
YES
NO
S1312
IS TIME OVER?
NO
YES
S1313
STOP TRIGGER SIGNAL
S1314
STOP TIMER
END

STROBE APPARATUS WITH COLOR TEMPERATURE CONTROL

BACKGROUND OF THE INVENTION

1. Field of the Invention

The present invention relates to a strobe apparatus for a still video camera having an image pickup device in which the color temperature of a strobe light is controlled so as to result in a natural color image, even with images which have a large step (or incremental) change in their color.

2. Description of the Related Art

In a conventional still video camera, a white light balance is adjusted so that a white object, when photographed, is reproduced as a white image, based on light reflected from the object, regardless of the color temperature of an illumination light used to illuminate the object. For instance, in a known still video camera having a strobe apparatus (electronic flash), the white balance adjustment is carried out by adjusting the gain of color difference signals (R-Y, B-Y) of an object image, etc., output from a solid-state image pickup device. In the situation where a strobe apparatus is activated to emit strobe light, the white balance is controlled in accordance with a predetermined color temperature of the strobe light.

However, if the color temperature of strobe light is different from the color temperature of ambient light, there is a possibility that the reproduced image will have an unnatural color. To prevent this, it has been proposed in Japanese Patent Application No. 5-235518 by the assignee of the present application that a color temperature of a strobe light emitted from a xenon tube (light emitting tube) be controlled to be substantially identical to a color temperature of the ambient light, by means of a color temperature conversion filter provided in front of a xenon tube.

However, the color temperature of the strobe light emitted from the light emitting tube or the conversion power of the color temperature conversion filter tends to vary with time, or to vary spontaneously during the emission of light. Consequently, if the emission time or the conversion power of the color temperature conversion filter is constantly controlled with respect to the color temperature of the ambient light in a predetermined mode, there can be an error in the color temperature of the strobe light incident upon the object, and thus, the resultant color temperature varies. Moreover, since the white balance in an image pickup system is effected so that the color temperature of the strobe light is identical to the color temperature of the ambient light, if there is an error of the color temperature of the strobe light or a variation in the color temperature during the emission, no white balance of the object image can be achieved.

If there is a difference in the quantity of the light between the light emitting tubes due to irregular emission characteristics of the light emitting tubes or irregular light receiving sensitivities of the photometers, the resultant color temperature can be wrong.

In this arrangement, since two emissions of the strobe light occurs for one photograph, the quantity of electric charges to be discharged from the trigger capacitor in the strobe apparatus is increased. Moreover, since it is necessary to charge the trigger capacitor in order to effect the second emission after the first emission is completed, it takes a long time to control the emission of the strobe light. In addition to the foregoing, if two xenon tubes are used, a range in which the color temperature of the resulting strobe light can be correctly controlled is reduced due to a possible deviation or difference in the illumination area between the two strobe lights.

However, the color temperature of the xenon tube increases as the emission time decreases, and accordingly, no precise control of the color temperature can be effected by the above-mentioned structure.

However, if there is a difference in the color temperature between the strobe light and the ambient light of the object to be photographed, there is a possibility that an unnatural color of an object image will be reproduced.

SUMMARY OF THE INVENTION

A primary object of the present invention is to provide a strobe apparatus in which a color temperature of a strobe light is controlled so as to realize an improved white balance of an object image, even if there is an error, or variation over time, in the color temperature of the strobe light.

The primary object of the present invention is to provide a simple strobe apparatus in which a natural color image can be obtained without providing a white balance circuit or a vertical edge extracting circuit.

To achieve the object mentioned above, according to the present invention, there is provided a strobe apparatus having a light emitter which emits a strobe light and a color temperature converter for varying a color temperature of the emitted strobe light. The color temperature converter includes a first color temperature detector for detecting a color temperature of the strobe light after being reflected from an object, a second color temperature detector for detecting a color temperature of ambient light reflected from the object, and, a color temperature controller for controlling a color temperature of the strobe light in accordance with the color temperature of the strobe light detected by the first color temperature detecting means. Thus, the color temperature of the strobe light to be incident upon the object to be photographed is substantially identical to the color temperature of the ambient light detected by the second color temperature detector.

It is an object of the present invention to provide a strobe apparatus in which a predetermined composite color temperature is obtained by a combination of different color temperatures of the strobe light. If there is a difference in the quantity of the strobe light, a desired composite color temperature or a color temperature approximate thereto can be obtained.

To achieve the object mentioned above, according to the present invention, there is provided a strobe apparatus having a light emitting apparatus which emits a strobe light including a first color temperature controller for controlling a color temperature of the strobe light emitted from the light emitting apparatus between a first upper limit of the color temperature and a first lower limit of the color temperature. A second color temperature controller is provided for controlling the color temperature of the strobe light emitted from the light emitting apparatus between a second upper limit of the color temperature that is substantially equal to the first lower limit of the color temperature and a second lower limit of the color temperature. Also provided are a color temperature detector for detecting a color temperature of ambient light reflected from an object, and a composite color temperature controller for controlling a plurality of the color temperature values to be determined by the first and second color temperature controllers in accordance with the color temperature of the ambient light. The composite color temperature controller further adjusts a quantity of the strobe light to be emitted from the light emitting apparatus, so that a resulting color temperature of the strobe light obtained through the composite color temperature controller is substantially identical to the color temperature of the ambient light.

It is an object of the present invention to provide a strobe apparatus in which the control of an emission requires only a short time so that the quantity of electric charge to be discharged from a trigger capacitor can be reduced, and no variation in the illumination occurs.

To achieve the object mentioned above, according to the present invention, a strobe apparatus having a single light emitting tube which emits a strobe light and a color temperature detecting device for detecting a color temperature of ambient light reflected from an object are provided. A plurality of filters are provided in front of the light emitting tube to vary the color temperature of the strobe light emitted from the single light emitting tube, and a color temperature controller which controls a specific filter, or plurality of filters, to vary a color temperature thereof in accordance with the color temperature of the ambient light, so that a color temperature of the strobe light, after being transmitted through the specific filter, or plurality of filters, is substantially identical to the color temperature of the ambient light.

It is an object of the present invention to provide a strobe apparatus in which the color temperature of the strobe light can be correctly and precisely controlled, regardless of the emission time of the strobe light by the light emitting tube (or tubes).

To achieve the object mentioned above, according to the present invention, there is provided a strobe apparatus having a light emitting tube which emits a strobe light and a color temperature converter provided in front of the light emitting tube to vary the color temperature of the strobe light emitted from the light emitting tube. The color temperature converter including a detector for detecting a quantity of light reflected from an object to be photographed during a pre-emission of the strobe light from the light emitting tube prior to a main emission of the-strobe light from the light emitting tube, a color temperature detector for detecting a color temperature of the ambient light reflected from an object, and a color temperature controller for controlling the color temperature converter. Thus, the color temperature of the strobe light in the main emission is substantially identical to the color temperature of the ambient light, in accordance with the detected quantity of light reflected from the object and the detected color temperature of the ambient light.

It is an object of the present invention to provide a strobe apparatus which can emit strobe light whose color temperature is balanced with the color temperature of ambient light incident upon the object being photographed.

To achieve the object mentioned above, according to the present invention, there is provided a strobe apparatus having a light emitter which emits a strobe light towards an object to be photographed, including a color temperature detector for detecting a color temperature of an ambient light reflected from an object, a color temperature converting filter which varies the color temperature of the strobe light in accordance with the color temperature detected by the color temperature detector and a Fresnel lens provided on the surface of the color temperature conversion filter.

The present disclosure relates to subject matter contained in Japanese patent application Nos. 5-285902, 5-285903 (both filed on Oct. 20, 1993), 5-285699 (filed on Oct. 21, 1993), 5-288610 (filed on Oct. 25, 1993), and 5-301200 (filed on Nov. 5, 1993) which are expressly incorporated herein by reference in its entirety.

BRIEF DESCRIPTION OF THE DRAWINGS

The invention will be described below in detail with reference to the accompanying drawings, in which:

FIG. 21 is a flow chart of a main emission in the sixth embodiment of the present invention;

FIG. 33 is a flow chart of an emission control operation in the ninth embodiment;

DESCRIPTION OF THE PREFERRED EMBODIMENT

Figure 1:
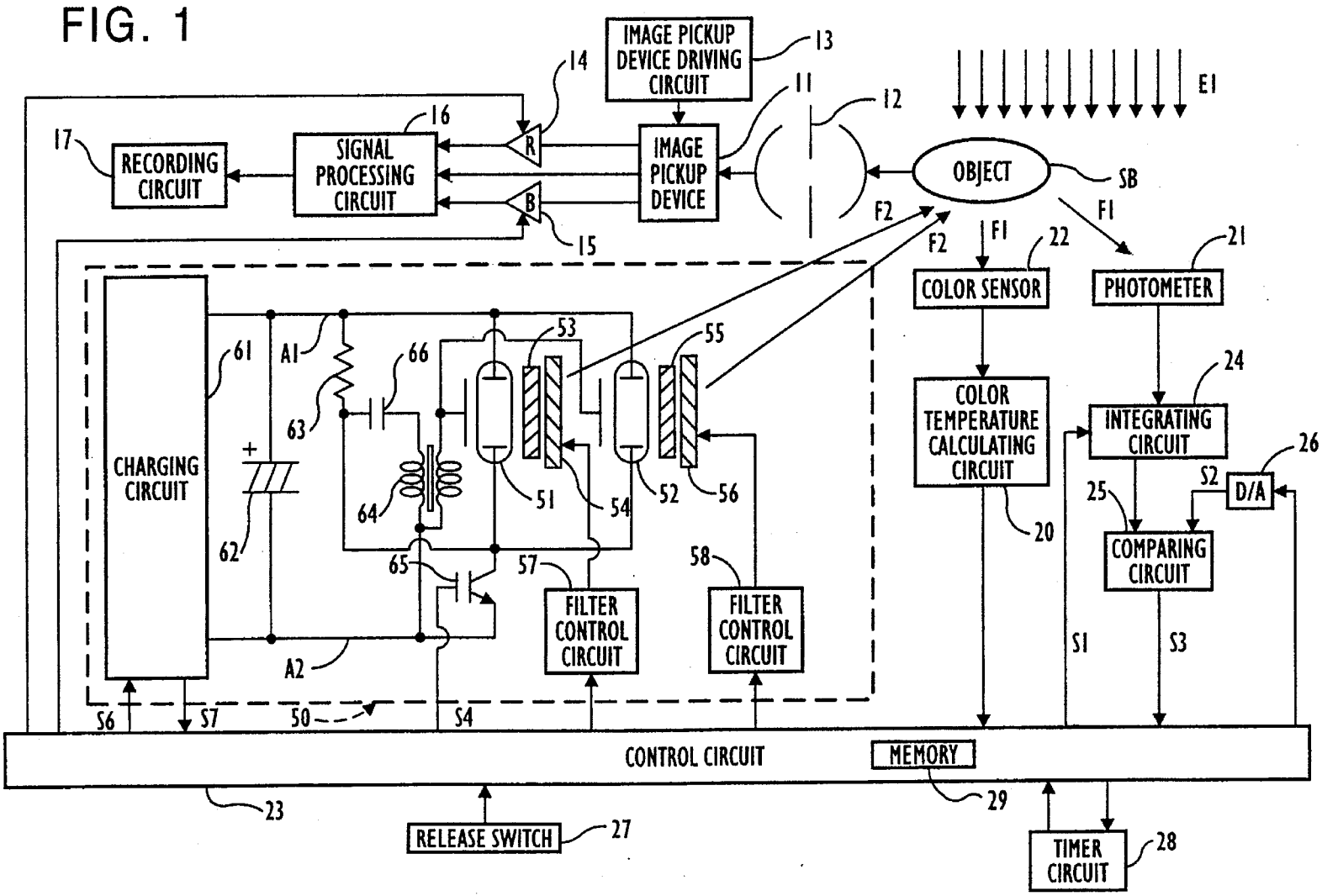
FIG. 1 is a circuit diagram of a still video camera to which a strobe apparatus according to a first embodiment of the present invention is applied.

FIG. 1 shows a circuit diagram of a control circuit for a still video camera to which a first embodiment of a strobe apparatus is applied.

In FIG. 1, two light emitting tubes emit strobed light simultaneously through monochrome liquid crystal filters, so that light reflected from an object to be photographed can be detected to vary a density ratio between the monochrome liquid crystal filters to thereby control a quantity of light to be emitted from the respective light emitting tubes.

An image of an object SB to be photographed is formed on a light receiving surface of a solid-state image pickup device 11 by taking (photographing) lens L. A diaphragm 12 is provided in an optical path of the picture taking lens L to control the quantity of light to be made incident upon the solid-state image pickup device 11 from the object SB. The image pickup device 11 is driven in accordance with shift pulses, etc., generated by an image pickup device driving circuit 13. Consequently, image signals (red color signal, green color signal and blue color signal) produced by the image pickup device 11 in accordance with an object image formed on the light receiving surface thereof are successively read from the image pickup device 11. The R-signal and the B-signal read from the image pickup device 11 are amplified by amplifier circuit 14 and 15 and inputted to a signal processing circuit 16. The G-signal is inputted to the signal processing circuit 16 directly. The amplifiers 14 and 15 are connected to the control circuit 23, so that the adjustment of the gain of the amplifiers 14 and 15, i.e., the white balance adjustment can be effected by the controller 23.

The image signals are converted to a predetermined recording signal format in the signal processing circuit 16 and inputted to a recording circuit 17 in which the recording signals are recorded on a recording medium 18, such as a magnetic disc.

A photometer (sensor) 21, which is made of, for example, a photoelectric transducer, such as a photodiode, receives light F1 reflected from the object SB and converts the same into electric signals to thereby indicate a luminance of the object SB. As will be discussed hereinafter, a color temperature of ambient light E1 is detected by a color temperature measuring sensor 22 before the emission of strobe light by xenon tubes 51 and 52 takes place. Upon emission, the color temperature of light F1 reflected from the object SB is detected by the sensor 22. Color temperature data from sensor 22 is inputted to the controller 23 through a color temperature calculating device 20, so that the color temperature of the strobe apparatus 50 can be determined in accordance with the color temperature data, which will be described hereinafter.

Photometer 21 is connected to an integrating circuit (integrater) 24 which integrates the electric signals outputted from the photometer 21 in response to an integration commencement signal S1. The integrating circuit 24 is connected to the control circuit 23 through a comparing circuit 25 which is in turn connected to a D/A converter 26. The comparing circuit 25 compares a voltage (signal S2) inputted from a D/A converter 26 and an integral value inputted from the integrating circuit 24. When the integral value is identical to the voltage (signal S2), a quenching signal S3 is sent to the control circuit 23. The control circuit 23 causes xenon tubes 51 and 52 to stop the emission of light in accordance with the quenching signal S3.

The strobe apparatus 50 is connected to the control circuit 23 so that the start and finish of the emission of the strobe light by the xenon tubes 51 and 52 of the strobe apparatus 50 are controlled by the control circuit (controller) 23. The first xenon tube 51 emits a strobe light whose color temperature is low. To this end, the first xenon tube 51 is provided on an outer peripheral surface thereof with an amber filter 53 coated thereon. The second xenon tube 52 emits strobe light whose color temperature is high. To this end, the second xenon tube 52 is provided on an other peripheral surface thereof with a blue filter 55 coated thereon. Guest-host type monochrome liquid crystal filters 54 and 56 are respectively provided in front of the first and second xenon tubes 51 and 52. The densities of the monochrome liquid crystal filters 54 and 56 are varied, depending on the amplitude of the voltage to be applied thereto and controlled by the respective filter control circuits 57 and 58 that operate in response to control signals outputted from the controller 23.

Signal line A1, connected to a positive terminal of a charging circuit 61, is also connected to a positive electrode of a main capacitor 62, a resistor 63, and anode terminals of the xenon tubes 51 and 52. Signal line A2, connected to a negative terminal of the charging circuit 61, is also connected to a negative electrode of the main capacitor 62, a common terminal of a trigger transformer 64, and an emitter of an insulation gate bipolar transistor (IGBT) 65. The main capacitor 62 accumulates an electric charge in accordance with an impulse voltage applied thereto by the charging circuit 61 through the signal line A1. A low-voltage coil of the trigger transformer 64 is connected to one end of the resistor 63 through a trigger capacitor 66. The one end of the resistor 63 is also connected to the cathodes of the xenon tubes 51 and 52.

The base of the IGBT 65 is connected to the control circuit 23, so that when the IGBT is activated in response to an emission trigger signal S4 outputted from the control circuit 23, electric current flows from the collector of the IGBT 65 to the emitter thereof. Consequently, the electric charge of the trigger capacitor 66 is discharged, so that the electric current is supplied to the low-voltage coil of the trigger transformer 64, resulting in an induction of a trigger pulse in the high voltage coil thereof. The trigger pulse is applied to the trigger electrodes of the xenon tubes 51 and 52, so that the anodes and cathodes thereof are connected. As a result, the electric charge of the main capacitor 62 is discharged, so that the xenon tubes 51 and 52 emit strobe lights F2 and F3.

A release switch 27 and a timer circuit 28, both provided in the still video camera are connected to the control circuit 23, so that various controls are effected by the operation of the release switch 27. Data for determining the density of the monochrome liquid crystal filters 53 and 56 is stored in a memory 29 provided in the control circuit 23.

Figure 2:
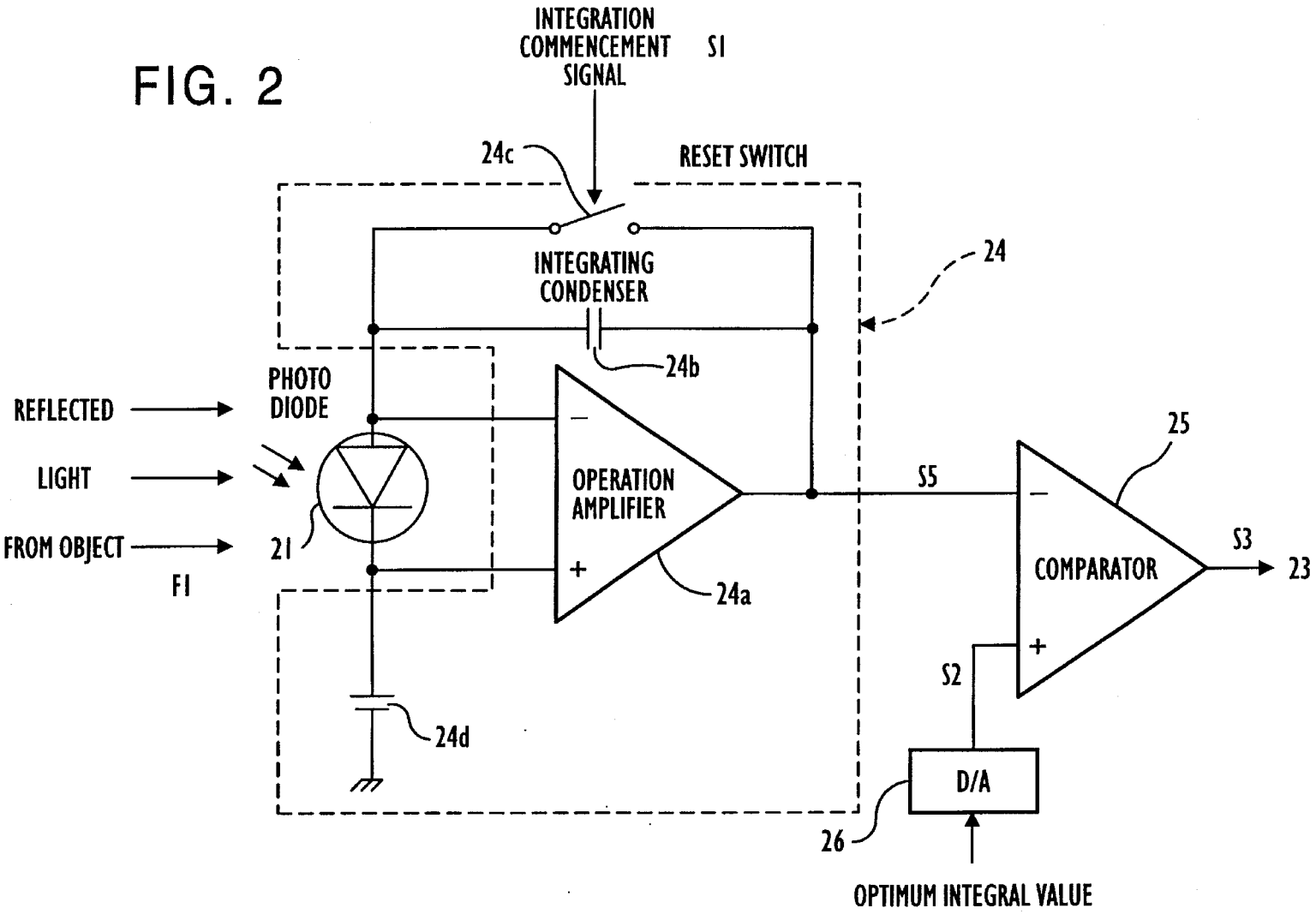
FIG. 2 is an explanatory view of the photometer, integrating circuit and comparing circuit, shown in FIG. 1.

FIG. 2 shows an electrical connection of the photometer 21, the integrating circuit 24, the comparing circuit (comparator) 25, and the D/A converter 26. The integrating circuit 24 has an operation amplifier **24*a*, an integrating capacitor 24*b*, and a reset switch 24*c*. The photometer 21 comprises a photodiode which is connected to an inverted signal input terminal and a non-inverted signal input terminal of the operation amplifier 24*a*. The non-inverted signal input terminal of the operation amplifier 24*a* is connected to a reference power source 24*d*, so that a reference voltage before the commencement of the integration is applied to the operation amplifier 24*a***.

The integrating capacitor **24*b* and the reset switch 24*c* are connected in parallel between the inverted signal input terminal and the non-inverted signal input terminal of the operation amplifier 24*a*, so that the operation of the reset switch 24*c* is controlled in accordance with the integration commencement signal S1 inputted from the control circuit (controller) 23. When the reset switch 24*c* is opened, the photoelectric current produced in the photometer 21 is integrated by the operation amplifier 24*a*. The output terminal of the operation amplifier 24*a* is connected to the inverted signal input terminal of the comparator 25**.

The D/A converter 26 is connected to the non-inverted signal input terminal of the comparator 25 in which the voltage value of the output signal S2 of the D/A converter 26 is compared with the voltage value of the output signal S5 of the operation amplifier **24*a*. If the voltage value of the signal S5 is lower than the voltage value of the signal S2, the quenching signal S3 is outputted from the comparing circuit 25 to the control circuit 23. Note that the voltage value of the signal S2 is determined in accordance with digital data supplied to the D/A converter 26 from the controller 23**. The setting of the voltage value of the signal S2 is carried out by an optimum integral value setting operation, which will be discussed hereinafter.

Figure 3:
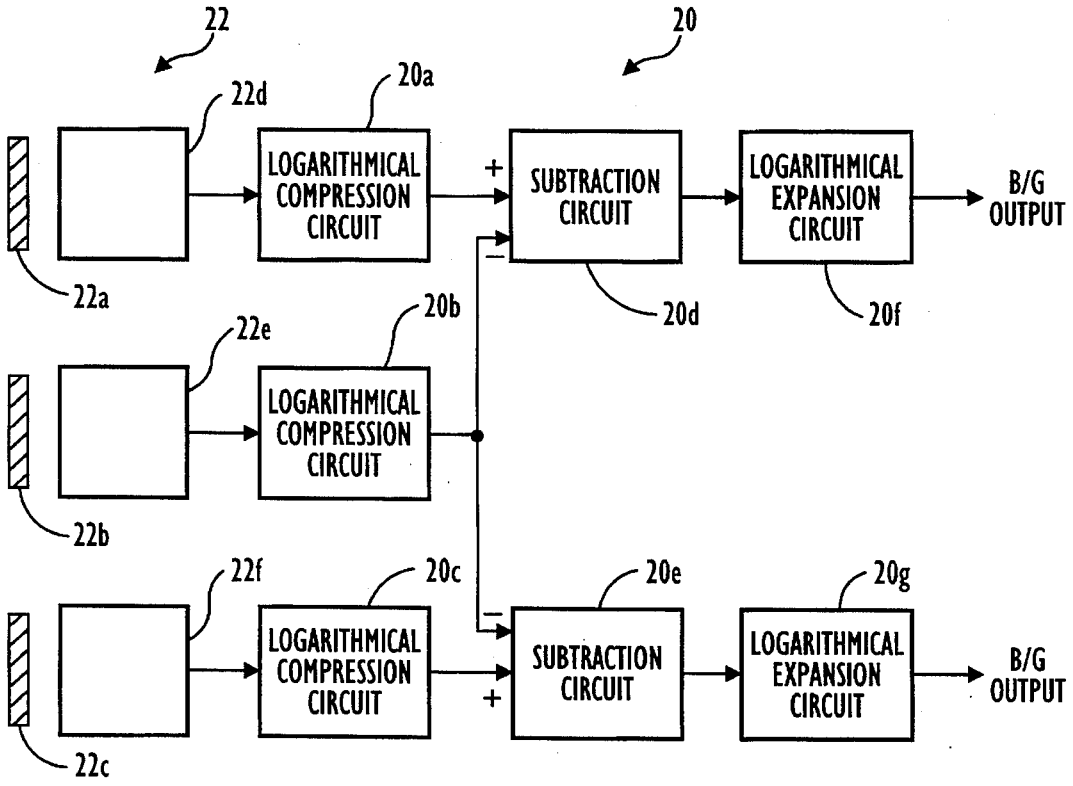
FIG. 3 is a circuit diagram of a color sensor and a color temperature calculating circuit.

FIG. 3 shows a block diagram of a color temperature sensor 22 and a color temperature calculating circuit 20. The sensor 22 includes R-filter **22*a*, G-filter 22*b* and B-filter 22*c* which extract R component, G component and B component of ambient light, and photo sensors 22*d*, 22*e* and 22*f* which convert the R, G and B components to electrical signals, respectively. The R, G and B signals outputted from the photo sensors 22*d*, 22*e* and 22*f* are inputted to logarithmic compression circuits 20*a*, 20*b* and 20*c* of the color temperature calculating circuit 20 and are logarithmically compressed. The difference (R–G) between the R-signal and the G-signal outputted from the logarithmic compression circuits 20*a* and 20*b* is calculated by a subtracting circuit 20*d*. The difference signal (R–G) thus obtained is logarithmically expanded by the logarithmic expansion circuit 20*f* and outputted to the control circuit 23 as R/G signals. Similarly, the difference (B–G) between the B-signal and the G-signal outputted from the logarithmic compression circuits 20*c* and 20*b* is calculated by a subtracting circuit 20*e*. The difference signal (B–G) thus obtained is logarithmically expanded by the logarithmic expansion circuit 20*g* and outputted to the control circuit 23 as B/G signals. Consequently, the color temperature of light inputted to the color temperature sensor 22 is detected in accordance with the R/G signals and B/G signals in the controller 23. As a result, the density data of the liquid crystal filters 54 and 55** is determined to obtain a desirable resultant color temperature.

Figure 4:
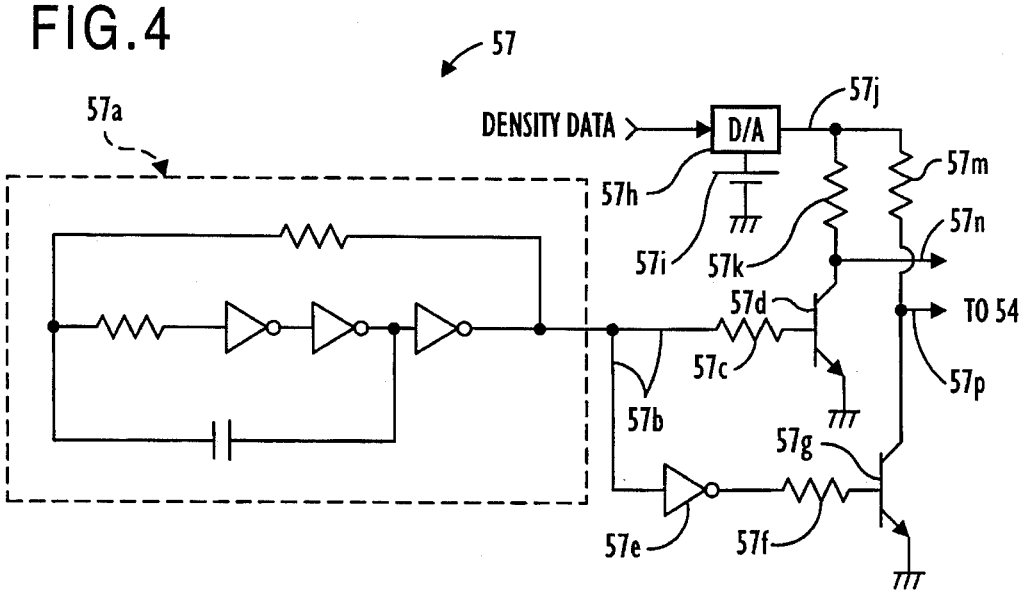
FIG. 4 is a circuit diagram of a voltage control circuit for controlling the voltage to be applied to a liquid crystal filter.

FIG. 4 shows the internal structure of a voltage control circuit 57 which controls the voltage to be applied to the liquid crystal filters. Oscillator 57*a*, as known, comprises a plurality of invertors, a resistor, and a capacitor in combination. Signal line 57*b*, connected to the output terminal of the oscillator 57*a*, is connected to the base of transistor 57*d* through resistor 57*c*, and to the base of transistor 57*g* through invertor 57*e* and resistor 57*f*, respectively. D/A converter 57*h* is connected to a constant voltage power source 57*i* and outputs an electric signal whose amplitude correspond to density data inputted from the controller 23. Signal line 57*j*, connected to the D/A converter 57*h*, is connected, through resistors 57*k* and 57*m*, to the collectors of transistors 57*d* and 57*g* that are in turn connected to the liquid crystal filter 54 through signal lines 57*n* and 57*p*.

The voltage signal of the rectangular wave from the oscillator 57*a*, which varies at a predetermined cycle, is applied to the bases of transistors 57*d* and 57*g* and the liquid crystal driving signal of the rectangular wave, which varies at the same cycle as the first-mentioned rectangular wave, is inputted to the liquid crystal filter 54 through the signal lines 57*n* and 57*p*. The amplitude of the liquid crystal driving signal is determined in accordance with the amplitude of the signal outputted from the D/A converter 57*h*, so that the density of the monochrome liquid crystal filter 54 can be controlled in accordance with the amplitude of the liquid crystal driving signal. Note that since the phases of the voltage to be applied to the bases of transistors 57*d* and 57*g* are opposite to each other, the phases of the rectangular wave signals outputted through signal lines 57*n* and 57*p* are opposite to each other. The structure of the voltage control circuit 58, as shown in FIG. 1, which controls the voltage to be applied to the liquid crystal filters is the same as the voltage control circuit 57, so that the density of the monochrome liquid crystal filter 56 can be similarly controlled.

Figure 5:
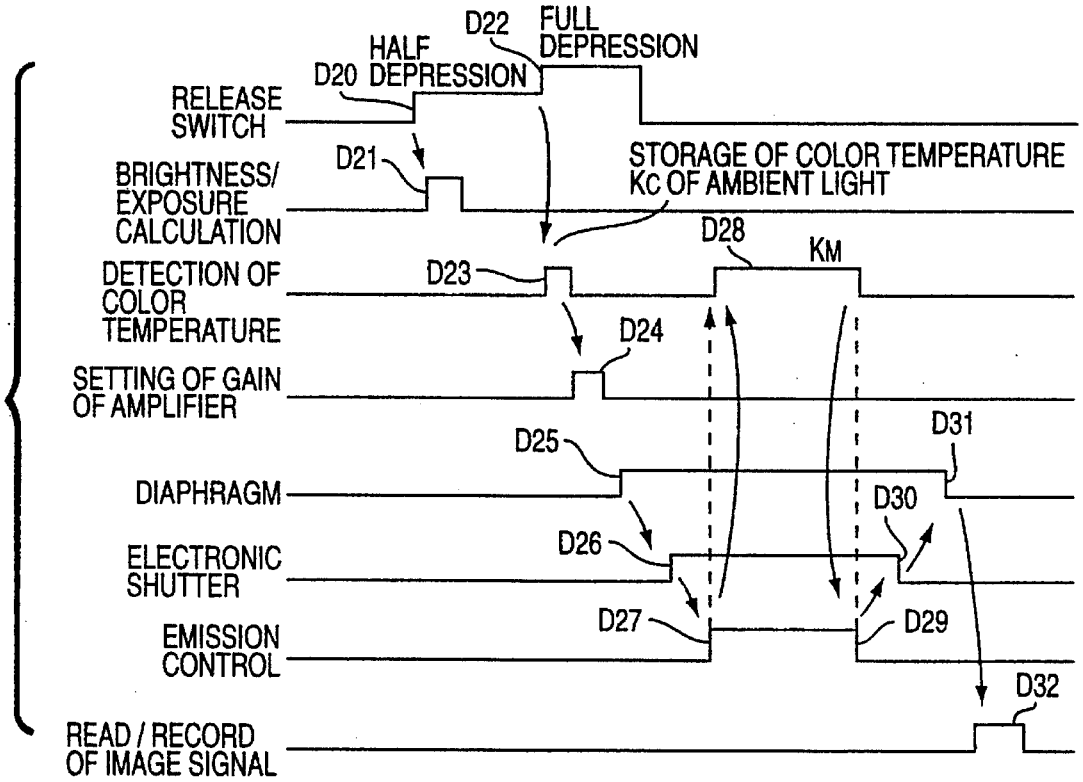
FIG. 5 is a sequence diagram of the photographing operations of the still video camera shown in FIG. 1.

FIG. 5 shows a sequence diagram of the photographing operation in the illustrated embodiment.

When release switch 27 is depressed by a half stroke (D20), the controller 23 detects luminance of the object SB in accordance with photometering data which is obtained by a photometer (not shown), different from the photometer 21, to determine an exposure value based on the photometering data (D21).

In the calculation for determining the exposure value (exposure calculation), the operation time of the electronic shutter of the image pickup device 11 and the quantity of the strobe light to be emitted by the strobe apparatus 50 are determined. The charging operation for the main capacitor 62 by the charging circuit 61 is commenced when a main switch (not shown) is turned ON or a strobe-photographing indicating switch (not shown) or the like is actuated, so that charge commencement signal S6 is outputted from the control circuit 23. Also, the charging operation is commenced when the strobe emission control is completed.

The charging circuit 61 outputs the high voltage current to the main capacitor 62 in response to the charge commencement signal S6. Consequently, electric charges for strobe emission are accumulated by the high voltage current in the main capacitor 62. When the main capacitor 62 is charged with a predetermined quantity of electric charge, the potential of signal line A1 reaches a predetermined value, so that the charging circuit 61 no longer outputs the high voltage current. Hence, the accumulation of the electric charge in the main capacitor 62 by the charging circuit is completed. Thereafter, a charge completion signal S7, which represents the completion of the accumulation of the charges in the main capacitor 62, is outputted from the charging circuit 61 to the control circuit 23. Consequently, the control circuit 23 determines that a picture can be taken using a strobe emission, i.e., strobe-photographing can be effected.

After the object brightness and exposure are calculated (D21), if the release switch 27 is fully depressed (D22), a color temperature $K_c$ of the ambient light E1 of the object SB is obtained by the control circuit 23 in accordance with the signal inputted from the sensor 22 (D23).

The color temperature detecting sensor 22 includes photosensors 22*d*, 22*e* and 22*f* having filters 22*a*, 22*b* and 22*c* of difference spectral sensitivities in a visible light area. The ratio of the output signals of sensors 22*d*, 22*e* and 22*f* does not depend upon the quantity of light received and is in direct proportion to the color temperature. The color temperature calculating circuit 20 calculates the ratio of the output signals which is inputted to the controller 23 where the color temperature $K_c$ of the ambient light E1 is obtained. Memory 29 of the controller 23 has stored therein a data table which shows a relationship between the signals outputted from the color temperature calculating circuit 29 and color temperature data corresponding thereto. Thus, color temperature $K_c$ of the ambient light E1 is calculated with reference to the data table, using the ratio of the output signals from the color temperature calculating circuit 20. Consequently, the gains of amplifiers 14 and 15 are set in accordance with the color temperature $K_c$ (D24).

Thereafter, the aperture of the diaphragm 12 is adjusted in accordance with the value detected by the photometer sensor to control the quantity of light reflected from the object SB and incident upon the image pickup device 11 (D25). Thereafter, the accumulation time of the electric charges of the photoelectric conversion signals in the image pickup device 11, i.e., the electronic shutter time is determined in accordance with the detection result of the photo sensor, so that the accumulation of the electric charges (main exposure) is started (D26). If it is determined that the strobe emission is necessary in accordance with the detection result of the photo sensor, the control of the strobe emission is started at the same time as the accumulation of the electric charges (D27).

The color temperature $K_M$ of light F1 reflected from the object SB is obtained by the controller 23 in accordance with the signals outputted from the photo sensor 22, substantially in synchronization with the commencement of the control of the strobe emission (D28). Moreover, a predetermined voltage is applied to the electrodes of the monochrome liquid crystal filters 54 and 56, so that the color temperature $K_M$ of the reflected light F1 is identical to the color temperature $K_c$ of the ambient light E1. Thus, the liquid crystal filters 54 and 56 are controlled so as to have predetermined densities. Namely, the color temperature of the actual strobe light is monitored during the main exposure to correct a color temperature error. When the quantity of light F1 reflected from the object SB reaches a predetermined value, the emission of strobe light is stopped (D29).

When the photographing operation is completed as mentioned above, the controller 23 causes the image pickup device driving circuit 13 to send a control signal to the image pickup device 11 to thereby complete the accumulation of the image pickup device 11 (D30) and close the diaphragm 12 (D31). At the same time, the voltage that has been applied to the electrodes of the liquid crystal filters 54 and 56 is released, so that the liquid crystals are returned to an inoperative position. Thereafter, a signal charge reading control signal, such as a transfer pulse is outputted from the image pickup device driving circuit 13 to the image pickup device 11, so that the signal charges accumulated in the image pickup device 11 are read as image signals which are then inputted to the signal processing circuit 16 in which the image signals are converted to a predetermined format of image signals. Hence, the image signals are recorded on a recording medium (not shown) by the recording circuit 17 (D32).

Figure 6:
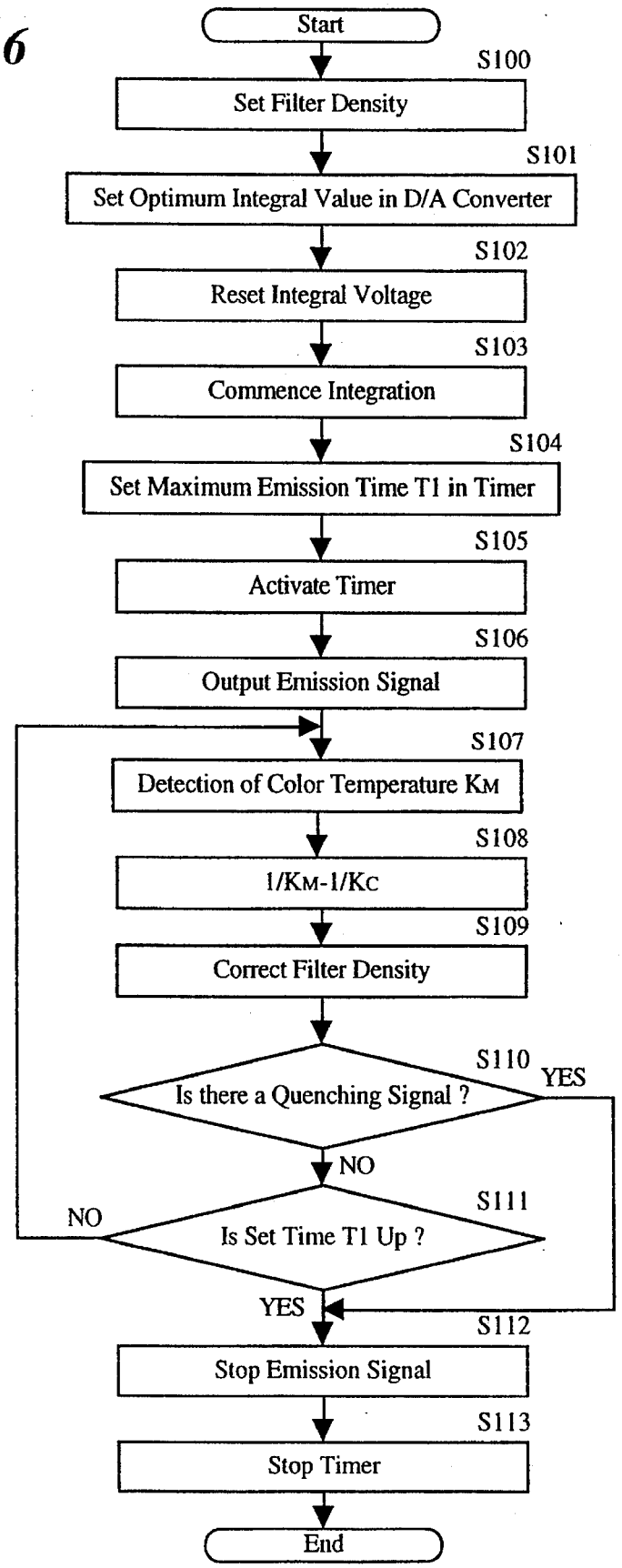
FIG. 6 is a flow chart of the strobe light emitting operation in the first embodiment.

FIG. 6 shows a flow chart of the strobe emission control operation of the controller 23.

At step S100, density data of the monochrome liquid crystal filters 54 and 56 corresponding to a reciprocal ($1/K_c$) of the color temperature ($K_c$) of the ambient light stored in the memory 29 of the controller 23 is read from the memory 29 and set in the voltage control circuits 57 and 58 which control the voltage to be applied to the liquid crystal filters. Namely, the density of the monochrome liquid crystal filter 54 provided in front of the blue filter 53 decreases and the density of the monochrome liquid crystal filter 56 provided in front of the amber filter 55 increases as the color temperature of the ambient light increases. Conversely, the density of the monochrome liquid crystal filter 54 increases and the density of the monochrome liquid crystal filter 56 decreases as the color temperature of the ambient light decreases. At step S101, the optimum integral value (exposure level) is read from the memory 29 and inputted to the D/A converter 26.

At step S102, the integral value outputted from the integrating circuit 24 is reset. Thereafter, at step S103, the integration of the operation amplifier **24*a* in the integrating circuit 24 is performed in response to the integration commencement signal S1. At the same time as the integral operation, the maximum emission time T1 is set in the timer circuit 28 at step S104, and the timer commences the counting operation at step S105. At step S106, the trigger signal S4 is outputted to the IGBT 65 to actuate the same. As a result, the trigger voltage is applied to the trigger electrodes of the xenon tubes 51 and 52**, so that the latter emit the strobe light.

The color temperature $K_M$ of the reflected light F1 is detected by the color temperature detecting sensor 22 at step S107. At step S108, a calculation is carried out to obtain the value of $\{(1/K_M)-(1/K_c)\}$ in accordance with the reciprocal ($1/K_c$) of the color temperature $K_c$ of the ambient light E1 stored in the memory 29. The value is equal to zero when the color temperature $K_M$ of the reflected light F1 is identical to the color temperature $K_c$ of the ambient light E1 and varies depending on the color temperatures $K_M$ and $K_c$.

The density correcting data of the liquid crystal filters corresponding to the values of $1/K_c$ and $\{(1/K_M)-(1/K_c)\}$ are read from the memory 29 and sent to the voltage control circuits 57 and 58 at step S109. For instance, if $K_M<K_c$, that is, if the color temperature of the reflected light F1 is lower than the color temperature of the ambient light E1, the density of the liquid crystal filter 54 located in front of the blue filter 53 is reduced to increase the color temperature of the strobe light. Conversely, if $K_M>K_c$, that is, if the color temperature of the reflected light F1 is higher than the color temperature of the ambient light E1, the density of the liquid crystal filter 56 located in front of the amber filter 55 is reduced to decrease the color temperature of the strobe light. It should be appreciated that the memory from which data is read at step S109 can be efficiently utilized if the data to be controlled is set in accordance with the sight so that the difference between reciprocals of the consecutive color temperatures is constant.

When the integral value of the integrating circuit 24 reaches the value of the signal S2 (optimum integral value) as a result of an increase in the quantity of light F1 reflected from the object Sb, the quenching signal S3 is outputted from the comparator 25. If the output of the quenching signal S3 is confirmed at step S110, the issuance of the trigger signal S4 for emission is stopped at step S112. Consequently, the emission of strobe light from the xenon tubes 51 and 52 is stopped. If there is no quenching signal S3 at step S110, control proceeds to step S111 to determine whether the time set in the timer circuit 28 has expired. If the set time has not expired, control is returned to step S107 to determine the presence or absence of the quenching signal S3. Conversely, if the set time has expired at step S111, control proceeds to step S112 to compulsively stop the output of the trigger signal S4. Thereafter, the IGBT 65 is turned OFF and the emission of the strobe light from the xenon tubes 51 and 52 is stopped. Thereafter, the timer circuit 28 is deactivated at step S113 and hence, the program ends.

As can be seen from the foregoing, in the illustrated embodiment, the color temperature $K_M$ of the reflected light is always detected when the strobe light is emitted, so that the densities of the liquid crystal filters 54 and 56 are adjusted in accordance with the difference in the color temperature between the strobe light and the ambient light to make the color temperature $K_M$ of the reflected light coincident with the color temperature $K_c$ of the ambient light. Therefore, even if there is a variation over time in the color temperature of the xenon tubes 51 and 52 or the conversion power of the filters 53 and 55, the color temperature of the strobe light can always be correctly compensated to improve the white balance of the object image. Moreover, since the color temperature $K_c$ of the ambient light E1 and the color temperature $K_M$ of the light F1 reflected from the object SB are detected by the single photo sensor 22, there is no increase in the manufacturing cost, size or weight of the strobe apparatus.

Figure 7:
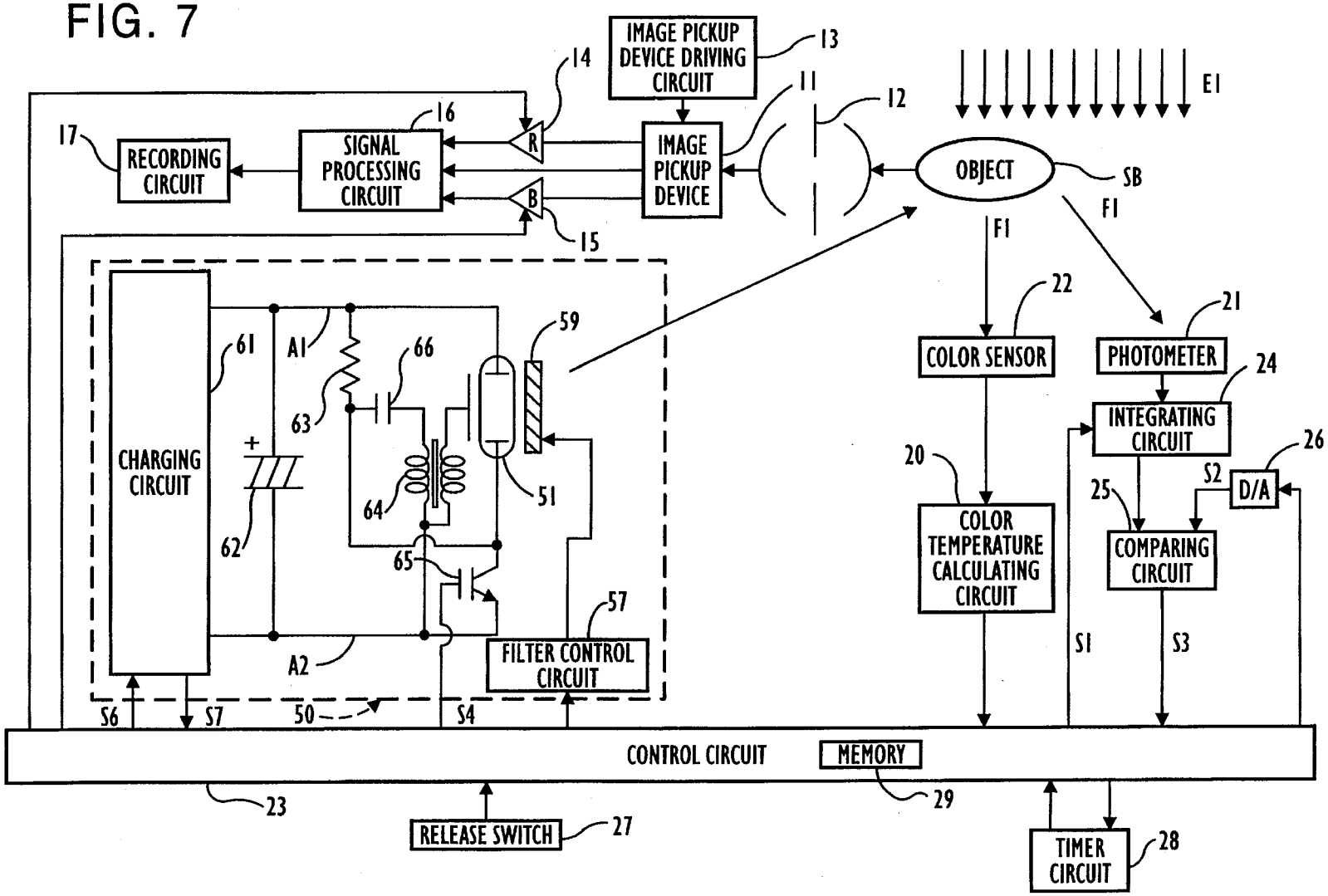
FIG. 7 is a circuit diagram of a still video camera to which a strobe apparatus according to a second embodiment of the present invention is applied.

FIG. 7 shows a second embodiment of the present invention, applied to a still video camera. In FIG. 7, the elements corresponding to those in the first embodiment are designated by the same reference numerals. The circuit arrangement shown in FIGS. 2–4 is common to the second embodiment. Furthermore, the photographing operation and the strobe emission control are basically the same as those shown in FIGS. 5 and 6.

Unlike the first embodiment which is applied to a simultaneous emission type strobe apparatus having two light emitting tubes, there is only a single light emitting tube (xenon tube) in the second embodiment. A white Taylor liquid crystal filter 59 is provided in front of the xenon tube 51, the color temperature of the filter being controlled in accordance with the color temperature of the ambient light E1. The voltage to be applied to the liquid crystal filter 59 is controlled by the voltage control circuit 57, so that the color temperature of the liquid crystal filter 59 can be controlled in accordance with the amplitude of the voltage. Other structure of the strobe apparatus in the second embodiment is the same as in the first embodiment. Note that a hue data signal (density data) which represents the hue of the liquid crystal filter 59 is inputted to a D/A converter **57*h* in the voltage control circuit 57**.

The emission control of the strobe light in the second embodiment is the same as that (FIG. 6) of the first embodiment, except for the following points:

Namely, hue data of the liquid crystal filter 59 is read from the memory 29 at step S100. Also, hue correction data for the liquid crystal filter 59 is read from the memory 29 at step S109. In the correction of the hue of the liquid crystal filter 59, it is adjusted such that the color temperature increases when the value of $K_M$ is lower than the value of $K_c$ ($K_M<K_c$), and the color temperature decreases when the value of $K_M$ is higher than the value of $K_c$ ($K_M>K_c$), respectively.

The same technical effect as in the first embodiment can be obtained in the second embodiment.

Figure 8:
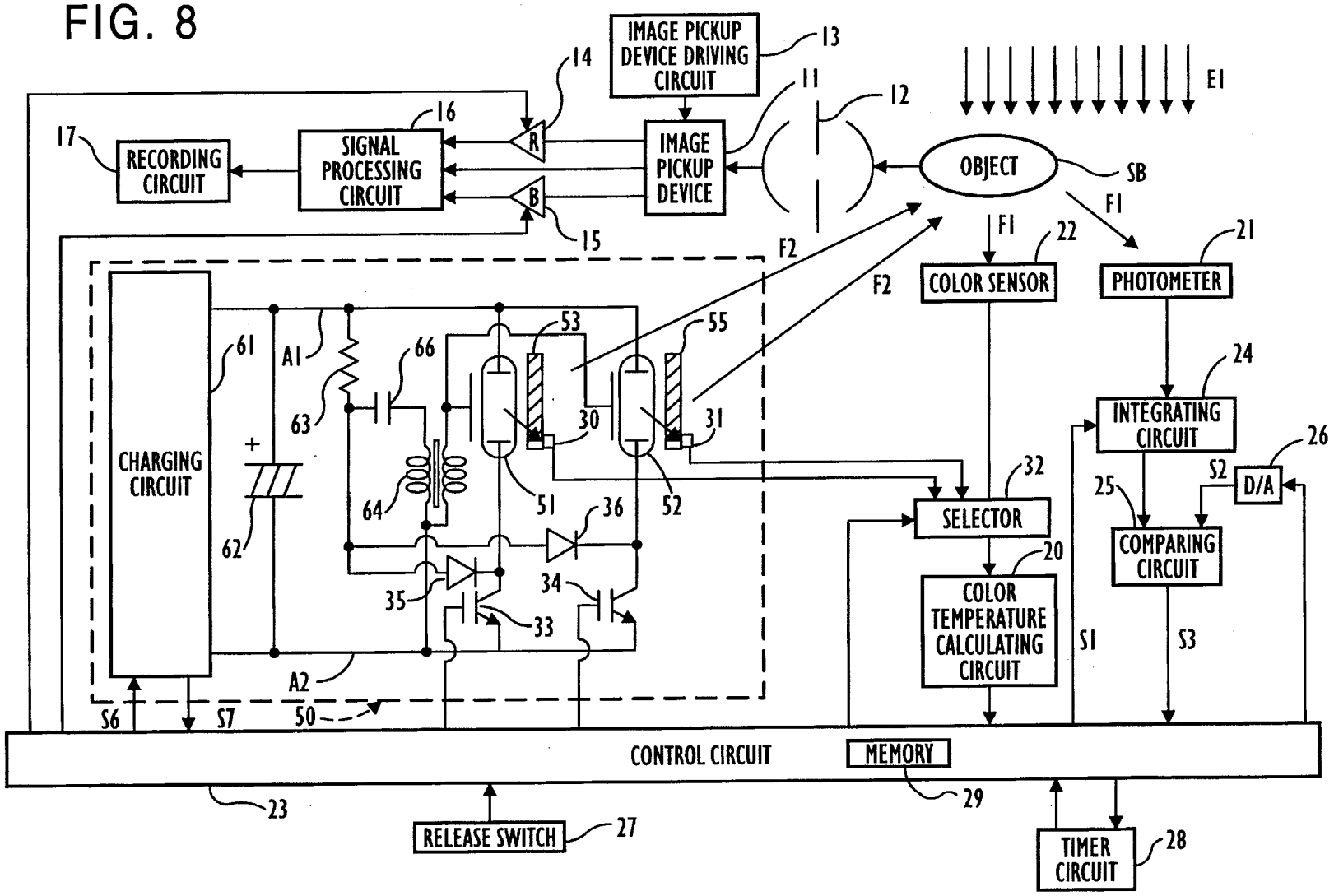
FIG. 8 is a circuit diagram of the still video camera to which a strobe apparatus according to third and fifth embodiments of the present invention is applied.

FIG. 8 shows a block diagram of a still video camera having a strobe apparatus according to a third embodiment of the present invention. In FIG. 8, the elements corresponding to those in the first and second embodiments are designated with the same reference numerals. The circuit arrangement shown in FIGS. 2 and 3 is common to the third embodiment. Furthermore, the photographing operation is basically the same as that shown in FIG. 5.

In the third embodiment, there are two xenon tubes 51 and 52 which successively emit strobe light incident upon the object SB through the blue filter 53 and the amber filter 55, respectively. The color temperatures $K_A$ and $K_B$ of the strobe light transmitted through the filters 53 and 55 are detected, so that the resultant color temperature of the strobe light incident upon the object SB can be controlled by controlling the rate of the light emission time of the xenon tubes 51 and 52. The light emissions of the xenon tubes 51 and 52 are carried out by alternately switching the IGBT's 33 and 34 at high speed.

The blue filter 53 and the amber filter 55 are provided with color temperature detecting sensors (color sensors) 30 and 31 which detect the color temperatures $K_A$ and $K_B$ of the strobe light transmitted through the respective filters. The outputs of the color sensors 30 and 31 are input to the selector 32 which selects the signal to be input to the color temperature calculating circuit 20 in accordance with the selection signal output from the controller 23. Signal line, A2 connected to the charging circuit 61, is connected to the emitters of the IGBTs 33 and 34 corresponding to the xenon tubes 51 and 52 to control the emission time. The low voltage coil of the trigger transformer 64 is connected, through the trigger condenser 66, to one end of the resistor 63, which is connected to the cathodes of the xenon tubes 51 and 52 and the collectors of the IGBTs 33 and 34 through the diodes 35 and 36, respectively.

Figure 9:
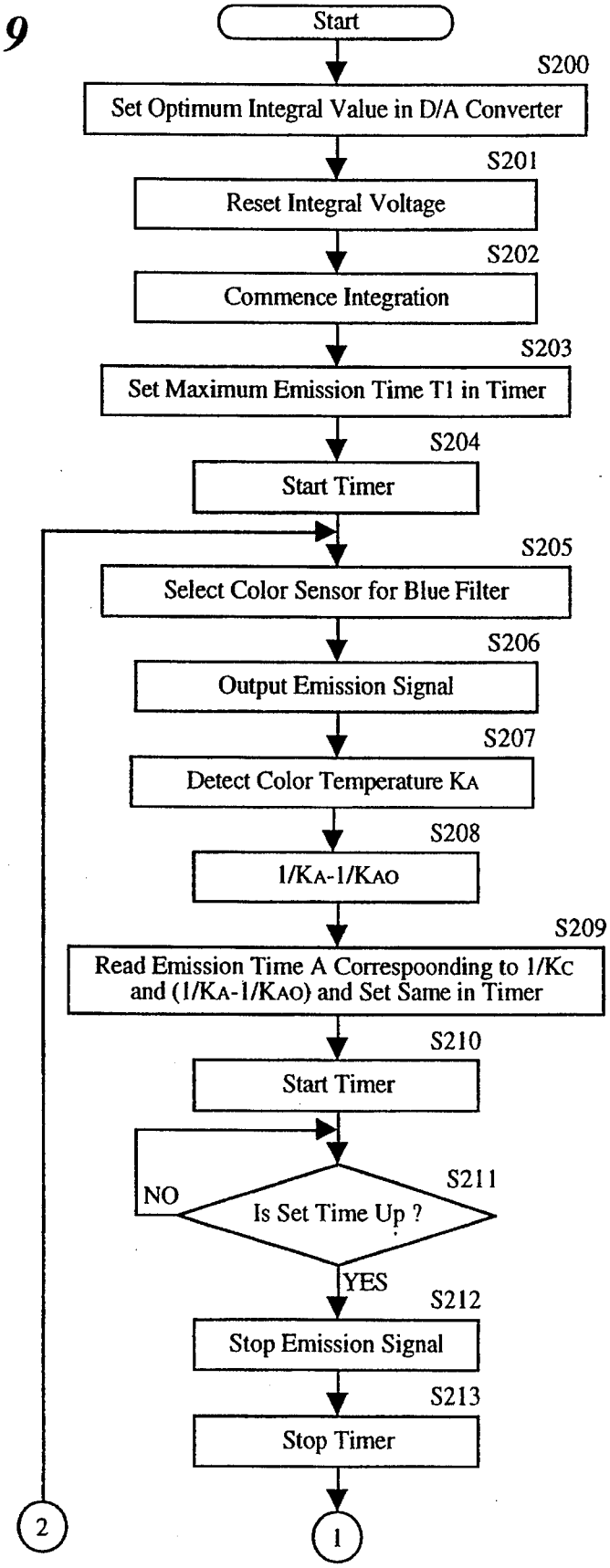
FIG. 9 is a flow chart of a first half of a strobe light emitting operation in the third embodiment.
Figure 10:
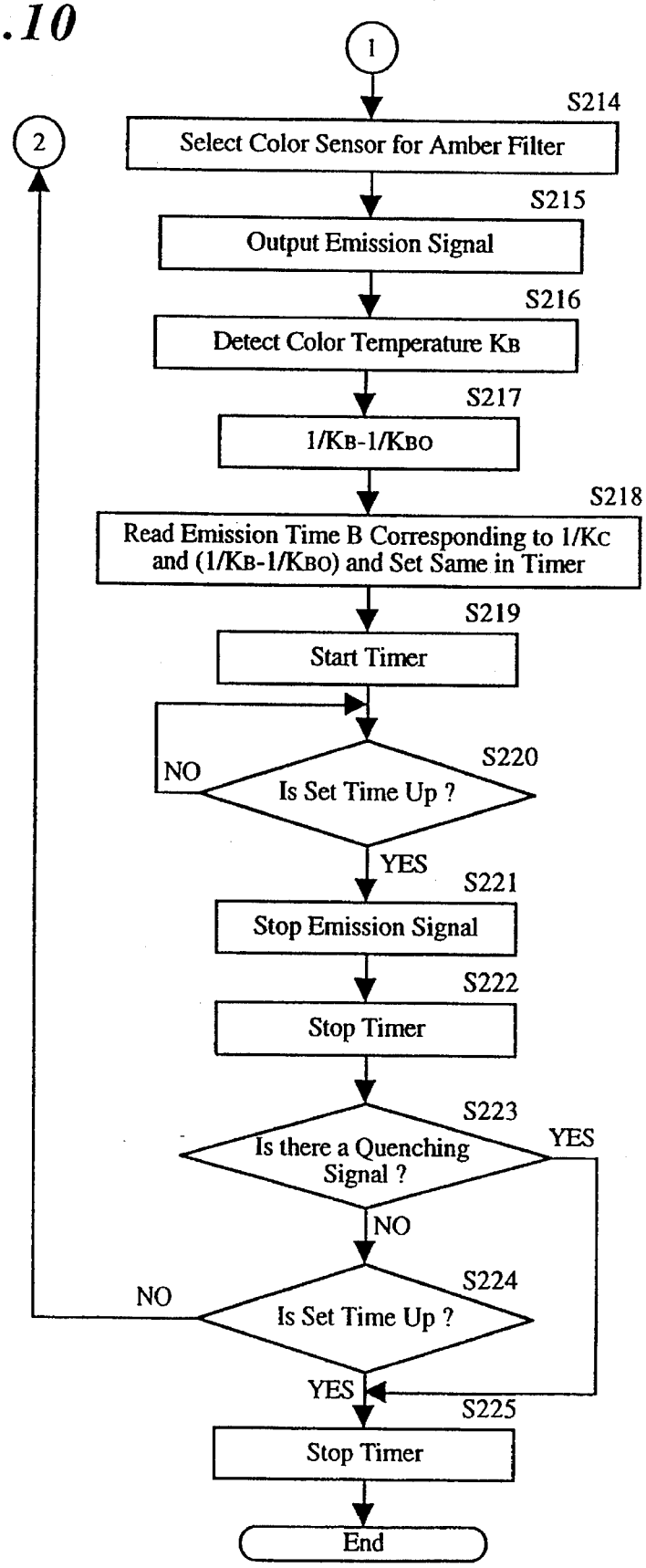
FIG. 10 is a flow chart of a second half of a strobe light emitting operation in the third embodiment.

FIGS. 9 and 10 show a flow chart of the emission control of the strobe light in the controller 23, in the third embodiment of the present invention.

In FIG. 9, operations from step S200 (optimum integral value setting operation) to step S204 (timer starting operation) are the same as those at steps S101 to S105 shown in FIG. 6.

At step S205, selector 32 selects the color sensor 30 provided in front of the blue filter 53, so that the signal from the color sensor 30 is inputted to the color temperature calculating circuit 20. The trigger signal is output to the IGBT 33 at step S206 to turn IGBT 33 ON. Consequently, the trigger voltage is applied to the trigger electrodes of the xenon tube 51 to emit the strobe light from the xenon tube 51.

After the strobe light is emitted, the color temperature $K_A$ of the strobe light F2, which is to be made incident upon the object SB, is detected by the color sensor 30 at step S207. At step S208, a difference $\{(1/K_A)-(1/K_{AO})\}$ between the reciprocal of the color temperature $K_A$ of the actual strobe light transmitted through the xenon tube 51 and the reciprocal of the color temperature $K_{AO}$ of the strobe light determined from the design, is calculated to include a variation over time of the color temperature of the xenon tube 51.

Thereafter, at step S209, the light emission time "A" of the xenon tube 51 corresponding to the value of $\{(1/K_A)-(1/K_{AO})\}$ is read from memory 29 with reference to the data table stored in the memory in accordance with the value of the reciprocal $1/K_c$ of the color temperature of the ambient light E1 and is set in the timer circuit 28. At step S210, the timer begins the counting operation. The emission of the strobe light from the xenon tube 51 continues until the set time "A" is over at step S211. After the lapse of the set time "A", control proceeds to step S212 to stop the issuance of the trigger signal. Consequently, IGBT 33 is turned OFF and the emission of the strobe light from the xenon tube 51 is stopped. Thereafter, at step S213, the timer circuit 28 is deactivated to stop the light emission of the strobe light by the xenon tube 51.

The light emission of the strobe light, as mentioned above, is similarly performed for the xenon tube 52 which emits the strobe light through the amber filter 55. Namely, the operations at steps S205 and S213 in the first embodiment are effected for the color sensor 31 and the xenon tube 52 at steps S214–S222 in the flow chart following step S213, as shown in FIG. 10. Note that the color temperature of the strobe light F2 detected by the color sensor 31 is designated as $K_B$; the design value of the color temperature of the strobe light emitted from the xenon tube 52 and transmitted through the amber filter 55 is designated by $K_{BO}$; and the emission time is designated by "B", respectively. Namely, the resultant color temperature increases and decreases as the emission time "A" increases and the emission time "B" increases, respectively.

After the light emission of the strobe light from the xenon tube 52 is completed, it is determined whether the quenching signal S3 is generated at step S223. If the quenching signal S3 is output, control proceeds to step S225 to stop the timer which was started at step S204, and hence the program ends. If there is no quenching signal S3 at step S223, the time set in the timer circuit 28 is checked at step S224. If the set time does not exceed the maximum emission time T1, control is returned to step S205 to repeat the light emission of the strobe light from the xenon tube 51. Conversely, if the set time exceeds the maximum emission time T1, the timer circuit 28 is deactivated at step S225, and hence the program ends.

Figure 11:
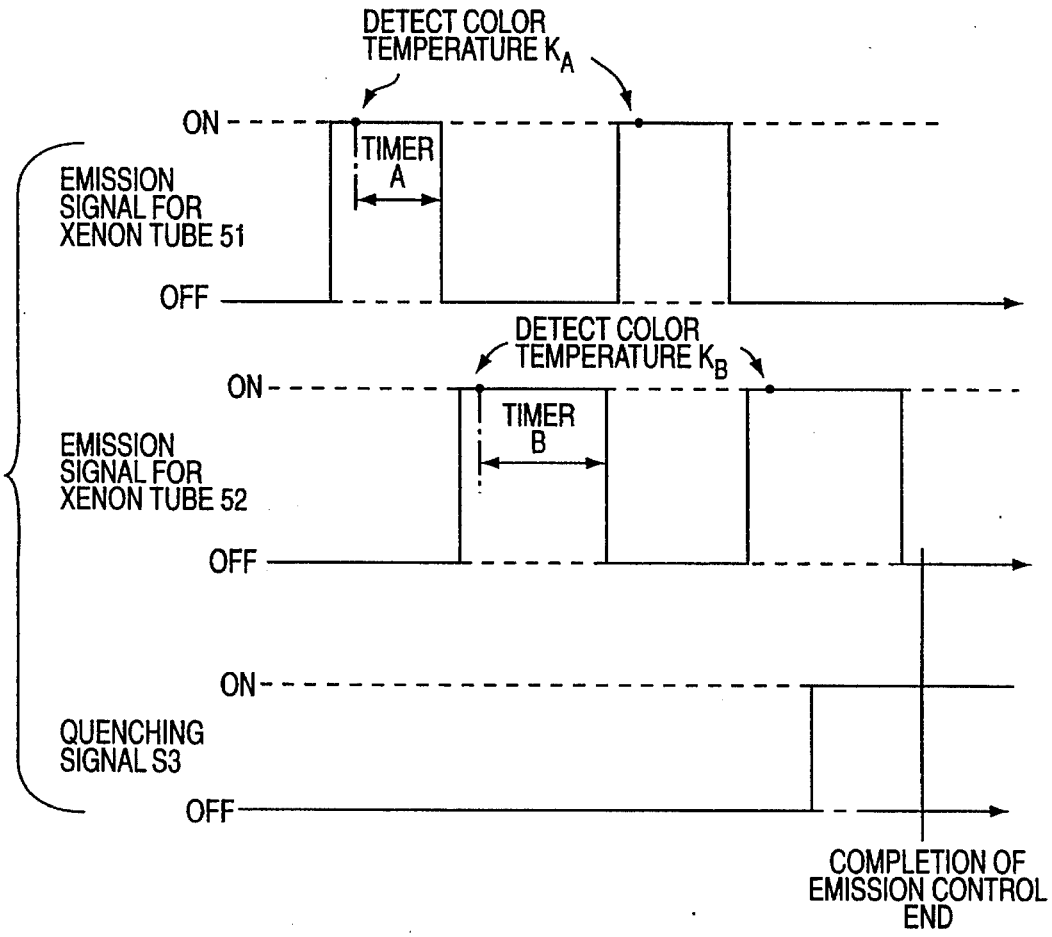
FIG. 11 is a sequence diagram of the strobe emission in the third embodiment of the present invention.

As can be seen from the above discussion, according to the third embodiment in which the xenon tubes 51 and 52 alternately and slightly emit the strobe light, the color temperatures $K_A$ and $K_B$ of the strobe light F2 incident upon the object SB are directly detected, so that the rate of the times for the light emission can be controlled accordingly so as to make the resultant color temperature of the strobe light coincidental with the color temperature of the ambient light E1 of the object SB. FIG. 11 shows a timing chart of the emission control of the xenon tubes 51 and 52, i.e., timing for the detection of the color temperatures $K_A$, $K_B$ and the counting operation for the emission times "A" and "B" by the timer. In FIG. 11, the alternate emission of the strobe light by the xenon tubes 51 and 52 continues until the quenching signal S3 is outputted. The total emission times of the xenon tubes are different from each other.

The same technical effect as the first and second embodiments can be expected from the third embodiment.

Note that in the third embodiment, the color temperatures of the strobe lights emitted from the xenon tubes through the filters are detected in the main exposure, so that the color temperatures thus detected are fed-back to control the emission time or ON-OFF time of the operation of the filters, etc., until the quenching signal S3 is outputted. Alternatively, it is possible to detect the color temperatures of the strobe lights prior to the main exposure, if it is difficult to carry out the feed-back control during the main exposure.

Figure 12:
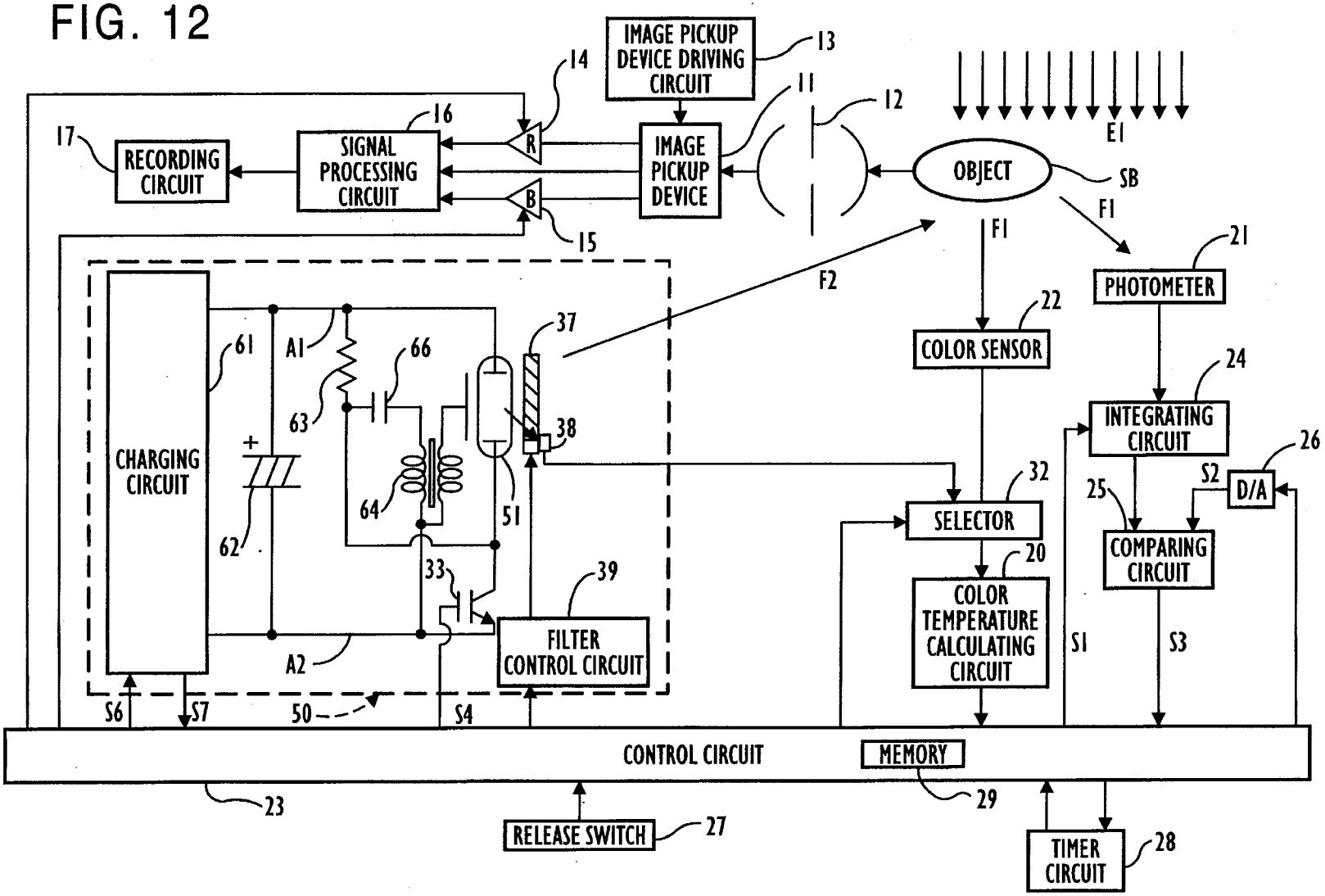
FIG. 12 is a circuit diagram of a still video camera to which the strobe apparatus according to fourth and sixth embodiments of the present invention is applied.

FIG. 12 shows a fourth embodiment of a strobe apparatus applied to a still video apparatus, according to the present invention. In the fourth embodiment, there is a single xenon tube (light emitter) 51. An amber liquid crystal filter 37 is provided in front of the xenon tube 51 to lower the color temperature. The color sensor 38 detects the color temperature $K_D$ of the strobe light F2 transmitted through the amber liquid crystal filter 37. The control of the color temperature is effected by the liquid crystal filter control circuit 39 which controls the time in which the filter is selectively tinted or transparent. Other structure of the fourth embodiment is identical to that of the third embodiment. The circuitry shown in FIGS. 2 and 3 can be commonly applied to the fourth embodiment. The photographing operation in the fourth embodiment is identical to that shown in FIG. 5.

Figure 13:
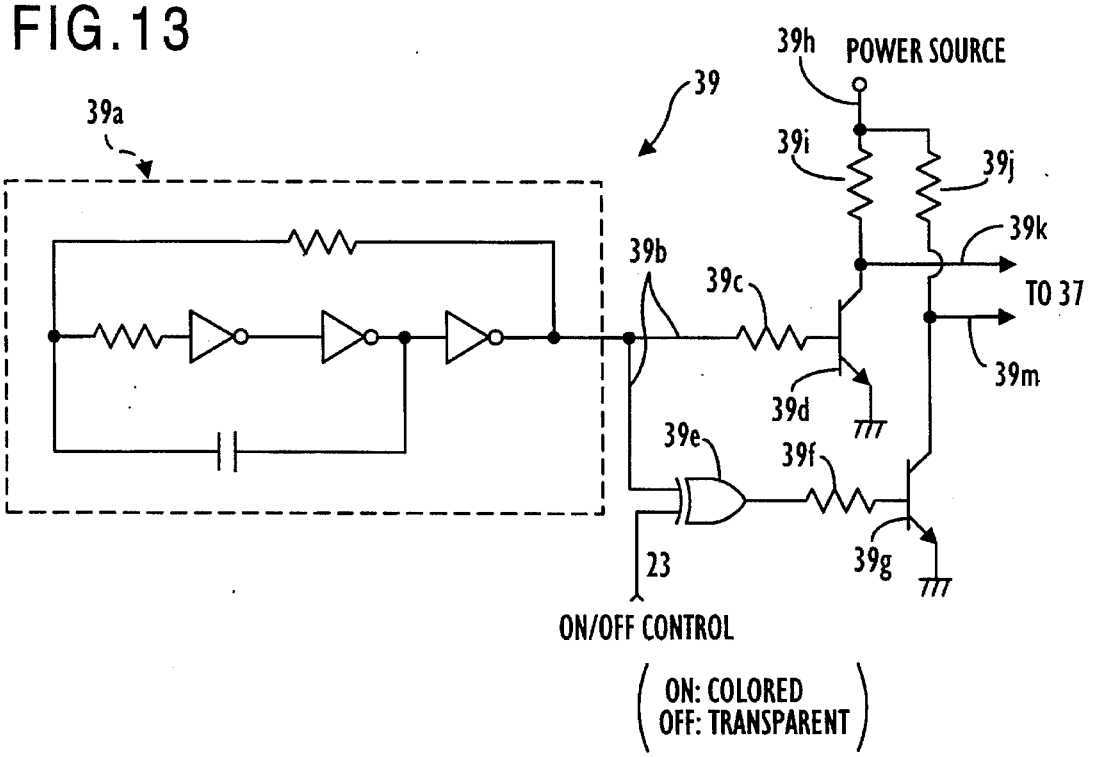
FIG. 13 is a circuit diagram of a liquid crystal filter control circuit according to the present invention.

FIG. 13 shows an internal structure of the liquid crystal filter control circuit 39. Oscillator 39*a* comprises a plurality of invertors, a resistor, and a capacitor in combination. Signal line 39*b*, also connected to the output terminal of the oscillator 39*a*, is connected to the base of transistor 39*d* through resistor 39*c*, and to the base of transistor 39*g* through EXOR circuit 39*e* and resistor 39*f*, respectively. Signal line 39*h*, connected to the power source, is also connected, through resistors 39*i* and 39*j*, to the collectors of transistors 39*d* and 39*g*, which are in turn connected to liquid crystal filter 37 through signal lines 39*k* and 39*m*.

The rectangular wave signals, which vary at a predetermined cycle, i.e., signals "0" and "1", are alternately input from the oscillator 39*a* to the first input terminal of the EXOR circuit 39*e*. The control signal "0" or "1" is selectively input to the second input terminal of the EXOR circuit 39*e* from the controller 23. The EXOR circuit 39*e* outputs a signal whose level is identical to the signal inputted to the first input terminal thereof from the control circuit 23 when the control signal to be input thereto is "0". The EXOR circuit 39*e* outputs a signal whose level is different from the signal input to the first input terminal thereof from the control circuit 23 when the control signal to be input is "1". Consequently, if the control signal is "0", the rectangular wave signals of the same phase are transmitted through the signal lines 39*k* and 39*m*, so that no voltage is applied to the electrodes of the amber liquid crystal filter 37, and thus, filter 37 is turned transparent. If the control signal is "1", the rectangular wave signals of opposite phases are transmitted through the signal lines 39*k* and 39*m*, so that a voltage is applied to the electrodes of the amber liquid crystal filter 37, and thus the filter 37 is turned amber.

Figure 14:
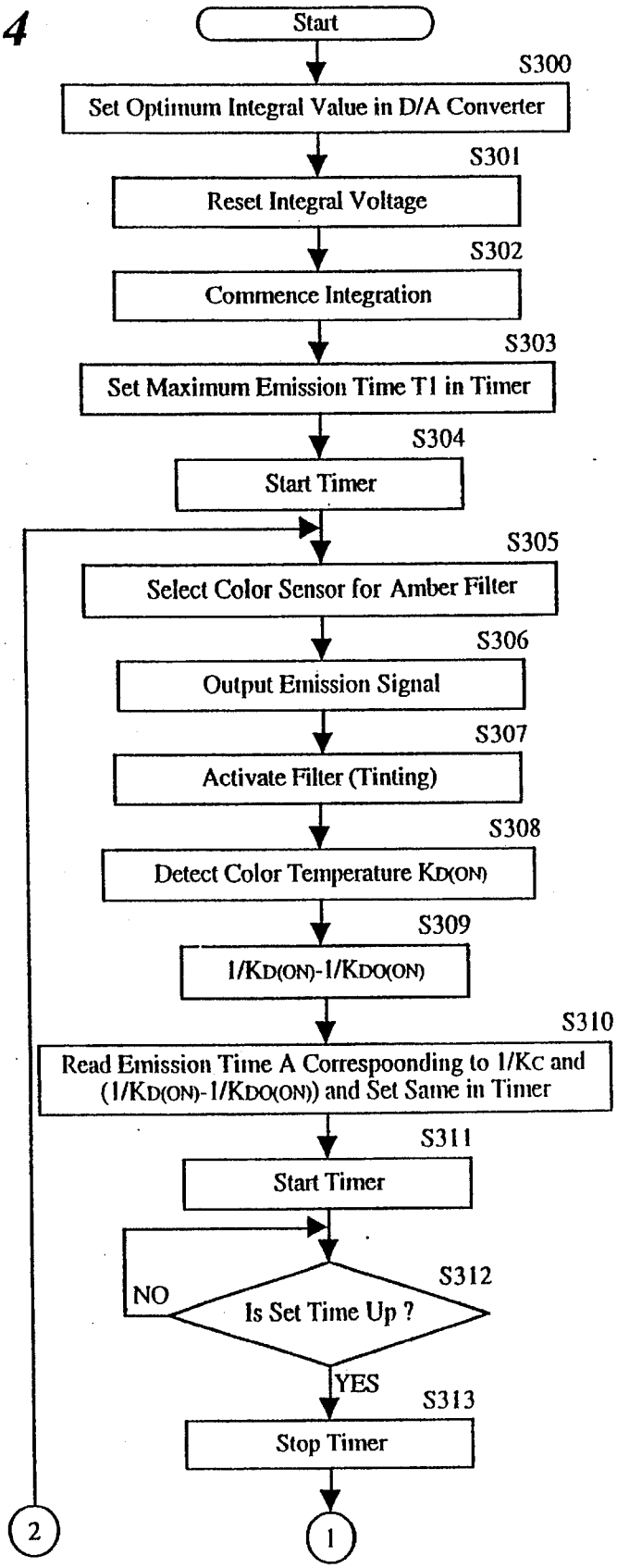
FIG. 14 is a flow chart of a first port of a strobe light emitting operation in the fourth embodiment.
Figure 15:
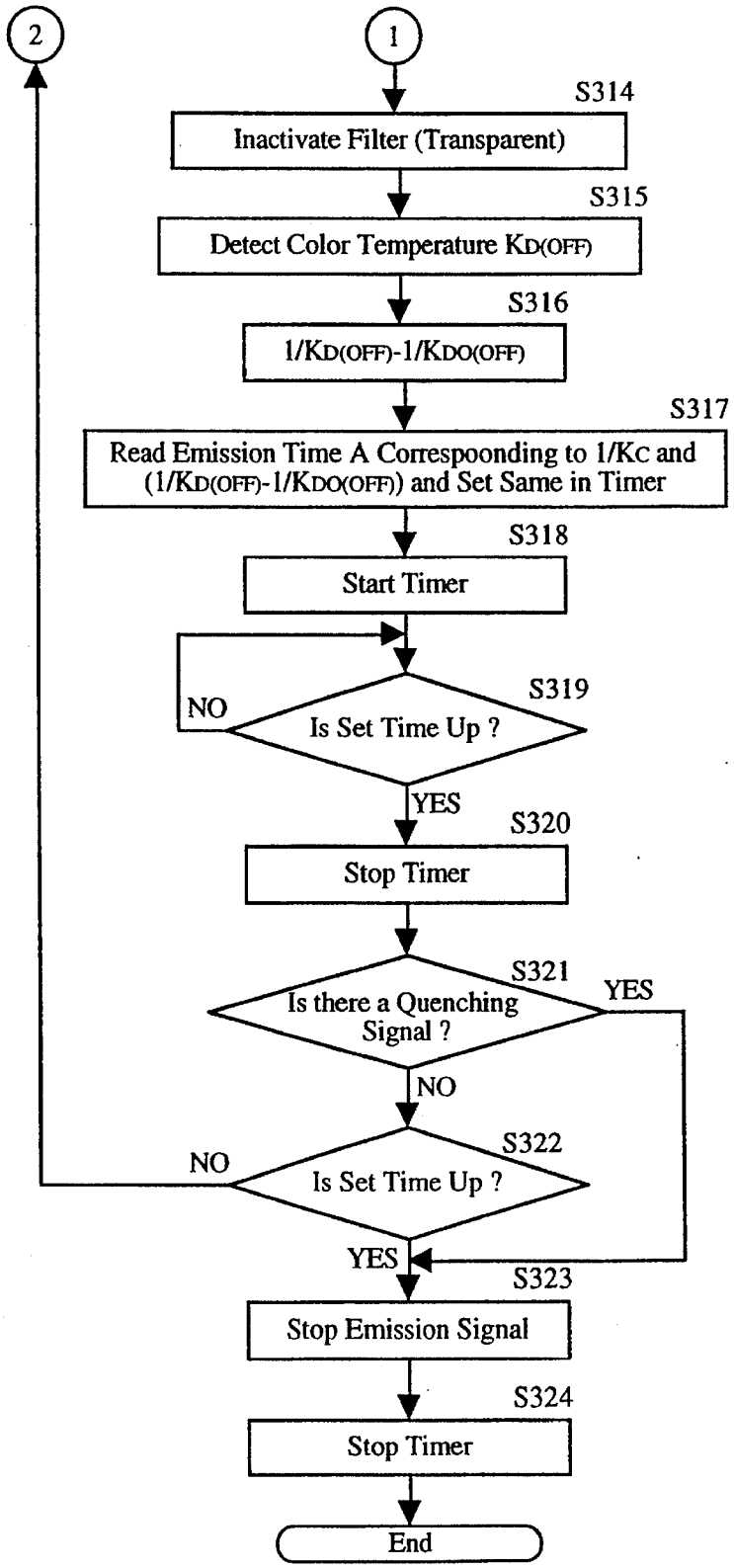
FIG. 15 is a flow chart of a second port of a strobe light emitting operation in the fourth embodiment.

FIGS. 14 and 15 show a flow chart of the emission control of the control circuit 23 in the fourth embodiment mentioned above. The following discussion will be addressed only to points different from the third embodiment.

At step S305, selector 32 selects color sensor 38 provided in front of the filter 37, so that the signal from the color sensor 38 is inputted to the color temperature calculating circuit 20. The emission trigger signal is outputted to the IGBT 33 at step S206 to turn IGBT 33 ON. consequently, the trigger voltage is applied to the trigger electrodes of the xenon tube 51 to emit the strobe light from the xenon tube 51.

After the strobe light is emitted, a control signal "1" is output from the controller 23 to the liquid crystal filter control circuit 39 to turn ON the amber filter 37 (to become amber), at step S307. Thereafter, the color temperature $K_{D\ (ON)}$ of strobe light F2, to be made incident upon the object SB through the filter 37, is detected by the color sensor 38 at step S308. At step S309, a difference $\{(1/K_{K(ON)})-(1/K_{DO(ON)})\}$ between the reciprocal of the color temperature $K_{D\ (ON)}$ of the strobe light and the reciprocal of a design value of the color temperature $K_{DO\ (ON)}$ of the strobe light transmitted through the filter 37 is calculated to obtain a variation with time or error with respect to the design value of the color temperature.

Thereafter, at step S310, the time for the activation of the filter corresponding to the value of $\{(1/K_{D(ON)})-(1/K_{DO(ON)})\}$ is read from the memory 29 with reference to the data table stored in the memory in accordance with the value of the reciprocal $1/K_c$ of the color temperature of the ambient light E1 and is set in the timer circuit 28. At step S311, the timer begins the counting operation. The outputting of the control signal "1" continues until the time for the activation of the filter expires. After this time expires, control proceeds to step S313 to deactivate the timer circuit 28.

Thereafter, control signal "0" is output from the controller 23 to the liquid crystal filter control circuit 39 to make the liquid crystal filter 37 transparent at step S314, and the color temperature $K_{D\ (OFF)}$ of the strobe light F2 to be made incident upon the object SB through the filter 37 is detected by the color sensor 38 at step S315. At step S316, a difference $\{(1/K_{D\ (OFF)})-(1/K_{DO\ (OFF)})\}$ between the reciprocal of the color temperature $K_{D\ (OFF)}$ of the strobe light and the reciprocal of a design value of the color temperature $K_{D\ (OFF)}$ of the strobe light transmitted through the filter 37 is calculated to obtain a variation over time with respect to the design value of the color temperature.

At step S317, the time for the deactivation of the filter corresponding to the value of $\{(1/K_{D\ (OFF)})-(1/K_{DO\ (OFF)})\}$ is read from the memory 29 with reference to the data table stored in the memory in accordance with the value of the reciprocal $1/K_c$ of the color temperature of the ambient light E1 and is set in the timer circuit 28. At step S318, the timer begins the counting operation. The output of the control signal "0" continues until the time for the deactivation of the filter expires. After the lapse of the time, control proceeds to step S320 to deactivate the timer circuit 28.

Thereafter, whether the quenching signal S3 is generated is checked at step S321. If the quenching signal S3 is output, control proceeds to step S323 to stop the supply of the emission signal to the xenon tube 51. Hence, the timer circuit, which has started the counting operation at step S304, is stopped at step S324 and the program ends. If there is no quenching signal S3 at step S321, timer circuit 28 is checked at step S322. If the set time does not exceed the maximum emission time T1, control is returned to step S305 to effect the coloring of the liquid crystal filter 37. Conversely, if the set time exceeds the maximum emission time T1, the supply of the emission signal to the xenon tube 51 is stopped. Consequently, the timer circuit 28 is deactivated at step S324, and hence the program ends.

Figure 16:
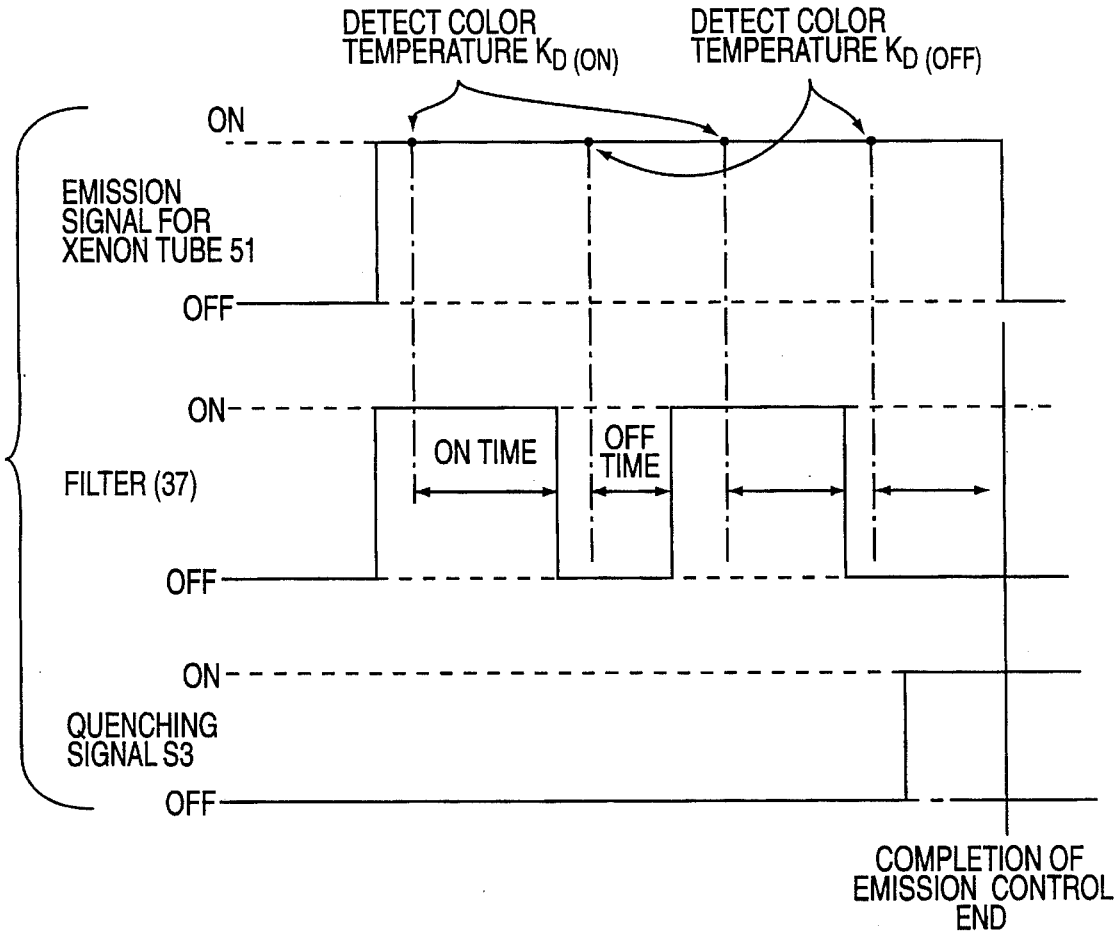
FIG. 16 is a sequence diagram of the strobe emission in the fourth embodiment of the present invention.

As can be understood from the above discussion, according to the fourth embodiment, in which the color temperature of the strobe light emitted from the xenon tube 51 is converted by the amber liquid crystal filter 37, the color temperature $K_D$ of the strobe light F2 incident upon the object SB is directly detected, so that the ON/OFF time duration (duty ratio) of the liquid crystal filter 37 can be controlled accordingly so as to make the resultant color temperature of the strobe light coincide with the color temperature of the ambient light E1 of the object SB. FIG. 16 shows a timing chart of the ON/OFF timing of the xenon tube 51 and the liquid crystal filter 37. As can be seen in FIG. 16, the ON/OFF operations are repeated at a predetermined interval until the quenching signal S3 is output.

It is also possible to detect the color temperature of the strobe light emitted from the xenon tube 51 prior to the main exposure, similar to the third embodiment.

In a fifth embodiment, a pre-emission is carried out to eliminate a red-eye phenomenon, in addition to the detection of the color temperature.

The block diagram of a still video camera having a strobe apparatus according to a fifth embodiment is substantially the same as the block diagram shown in FIG. 8 (third embodiment). The control circuit, comprising of the photometer 21, the integral circuit 24, the comparator 25, and the D/A converter 26, etc., is identical to the control circuit shown in FIG. 2. The structures of the color sensor 22 and the color temperature calculating circuit 20 are identical to those shown in FIG. 3.

Figure 17:
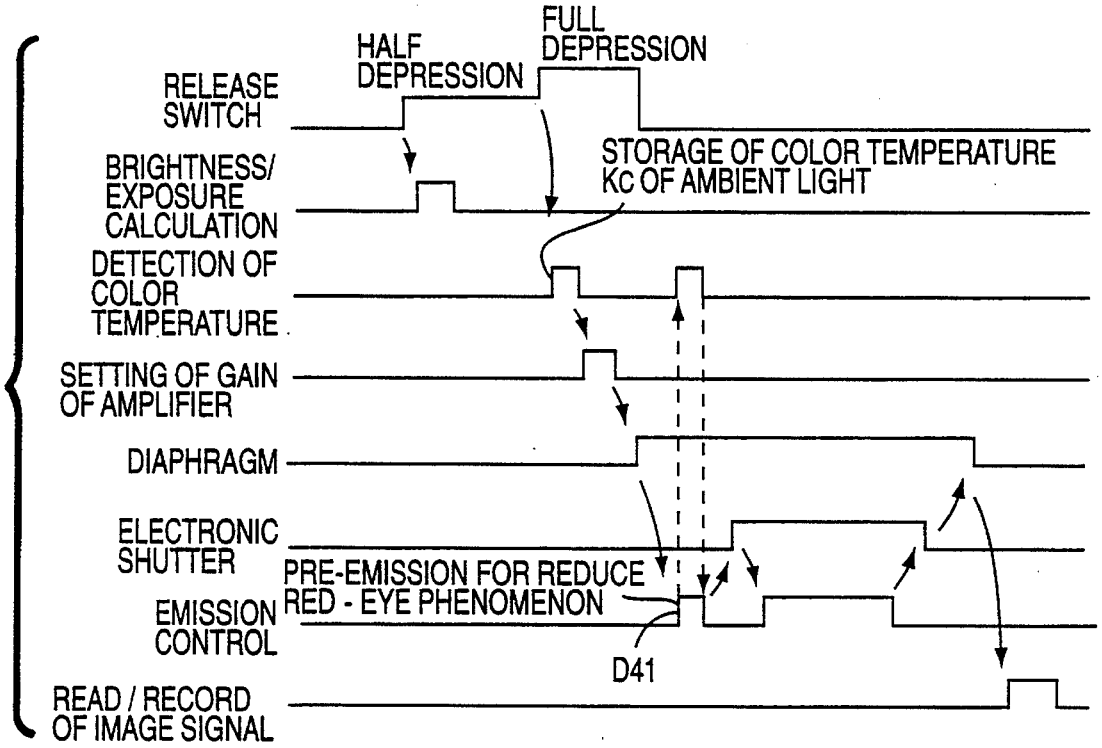
FIG. 17 is a sequence diagram of photographing operations in the fifth embodiment.

FIG. 17 shows a sequence diagram of the photographing operation in the fifth embodiment. The operations from the depression of the release switch 27 (FIG. 8) by half step to the adjustment of the aperture of the diaphragm 12 are identical to those shown in FIG. 5. When the quantity of light reflected from the object SB is adjusted by the diaphragm 12, the pre-emission for preventing red-eye phenomenon is commenced in accordance with the detection results of the photometer (D41). Upon the pre-emission, the color temperatures $K_A$ and $K_B$ of the strobe light F2 through the filters 53 and 55 are detected. Consequently, the electronic shutter time is determined in accordance with the detection results to commence the accumulation of the electric charges, so that the main emission of the strobe light occurs. The subsequent operations are the same as those shown in FIG. 5.

Figure 18:
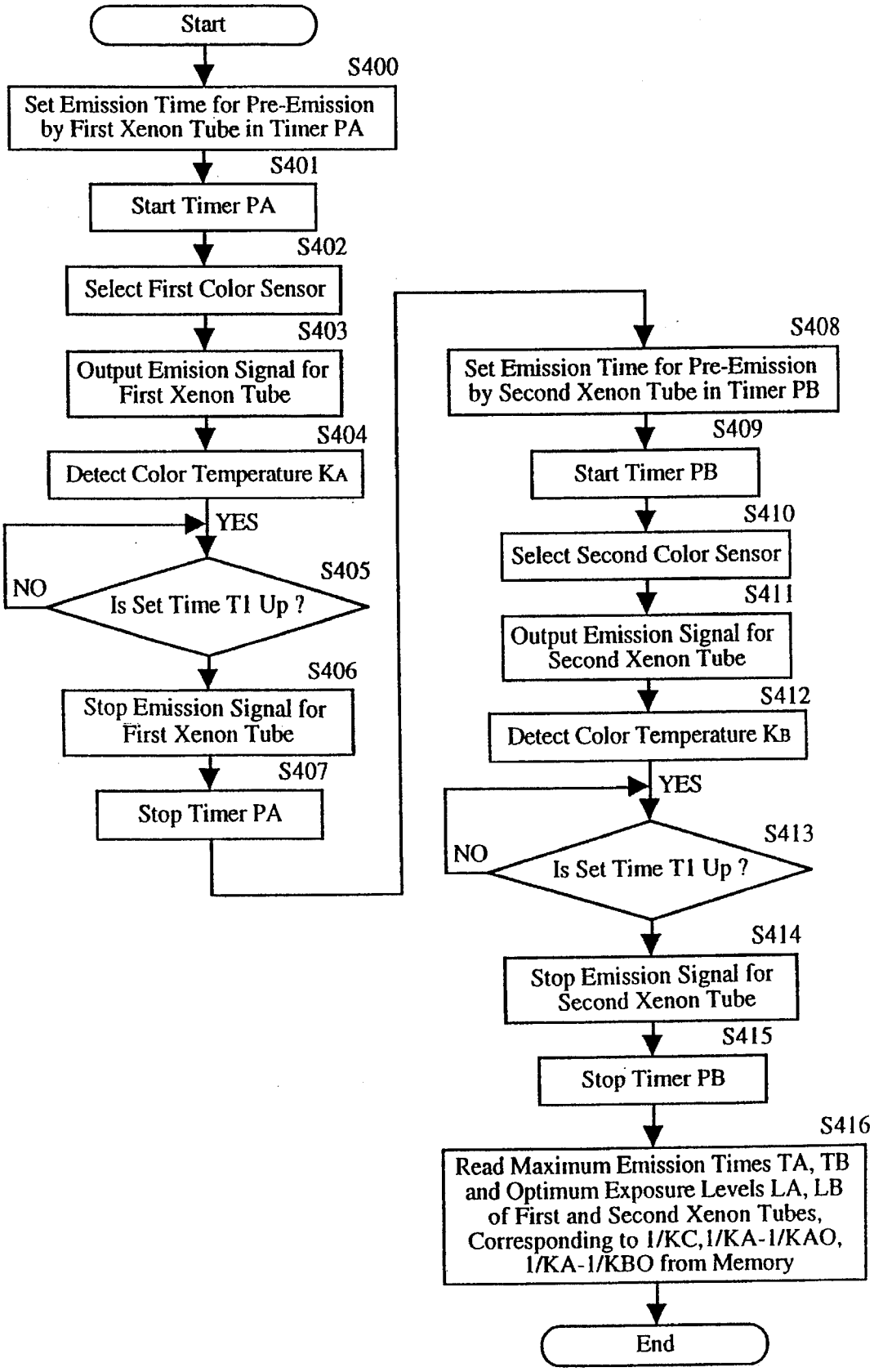
FIG. 18 is a flow chart of the pre-emission in the fifth embodiment of the present invention.

FIG. 18 shows a flow chart of the pre-emission control in the fifth embodiment. At step S400, the pre-emission time PA of the first xenon tube 51 corresponding to the blue filter 53 is set in timer circuit 28. The timer circuit begins counting the time at step S401. At step S402, selector 32 selects the color sensor 30, so that the signal from the color sensor 30 is inputted to the color temperature calculating circuit 20. The emission trigger signal is output to the IGBT 33 at step S403 to turn the IGBT 33 ON. Consequently, the trigger voltage is applied to the trigger electrodes of the xenon tube 51 to emit the strobe light from the xenon tube 51 (pre-emission).

After the strobe light for the pre-emission is emitted from the xenon tube 51, the color temperature $K_A$ of the strobe light F2 to be made incident upon the object SB is detected by the color sensor 30 at step S404. The pre-emission continues until expiration of the set time PA for the pre-emission. After the expiration of the set time PA at step S405, control proceeds to step S212 to stop the issuance of the trigger signal at step S406. Consequently, IGBT 33 is turned OFF and the emission of the strobe light from the first xenon tube 51 is stopped. Thereafter, at step S407, the timer circuit 28 is deactivated.

The pre-emission operation mentioned above is carried out for the second xenon tube 52 corresponding to the amber filter 55. Namely, the operations of steps S400 to S407 are carried out as steps S408 to S415 for the second color sensor 31 and the second xenon tube 52. Note that the color temperature of the strobe light F2 detected by the color sensor 31 is designated by $K_B$ and the pre-emission time is designated by PB, respectively.

After the pre-emission by the first and second xenon tubes 51 and 52 is suspended, the maximum emission times $T_A$ and $T_B$ of the first and second xenon tubes 51 and 52 and the optimum exposure levels $L_A$ and $L_B$ corresponding to the values of $\{(1/K_A)-(1/K_{AO})\}$ and $\{(1/K_B)-(1/K_{BO})\}$, obtained based on the reciprocal $1/K_c$ of the color temperature of the ambient light and the color temperatures $K_A$ and $K_B$ detected during the pre-emission are read from the memory 29, and hence the program ends.

Figure 19:
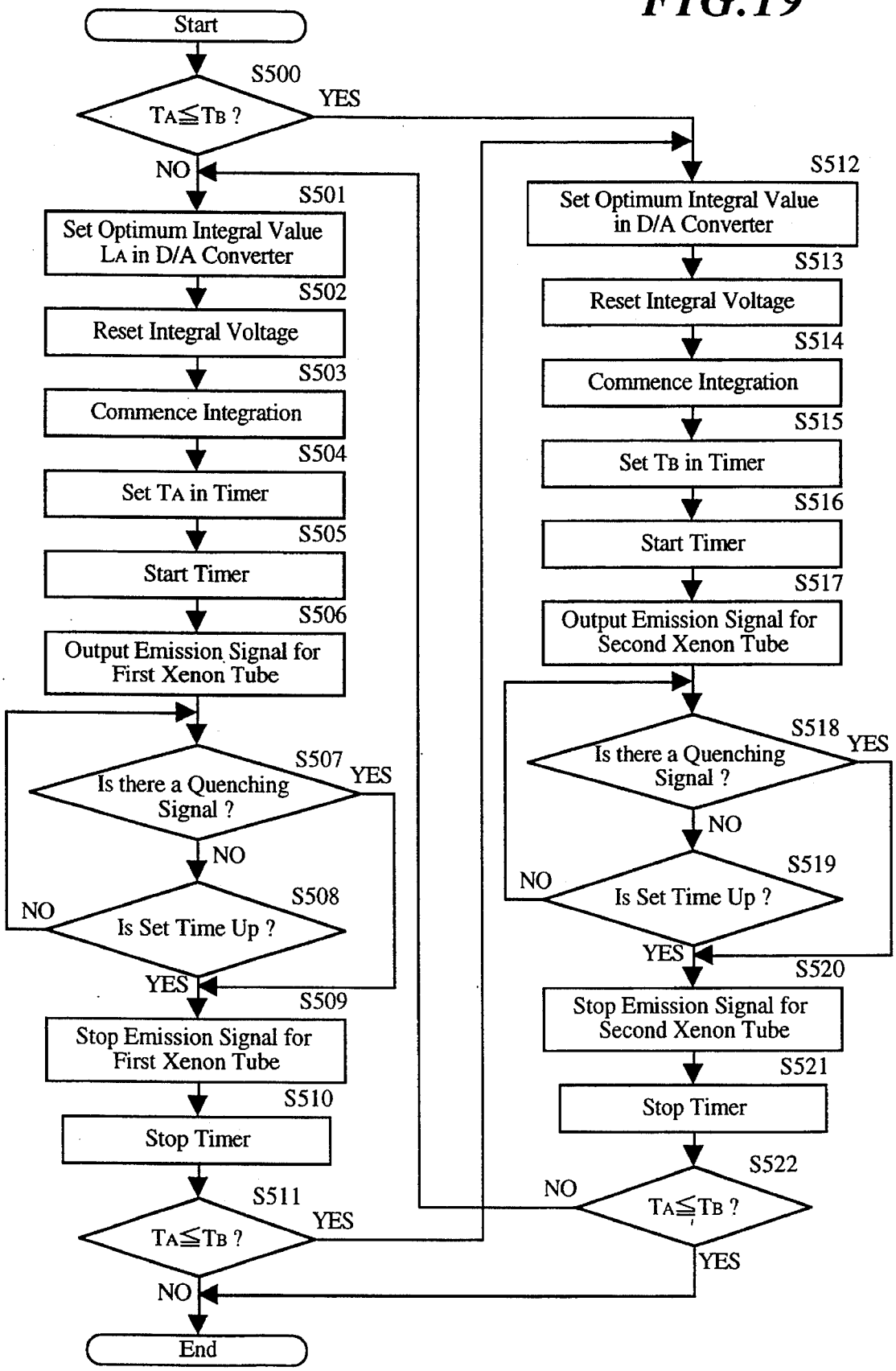
FIG. 19 is a flow chart of the main emission in the fifth embodiment of the present invention.

FIG. 19 shows a flow chart of the control for the main emission in the fifth embodiment. The maximum emission times $T_A$ and $T_B$ determined in the pre-emission control routine shown in FIG. 18 are compared at step S500. If the maximum emission time $T_A$ of the first xenon tube 51 is less than the maximum emission time $T_B$ of the second xenon tube 52, the operations at steps S501 to S511 are first carried out to emit the strobe light from the first xenon tube 51. Conversely, if the maximum emission time $T_A$ of the first xenon tube 51 is greater than the maximum emission time $T_B$ of the second xenon tube 52, the operations at steps S512 to S522 are first carried out to emit the strobe light from the second xenon tube 51.

At step S501, an optimum integral value $L_A$ read out in the pre-emission control routine is set in the D/A converter 26. The integral value outputted from the integrating circuit 24 is reset at step S502. Thereafter, at step S503, the integration in the integrating circuit 24 is performed in response to the integration commencement signal S1. At the same time as the integral operation, the maximum emission time $T_A$ is set in the timer circuit 28 at step S504, and the timer commences the counting operation at step S505. At step S506, the trigger signal S4 is outputted to the IGBT 33 to actuate the same. As a result, the trigger voltage is applied to the trigger electrodes of the xenon tube 51, so that the latter emits the strobe light.

After the emission of the strobe light takes place as mentioned above, it is determined whether the quenching signal S2 is output at step S507. If the output of the quenching signal S3 is confirmed, the issuance of the trigger signal S4 for emission is stopped at step S509. Consequently, the emission of the strobe light from the xenon tube 51 is stopped. If there is no quenching signal S3 at step S507, control proceeds to step S508 at which the timer circuit 28 is checked at step S508. If the set time does not exceed $T_A$, control is returned to step S507 to determine the presence or absence of the quenching signal S3. Conversely, if the set time exceeds $T_A$ at step S508, control proceeds to step S509 to compulsively stop the output of the trigger signal S4 to the IGBT 33. Thereafter, the IGBT 33 is turned OFF and the emission of the strobe light from the first xenon tube 51 is stopped. The timer circuit 28 is then deactivated at step S510, and hence, the program ends.

The main emission of the second xenon tube 52 at steps S512 to S522 is identical to the main emission of the first xenon tube 51 mentioned above. Namely, the operations at steps S512 to S522 correspond to those at steps S501 to S511.

According to the fifth embodiment, not only can the same technical effects as the previous embodiments be obtained, but also the energy consumption for the emission can be decreased, thus resulting in a long service life of the batteries of the strobe apparatus.

The following discussion will be addressed to a sixth embodiment of the present invention. The circuitry in the sixth embodiment is substantially the same as the circuitry shown in FIG. 12 (fourth embodiment). In the sixth embodiment, a red-eye phenomenon preventing pre-emission is executed in addition to the detection of the color temperature. Namely, the block diagram of a still video camera to which the strobe apparatus according to the fourth embodiment is applied is the same as that shown in FIG. 12.

Figure 20:
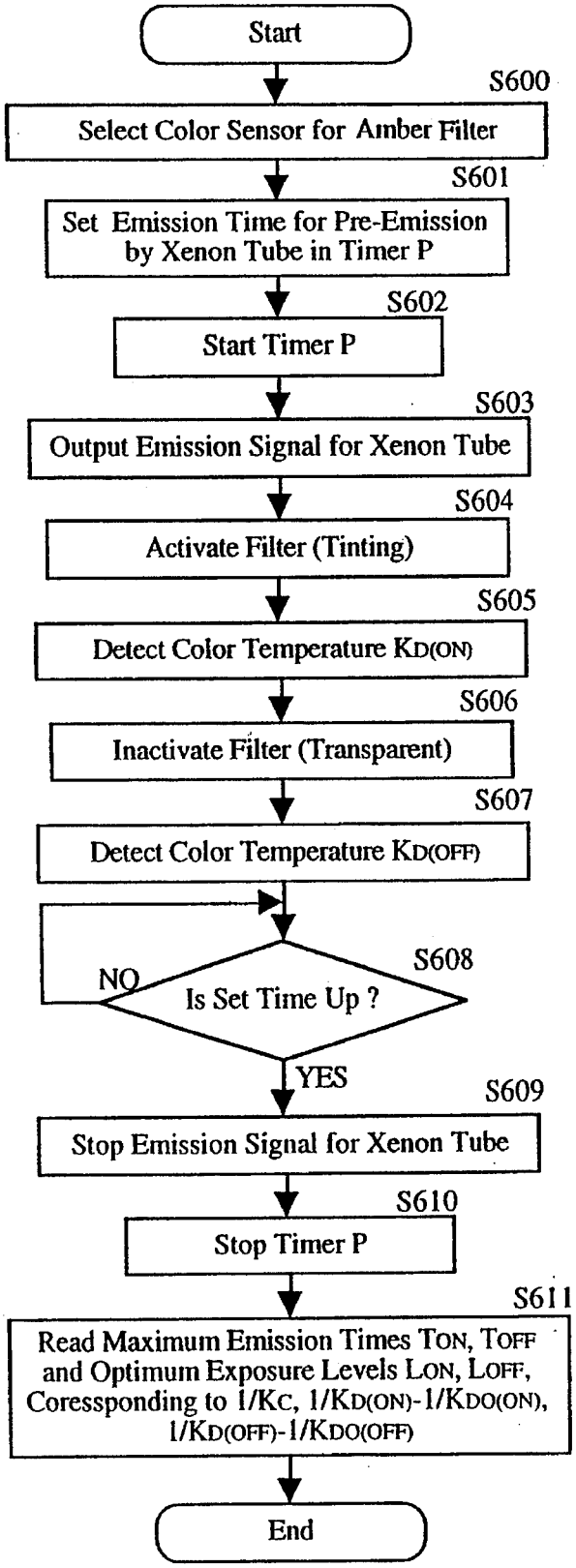
FIG. 20 is a flow chart of the pre-emission in the sixth embodiment of the present invention.

FIG. 20 shows a control operation for the pre-emission in the sixth embodiment.

At step S600, selector 32 selects the color sensor 38 provided in front of filter 37, so that the signal from the color sensor 38 is inputted to the color temperature calculating circuit 20. The pre-emission time P of the xenon tube 51 is set in the timer circuit 28 at step S601. The timer commences the time counting operation at step S602. The emission trigger signal is output to IGBT 33 at step S603 to emit the strobe light from the xenon tube 51 for pre-emission.

After the strobe light for the pre-emission is emitted from the xenon tube 51, a control signal "1" is outputted from the controller 23 to the liquid crystal filter control circuit 39 to turn the amber filter 37 to an amber state at step S604. Thereafter, the color temperature $K_{D\ (ON)}$ of the strobe light F2 to be made incident upon the object SB through the filter 37 is detected by the color sensor 38 and stored in the memory 29 at step S605.

Thereafter, a control signal "0" is outputted from the controller 23 to the liquid crystal filter control circuit 39 to turn the liquid crystal filter 37 transparent at step S606. Thereafter, the color temperature $K_{D\ (OFF)}$ of the strobe light F2 to be made incident upon the object SB through the filter 37 is detected and stored at step S607. At step S608, the pre-emission time P that has been set at step S602 is checked. The pre-emission continues until the pre-emission time P expires. If the pre-emission time P expires, control proceeds to step S609 and turn OFF the IGBT 33, thereby stopping the emission of the xenon tube 51. Thereafter, the timer circuit 28 is deactivated at step S610.

At step S611, the maximum emission times $T_{ON}$ and $T_{OFF}$ of the liquid crystal filter 37 at the ON and OFF positions thereof and the optimum exposure levels $L_{ON}$ and $L_{OFF}$ corresponding to the values of $\{(1/K_{D\ (ON)})-(1/K_{DO\ (ON)})\}$ and $\{(1/K_{D\ (OFF)})-((1/K_{D\ (OFF)})\}$, obtained based on the reciprocal $1/K_C$ of the color temperature of the ambient light and the color temperatures $K_{D\ (ON)}$ and $K_{D\ (OFF)}$ are read from the memory 29, and the program ends.

FIG. 21 shows a flow chart of the control for the main emission in the sixth embodiment. The flow chart shown in FIG. 21 is substantially identical to the flow chart of the fifth embodiment. Namely, the maximum emission times $T_{ON}$ and $T_{OFF}$ determined in the pre-emission control routine shown in FIG. 20 are compared at step S700, instead of the comparison of the above-mentioned times $T_A$ and $T_B$. If the maximum emission time $T_{ON}$ of the first xenon tube 51 is less than the maximum emission time $T_{OFF}$, the liquid crystal filter 37 is turned ON to become tinted at step S701, and thereafter, the same operations as those at steps S501 and S510 are carried out at steps S702 and S711.

Conversely, if the maximum emission time $T_{ON}$ of the first xenon tube 51 is greater than the maximum emission time $T_{OFF}$, the liquid crystal filter 37 is turned OFF to become transparent at step S713, the same operations as those at steps S512 to S521 (FIG. 19) are carried out by steps S714 to S723.

The same technical effects as those in the previous embodiments can be expected from the sixth embodiment.

Although the color sensor is provided outside the optical system to detect the strobe light or light reflected from the object in the illustrated embodiments, it is possible to use the image pickup device 11 as a color sensor to detect the light transmitted through a photographing lens.

Moreover, the present invention is not limited to a still video camera and can be applied to a common camera using a silver halide film. In this case, if the film characteristics do not meet ambient light, it is necessary to provide a color conversion filter in front of the photographing lens.

As can be understood from the above discussion, according to the present invention, the color temperature of strobe light incident upon or reflected from the object is detected to perform a feed-back control thereof, even if there is an error or variation with time in the inherent color temperature of the light emitting tube or the degree of color conversion of a color conversion filter, so that the color temperature of the strobe light can be made identical to the color temperature of ambient light so as to improve the white balance of an object image.

Figure 22:
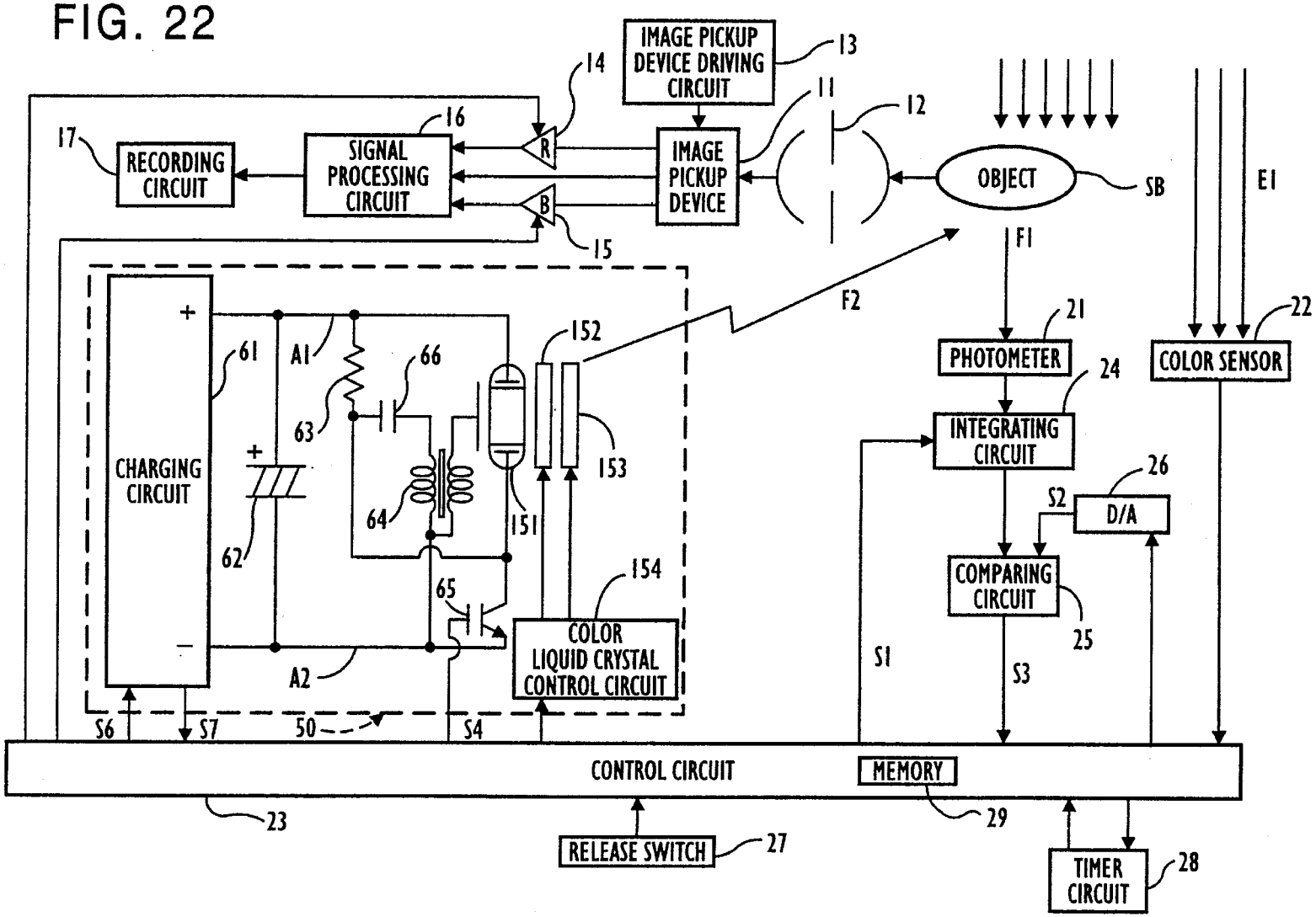
FIG. 22 is a circuit diagram of a still video camera to which a strobe apparatus according to a seventh embodiment of the present invention is applied.

FIG. 22 shows a seventh embodiment of the present invention. The seventh embodiment of the still video camera has a single xenon tube 151.

The strobe apparatus 50 is connected to the control circuit 23, so that the start and finish of the emission of the strobe light by the xenon tubes 151 of the strobe apparatus 51 are controlled by the control circuit (controller) 23. A guest-host type blue liquid crystal filter 152 and an amber liquid crystal filter 153 are provided in front of the xenon tube 151. The color of liquid crystal filters 152, 153 are varied depending on the amplitude of the voltage to be applied thereto and controlled by a color liquid crystal control circuit 154 that operates in response to control signals output from the controller 23. For example, filters 152 and 153 are respectively turned blue and amber when the voltage is applied thereto. When no voltage is applied, the filters 152 and 153 are transparent. The color liquid crystal driving circuit 154 operates in response to the control signal outputted from the control circuit 23.

Figure 23:
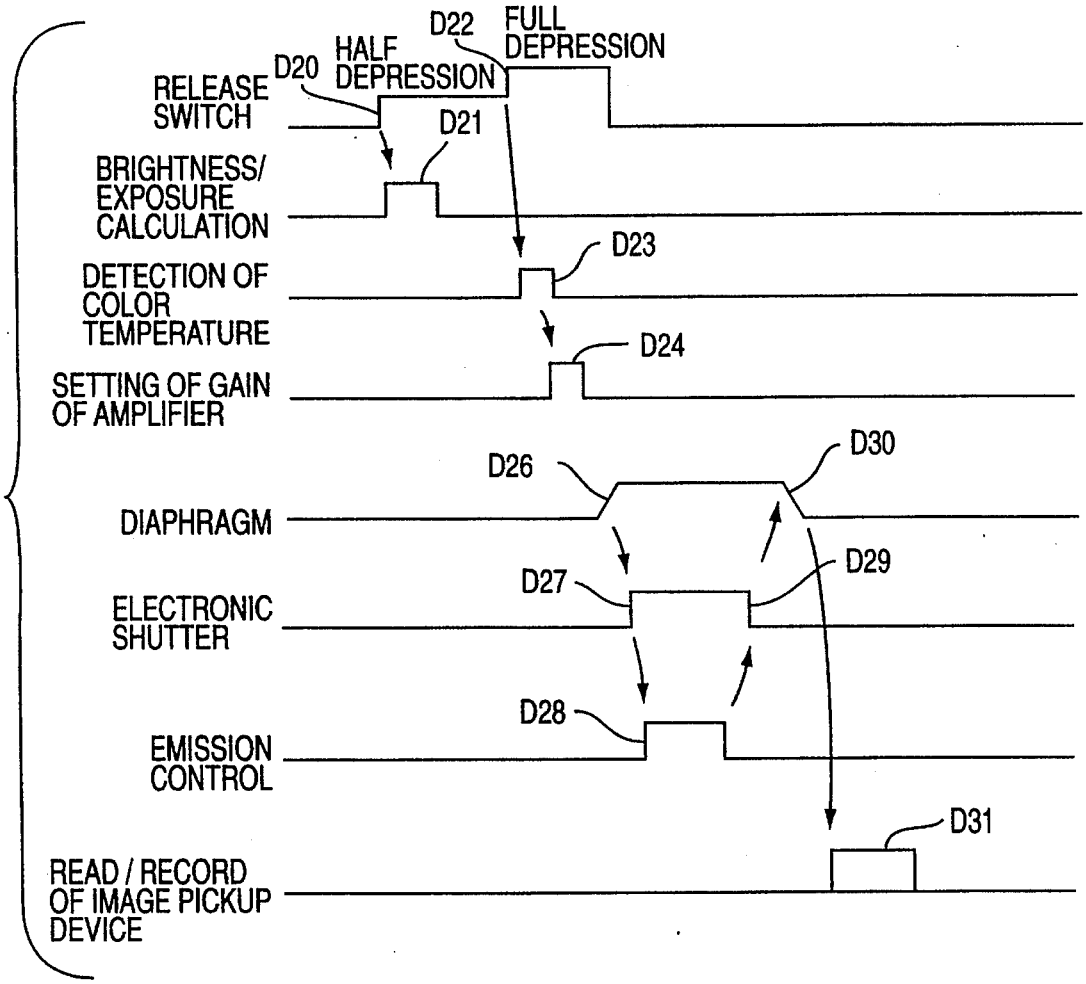
FIG. 23 is a sequence diagram of photographing operations of a still video camera shown in FIG. 22.

FIG. 23 shows a sequence diagram of the emission of the strobe light in the seventh embodiment.

When the release switch 27 is depressed by a half stroke (D20), the controller 23 detects the luminance of the object SB in accordance with photometering data which is obtained by the photometer 21 and determines an exposure value based on the photometering data (step D21).

In the calculation for determining the exposure value (exposure calculation), the operation time of the electronic shutter of the image pickup device 11 and the quantity of the strobe light to be emitted by the strobe apparatus 50 are determined. The charging operation for the main capacitor 62 by the charging circuit 61 is commenced when a main switch (not shown) is turned ON or a strobe-photographing indicating switch (not shown) or the like is actuated, so that the charge start signal S6 is output from the control circuit 23. Also, the charging operation is started when the strobe emission control is completed.

The charging circuit 61 outputs the high voltage current to the main capacitor 62 in response to the charge commencement signal S6. Consequently, the electric charges for strobe emission are accumulated by the high voltage current in the main capacitor 62. When the main capacitor 62 is charged with a predetermined quantity of electric charge, the potential of signal line A1 reaches a predetermined value, so that the charging circuit 61 no longer outputs the high voltage current. Hence, the accumulation of the electric charge in the main capacitor 62 by the charging circuit is completed. Thereafter, a charge finish signal S7 which represents the end of the accumulation of the charge in the main capacitor 62 is output from the charging circuit 61 to the control circuit 23. Consequently, the control circuit 23 determines that a picture can be taken using a strobe emission, i.e., the strobe-photographing can be performed.

Upon completion of the calculation of the luminance and exposure value (D21), when the release switch 27 is fully depressed (D22), the controller 23 calculates the color temperature of the ambient light E1 of the object SB in accordance with a signal inputted from the color photometering sensor 22 (D23).

A data table which represents the relationship between the color temperature of the ambient light and the signal input from the color sensor 22 is stored in the memory 29 of the control circuit 23.

Namely, when the color temperature of the ambient light E1 is obtained (D23), the gain of amplifiers 14 and 15 are determined (D24).

Thereafter, the aperture of the diaphragm 12 is adjusted in accordance with the photometering data (luminance data) to adjust the quantity of light reflected from the object and made incident upon the image pickup device 11 (D26). The time for accumulating the electric charges (photoelectric signals) of the image pickup device 11, i.e., the electronic shutter time is determined in accordance with the photometering data, and the accumulation of the electric charge is started (step D27). At the same time as the start of the accumulation of the electric charges, control of the strobe emission is commenced in accordance with the photometering data (step D28). Note that during the emission control, a predetermined magnitude of voltage is applied to the electrodes of one of the liquid crystal filters 152 and 153 to color (or tint) the same.

Upon completion of the photographing operation, the control circuit 23 controls the image pickup device driving circuit 13 to send a control signal to the image pickup device 11 to end the accumulation of the electric charge and close the diaphragm 12 (step D29). At the same time, control supply voltage to the electrodes of the liquid crystal filters 152 and 153 is stopped, so that the filters 152 and 153 are made transparent. Thereafter, a read control signal is output from the image pickup device driving circuit 13 to the image pickup device 11 to read the signal charges, such as transfer pulses, so that the signal charges accumulated in the image pickup device 11 are read as image signals and inputted to the signal processing circuit 16, where the image signals are converted to a predetermined format of image signals and recorded onto the recording medium (not shown) by the recording circuit 17 (D31).

In the emission control (indicated at D28 in FIG. 23) of the strobe light, one of the color filters 152 and 153 is turned blue or amber and the other filter 153 or 152 is transparent. The control of the filters 152 and 153 will be discussed below with reference to FIGS. 24 and 25.

Figure 24:
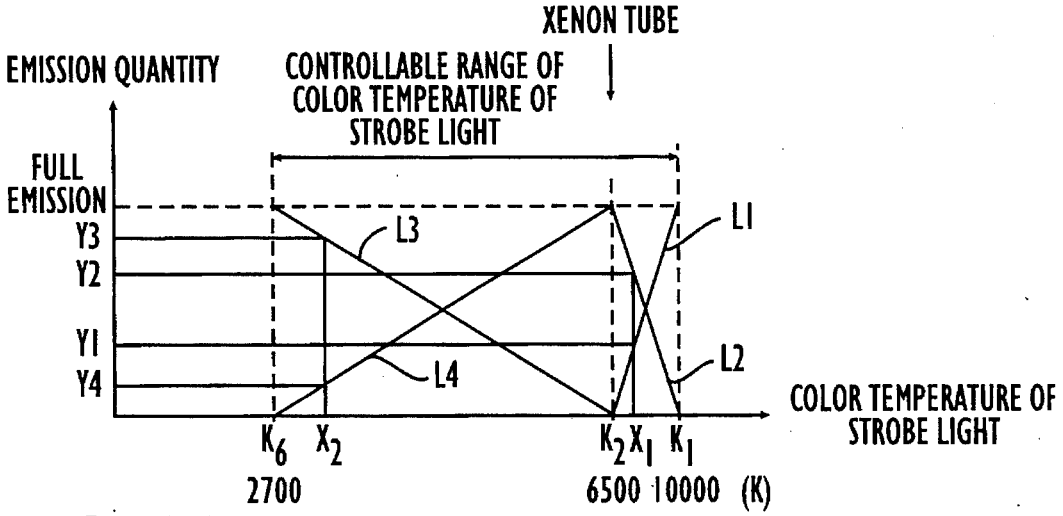
FIG. 24 is a conceptual graph of a controllable range of the color temperature in the first embodiment.

FIG. 24 shows a controllable range of the color temperature of the strobe light.

The inherent unfiltered color temperature $K_2$ of the strobe light emitted from the xenon tube 151 is 6500° K. in the illustrated embodiment. The blue liquid crystal filter 152 is selectively blue or transparent. When the blue liquid crystal filter 152 is turned blue, the color temperature of the strobe light transmitted through the filter 152 is 10000° K. Consequently, the upper limit color temperature $K_1$ and the lower limit color temperature $K_2$ of the strobe light that can be controlled by the filter 152 are 10000° K. and 6500° K., respectively. The amber liquid crystal filter 153 is selectively amber or transparent. When the amber light crystal filter 153 is amber, the color temperature of the strobe light transmitted through the filter 153 is 2700° K. Consequently, the upper limit $K_2$ and the lower limit $K_6$ of the color temperature of the strobe light that can be controlled by the filter 153 is 6500° K. and 2700° K., respectively.

When the color temperature of the ambient light is 6500° K. the filters 152 and 153 are both selected to be transparent. If the color temperature of the ambient light is higher than 6500° K., the amber liquid crystal filter 153 is transparent. To further increase the color temperature, the blue liquid crystal filter 152 is changed between the blue and transparent states to change the quantity of light emission by the xenon tube 151. For instance, if the composite color temperature to be obtained is X1, the quantity of the emission in the blue state is Y1 and the quantity of emission in the transparent state is Y2, respectively. If the color temperature of the ambient light is lower then 6500° K. the blue liquid crystal filter 152 is transparent. To further decrease the color temperature, the amber liquid crystal filter 153 is changed between the amber and transparent states to change the quantity of light emission by the xenon tube 151. For instance, if the composite color temperature to be obtained is X2, the quantity of emission in the amber state is Y3 and the quantity of emission in the transparent state is Y4, respectively. FIG. 24 further shows another possible scenario: each filter may be set to an extreme of its color temperature range, that is, full color or transparent, at the start of the xenon tube emission, then throughout the emission, the color temperature is linearly adjusted such that by the end of the emission the color temperature is at the other extreme of the color temperature range for that filter.

Figure 25:
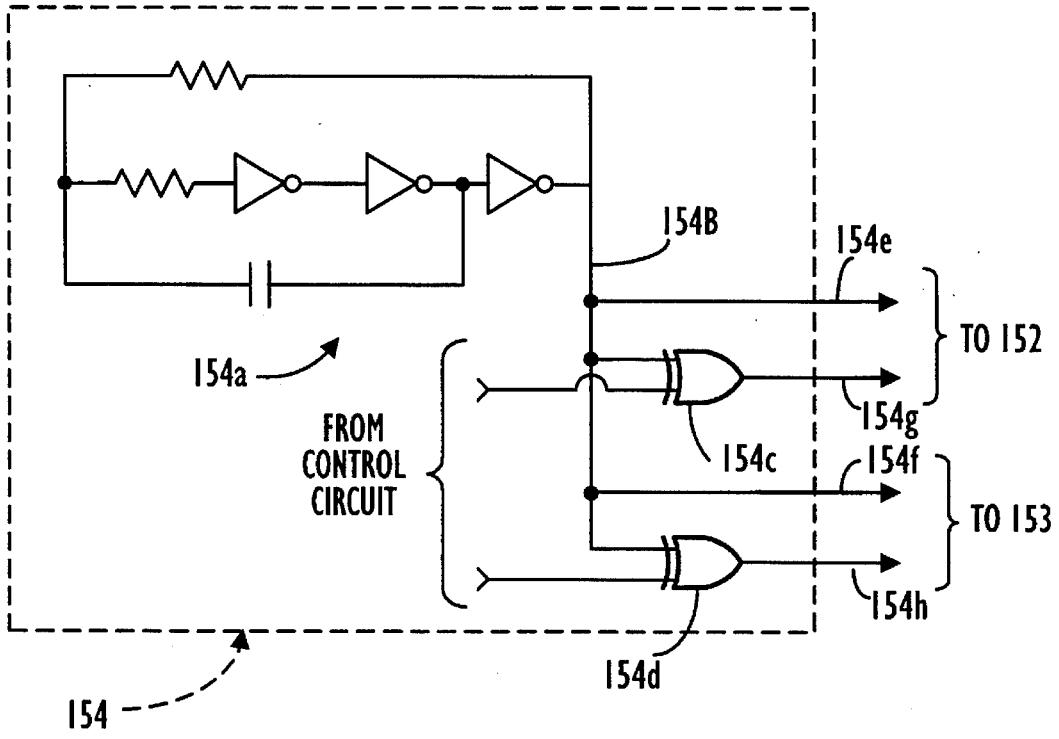
FIG. 25 is a block diagram of a color liquid crystal driving circuit according to the present invention.

FIG. 25 shows an internal structure of the color liquid crystal driving circuit 154. The oscillator **154*a* comprises a plurality of invertors, a resistor, and a capacitor in combination. The signal line 154*b*, connected to the output terminal of oscillator 154*a*, is connected to the first input terminals of EXOR circuits 154*c* and 154*d*, and to the blue liquid crystal filter 152 and the amber liquid crystal filter 153 through the signal lines 154*e* and 154*f*, respectively. Consequently, the rectangular wave signals which vary at a predetermined cycle, i.e., signals "0" and "1", are alternately input through the EXOR circuits 154*c* and 154*d* to the amber liquid crystal filter 153 and the blue liquid crystal filter 152. The control signal "0" or "1" is input to the second input terminals of the EXOR circuits 154*c* and 154*d* from the control circuit 23. The output terminals of the EXOR circuits and 154*c* and 154*d* are connected to the amber liquid crystal filter 153 and the blue liquid crystal filter 152 through the signal lines 154*g* and 154*h***, respectively.

The EXOR circuit **154*c* outputs a signal whose level is identical to the level of the signal to be input to the first input terminal thereof when the control signal from the control circuit 23 is "0". When the control signal from the control circuit 23 is "1", the EXOR circuit 154*c* outputs a signal whose level is the opposite of the level of the signal to be input to the first input terminal thereof. Consequently, if the control signal is "0", the rectangular wave signals having the same phase are transmitted through the signal lines 154*e* and 154*g*, so that no voltage is applied to the electrodes of the blue liquid crystal filter 152, and thus, the filter 152 is transparent. Conversely, if the control signal is "1", the rectangular wave signals having opposed phases are transmitted through the signal lines 154***e* and 154*g*, so that a voltage is applied to the electrodes of the filter 152, and thus, the filter 152 is turned blue.

Similarly, if the control signal to be sent to the EXOR circuit 154*d* is "0", the rectangular wave signals having the same phase are transmitted through the signal lines 154*f* and 154*h*, so that no voltage is applied to the electrodes of the amber liquid crystal filter 153, and thus, the filter 153 is transparent. Conversely, if the control signal is "1", the rectangular wave signals having opposed phases are transmitted through the signal lines 154*f* and 154*h*, so that a voltage is applied to the electrodes of the filter 153, and thus, the filter 153 is turned amber.

FIGS. 26–29 show a flow chart of the control operations of the control circuit 23 to control the strobe emission (indicated by D28 in FIG. 23). It is assumed in the following discussion that the color temperature $K_A$ of the ambient light is above the color temperature $K_2$ of the strobe light emitted from the xenon tube 151, and that the maximum emission time $T_1$ is below the maximum emission time $T_2$.

At step S1100, the color temperature $K_A$ of the ambient light is detected. If the color temperature $K_A$ is above the color temperature $K_2$ of the strobe light emitted from the xenon tube 151, the operations beginning at step S1101 are performed to actuate the blue liquid crystal filter 152. However, if the color temperature $K_A$ is below the color temperature $K_2$ of the strobe light emitted from the xenon tube 151, the operations beginning at step S1201 are performed to actuate the amber liquid crystal filter 153.

At step S1101, the amber liquid crystal filter 153 is turned transparent, and thereafter, at step S1102, the maximum emission times $T_1$ and $T_2$ corresponding to the color temperature $K_A$ of the ambient light are read from the memory 29. The maximum emission time $T_1$ defines a maximum time in which the strobe light is emitted from the xenon tube 151 when the blue liquid crystal filter 152 is turned blue. The emission time $T_2$ defines a maximum time in which the strobe light is emitted from the xenon tube 151 when the blue liquid crystal filter 152 is turned transparent. As will be described hereinafter (step S1103), the emission for the shorter maximum emission time is first carried out. The reason why the order of the emission is determined as mentioned above is that if the emission for the longer maximum emission time is first effected, a larger quantity of electric charges is discharged from the main capacitor 62, thus resulting in a reduction of the voltage of the main capacitor. This might make it impossible to subsequently emit the strobe light for the shorter maximum emission time.

In the illustrated embodiment, since it is judged that the maximum emission time $T_1$ is below the maximum emission time $T_2$ at step S1103, control proceeds to step S1104, at which the blue liquid crystal filter 152 is turned blue. Thereafter, at step S1105, the maximum emission time $T_1$ is set in the timer circuit 28, so that the timer begins counting. At step S1106, an appropriate (optimum) integral value of the light transmitted through the blue liquid crystal filter 152 and reflected from the object to be photographed, corresponding to the color temperature $K_A$ of the ambient light is read from the memory 29 and inputted to the D/A converter 26.

At step S1107, the integral value outputted from the integrating circuit 24 is reset. Thereafter, at step S1108, the integration of the operation amplifier 24*a* in the integrating circuit 24 is performed in response to the integration commencement signal S1. At the same time as the integral operation, the trigger signal S4 is output to the IGBT 65 at step S1109. Consequently, IGBT 65 is turned ON. Thus, the trigger voltage is applied to the trigger electrodes of the xenon tube 151, so that the letter emits the strobe light.

The quantity of light F1 to be reflected from the object SB is increased by the emission of the strobe light. Consequently, when the integral value outputted from the integrating circuit 24 is identical to the value of signal S2 (appropriate or optimum integral value), the quenching signal S3 is outputted from the comparitor 25. If the output of the quenching signal S3 is confirmed at step S1110, the issuance of the trigger signal S4 for emission is stopped at step S1112. Consequently, the emission of the strobe light from the xenon tube 151 is stopped. If there is no quenching signal S3 at step S1110, control proceeds to step S1111 to determine the time set in the timer circuit 28 has expired. If the set time has not elapsed, control is returned to step S1110 to determine whether quenching signal S3 is present. Conversely, if the set time has elapsed at step S1111, control proceeds to step S1112 to completely stop the output of the trigger signal S4. Thereafter, the IGBT 65 is turned OFF and the emission of the strobe light from the xenon tube 151 is stopped.

Thereafter, the timer circuit 28 is deactivated at step S1113. Step S1114 checks whether the maximum emission time $T_1$, is below the maximum emission time $T_2$. In the illustrated embodiment, since it is assumed that the maximum emission time $T_1$ is below the maximum emission time $T_2$, control proceeds to step S1115 to perform the operations at steps S1115 to S1125 in which the emission of the strobe light takes place when the blue liquid crystal filter 152 is in a transparent state. If the maximum emission time $T_1$, is above the maximum emission time $T_1$, the program ends since the operations at steps S1115 through S1125 have already been completed.

The operations in steps S1115 to S1125 are basically identical to those in steps S1104 to S1114. Accordingly, the following discussion will be addressed only to differences therebetween. At step S1115, the blue liquid crystal filter 152 is turned transparent. Thereafter, the maximum emission time $T_2$ is set in the timer circuit 28, so that the timer begins counting at step S1116. At step S1117, an optimum integral value of the light transmitted through the transparent filter 152 and reflected from the object to be photographed, corresponding to the color temperature $K_A$ of the ambient light is read from the memory 29 and inputted to the D/A converter 26.

At step S1125, if it is judged that the maximum emission time $T_1$ is less than the maximum emission time $T_2$, the program ends. If the maximum emission time $T_1$ is greater than the maximum emission time $T_2$, the control is returned to step S1104 to execute the operations at steps S1104 to S1114.

As mentioned above, if the color temperature $K_A$ of the ambient light is higher than the color temperature of the strobe light, the operations at steps S1101 and S1125 are performed, so that the blue liquid crystal filter 152 is turned blue or transparent to carry out the emission of the strobe light. If the color temperature $K_A$ of the ambient light is lower than the color temperature of the strobe light, the operations at steps S1201 to S1225 (FIGS. 28 and 29) are performed. Namely, the amber liquid crystal filter 153 is turned amber or transparent to carry out the emission of the strobe light. The operations at steps S1201 to S1225 are substantially identical to those in the above-mentioned steps S1101 to S1125, except for the number of filters to be controlled. Accordingly, no explanation therefor will be given.

As may be understood from the foregoing, in the illustrated embodiment, the amber liquid crystal filter 153 is made transparent and the blue liquid crystal filter 152 is selectively turned blue or transparent if the color temperature $K_A$ of the ambient light is above the color temperature $K_2$ of the strobe light emitted from the xenon tube 151, so that the resultant color temperature of the successive emissions from the xenon tube 151 are substantially identical to the color temperature of the ambient light. Similarly, if the color temperature $K_A$ of the ambient light is below the color temperature of the strobe light emitted from the xenon tube 151, the blue liquid crystal filter 152 is made transparent and the amber liquid crystal filter 153 is selectively turned amber or transparent, so that a predetermined resultant color temperature of the successive emissions from the xenon tube 151 can be obtained. Namely, the controllable range of the color temperature by the blue liquid crystal filter 152 is between the upper limit $K_1$ of the color temperature and the lower limit $K_2$ of the color temperature. Similarly, the controllable range of the color temperature by the amber liquid crystal filter 153 is between the upper limit $K_2$ of the color temperature and the lower limit $K_3$ of the color temperature. The lower limit $K_2$ of the blue liquid crystal filter 152 is identical to the upper limit $K_2$ of the amber liquid crystal filter 153. The value $K_2$ is identical to the inherent color temperature of the strobe light emitted from the xenon tube 151.

Consequently, the controllable ranges of the color temperature by the liquid crystal filters 152 and 153 are narrower than those by dyed filters or permanently colored filters (the control of the quantity of light to be emitted at the color temperatures of $K_1$ and $K_6$). Therefore, if there is an error in the control of the emission by the xenon tube 151, etc., the resultant color temperature can be correctly controlled.

Figure 30:
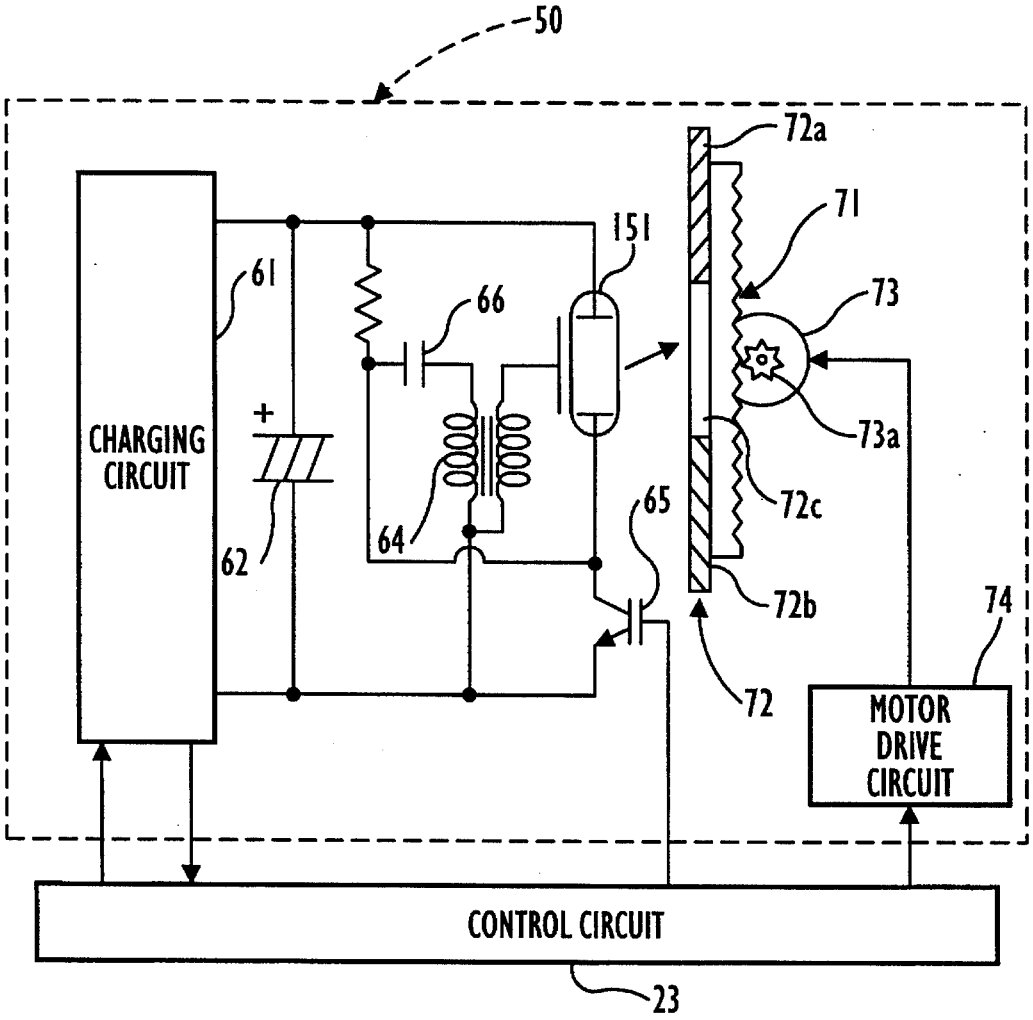
FIG. 30 is a circuit diagram of an eighth embodiment of a strobe apparatus according to the present invention.

FIG. 30 shows a block diagram of an eighth embodiment of the strobe apparatus 50 according to the present invention.

In the embodiment illustrated in FIG. 30, guest-host type liquid crystal filters shown in the fifth embodiment are replaced with a filter 72 which is driven by a rack 71 which is in mesh with a pinion 73*a* secured to a drive shaft of a motor 73. The filter 72 comprises a transparent substrate, made of, for example, a glass plate which is provided with a blue filter portion 72*a* formed by a blue filter film coated thereon, an amber filter portion 72*b* formed by an amber filter film coated thereon, and a transparent filter portion 72*c* having a transparent film or a gap. The motor 73 is driven by a motor driving circuit 74 which is in turn controlled by the control circuit 23.

The switching control of the filter 72 shown in FIG. 30 is substantially identical to that in the fifth embodiment, and accordingly, the following discussion is directed only to points different from the operations shown in FIGS. 26–29.

There are no operations at steps S1101 and S1201 in the eight embodiment. At step S1104, the blue filter portion 72*a* is located in front of the xenon tube 151 and at step S1115, the transparent filter portion 72*c* is located in front of the xenon tube 151, respectively. At step S1204, the amber filter portion 72*b* is located in front of the xenon tube 151, and at step S1215, the transparent filter portion 72*b* is located in front of the xenon tube 151. The operations at other steps are the same as those in FIGS. 26 through 29.

The same technical effect as the fifth embodiment can be obtained in this embodiment.

Figure 31:
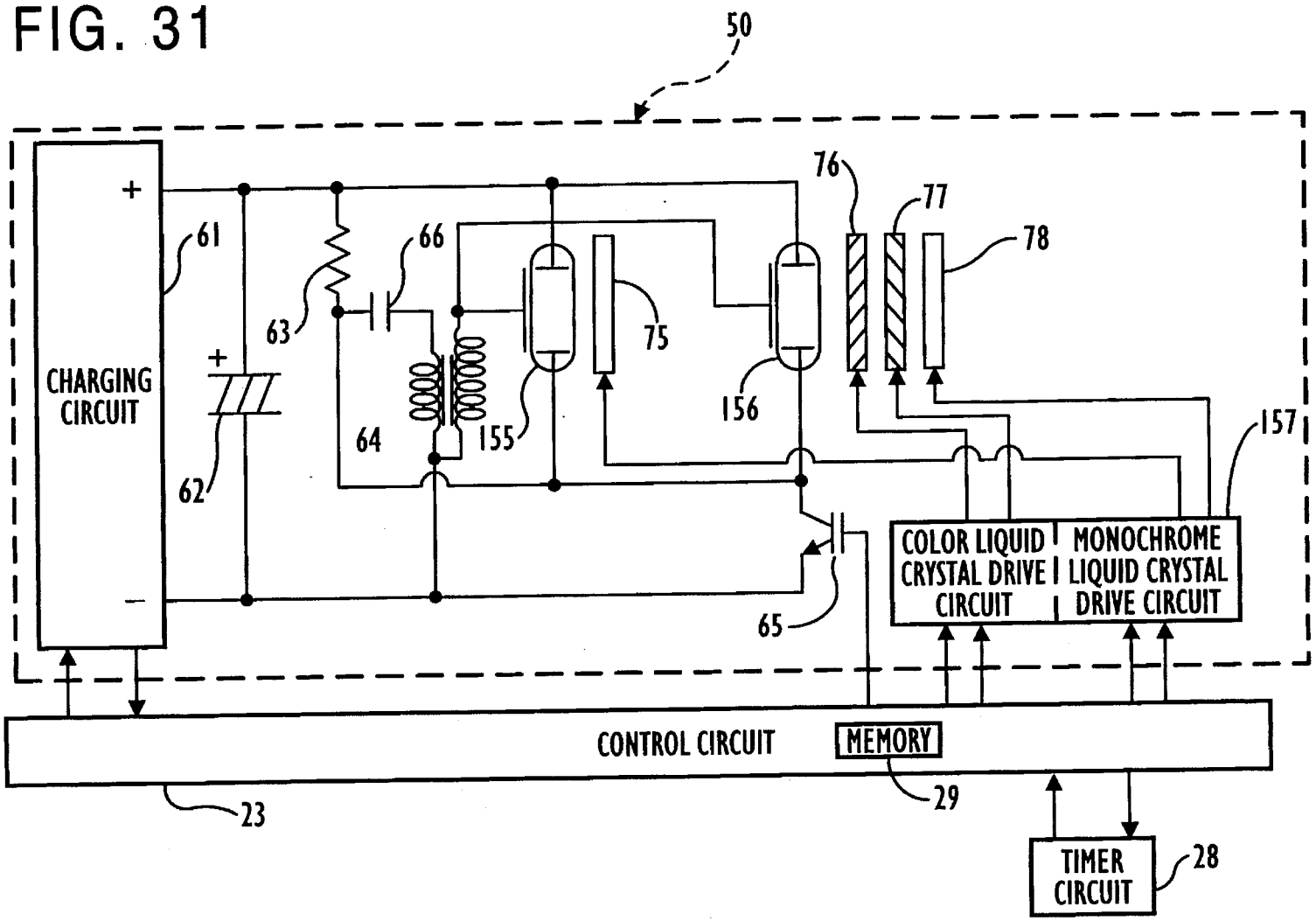
FIG. 31 is a circuit diagram of a ninth embodiment of a strobe apparatus according to the present invention.

FIG. 31 shows a block diagram of the strobe apparatus 50 according to a ninth embodiment of the present invention.

In the ninth embodiment, there are two xenon tubes 155 and 156, unlike the fifth embodiment in which there is only one xenon tube. The xenon tubes 155 and 156 simultaneously commence and stop the emission of the strobe light. There is a monochrome liquid crystal filter 75 in front of the first xenon tube 155. There is a blue liquid crystal filter 76, an amber liquid crystal filter 77 and a monochrome liquid crystal filter 78 in front of the second xenon tube 156. The filters 76, 77 and 78 in front of the second xenon tube 156 are superimposed, so that the strobe light emitted from the second xenon tube 156 is transmitted through the filters and made incident upon the object to be photographed.

The color of the blue liquid crystal filter 76 and the amber liquid crystal filter 77 is controlled by the color liquid crystal driving circuit 154. The amber liquid crystal filer 77 is selectively turned amber or transparent, and the blue liquid crystal filter 76 is selectively turned blue or transparent, respectively. The density of the monochrome liquid crystal filters 75 and 78 is controlled by the monochrome liquid crystal driving circuit 157. The color liquid crystal driving circuit 154 and the monochrome liquid crystal driving circuit 157 are actuated in response to the control signal output from the control circuit 23.

Figure 32:
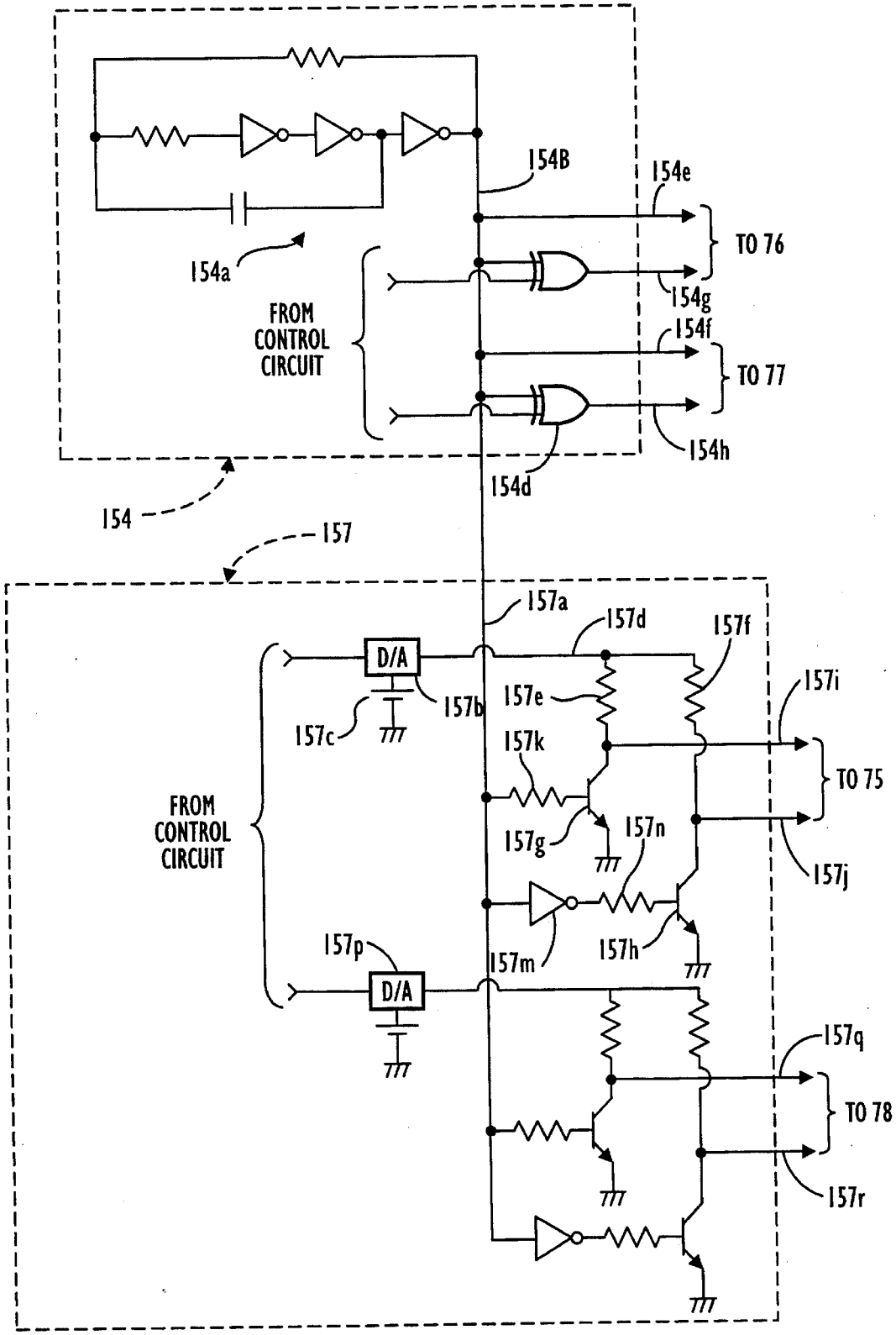
FIG. 32 is a circuit diagram of a color liquid crystal driving circuit and a monochrome liquid crystal driving circuit.

FIG. 32 shows internal structures of the color liquid crystal driving circuit 154 and the monochrome liquid crystal driving circuit 157. The color liquid crystal driving circuit 154 is the same as that shown in FIG. 25, and the signal line 154*b* of the color liquid crystal driving circuit 154 is connected to the signal line 157*a* of the monochrome liquid crystal driving circuit 157.

The monochrome liquid crystal driving circuit 157 includes drive circuits for driving the monochrome liquid crystal filters 75 and 78. These circuits are identical, and accordingly, the drive circuit for the monochrome liquid crystal filter 75 only will be discussed below. Namely, the D/A converter 157*b* is connected to a constant voltage power source 157*c* to output a signal whose amplitude corresponds to the control signal input thereto from control circuit 23. Signal line 157*d* is connected to the D/A converter 157*b* and collector terminals of the transistors 157*g* and 157*b* through the resistors 157*a* and 157*f*, respectively. The collector terminals of transistors 157*g* and 157*h* are connected to the monochrome liquid crystal filter 75 through signal lines 157*i* and 157*j*. Signal line 157*a* is connected to the base terminal of the transistor 157*g* through resistor 157*k* and to the base terminal of transistor 157*h* through inventor 157*m* and the resistor 157*n*.

Consequently, the rectangular wave voltage signal which varies at a predetermined cycle, outputted from the oscillator 154*b* of the color liquid crystal driving circuit 154, is applied to the base terminals of transistors 157*g* and 157*h*, so that the liquid crystal driving rectangular wave signal which varies at the same cycle as the rectangular wave voltage signal is outputted to the monochrome liquid crystal filter 75 through signal lines 157*i* and 157*j*. The amplitude of the liquid crystal driving signal is determined in accordance with the amplitude of the output signal of the D/A converter 157*b*. The density of the monochrome liquid crystal filter 75 is controlled in accordance with the amplitude of the liquid crystal driving signal. Note that since the voltage of the opposite phase is applied to the base terminals of the transistors, the phases of the rectangular wave signals output from the signal lines 157*i* and 157*j* are opposite.

The drive circuit for driving the monochrome liquid crystal filter 78 is the same as the drive circuit for driving the monochrome liquid crystal filter 75, as mentioned above.

Namely, the signal having an amplitude corresponding to the control signal inputted thereto from the control circuit 23 is outputted from the D/A converter 157p, so that the liquid crystal driving rectangular wave signal whose amplitude corresponds to the amplitude of the control signal is outputted into the monochrome liquid crystal filter 78 through signal lines 157*q* and 157*r* to control the density of the monochrome liquid crystal filter 78.

FIG. 33 shows a flow chart of the emission control according to the ninth embodiment of the present invention.

At step S1300, the color temperature $K_A$ of the ambient light is detected. If the color temperature $K_A$ is above the color temperature $K_2$ of the strobe light emitted from the xenon tubes 155 and 156, control proceeds to step S1302 at which the blue liquid crystal filter 76 is turned blue. Conversely, if the color temperature $K_A$ is below the color temperature $K_2$ of the strobe light, control proceeds to step S1303 at which the blue liquid crystal filter 76 is turned transparent. At the same time, the amber liquid crystal filter 77 is turned amber at step S1304.

At step S1305, the density data of the monochrome liquid crystal filters 75 and 78 corresponding to the color temperature KA of the ambient light is read from the memory 29 and is inputted to the D/A converters 157*b* and 157*p* of the monochrome liquid crystal driving circuit 157. At step S1306, the maximum emission time T is set in the timer circuit 28, so that the latter begins counting the time. At step S1307, the optimum integral value corresponding to the color temperature $K_A$ of the ambient light is read from the memory 29 and sent to the D/A converter 26.

Figure 26:
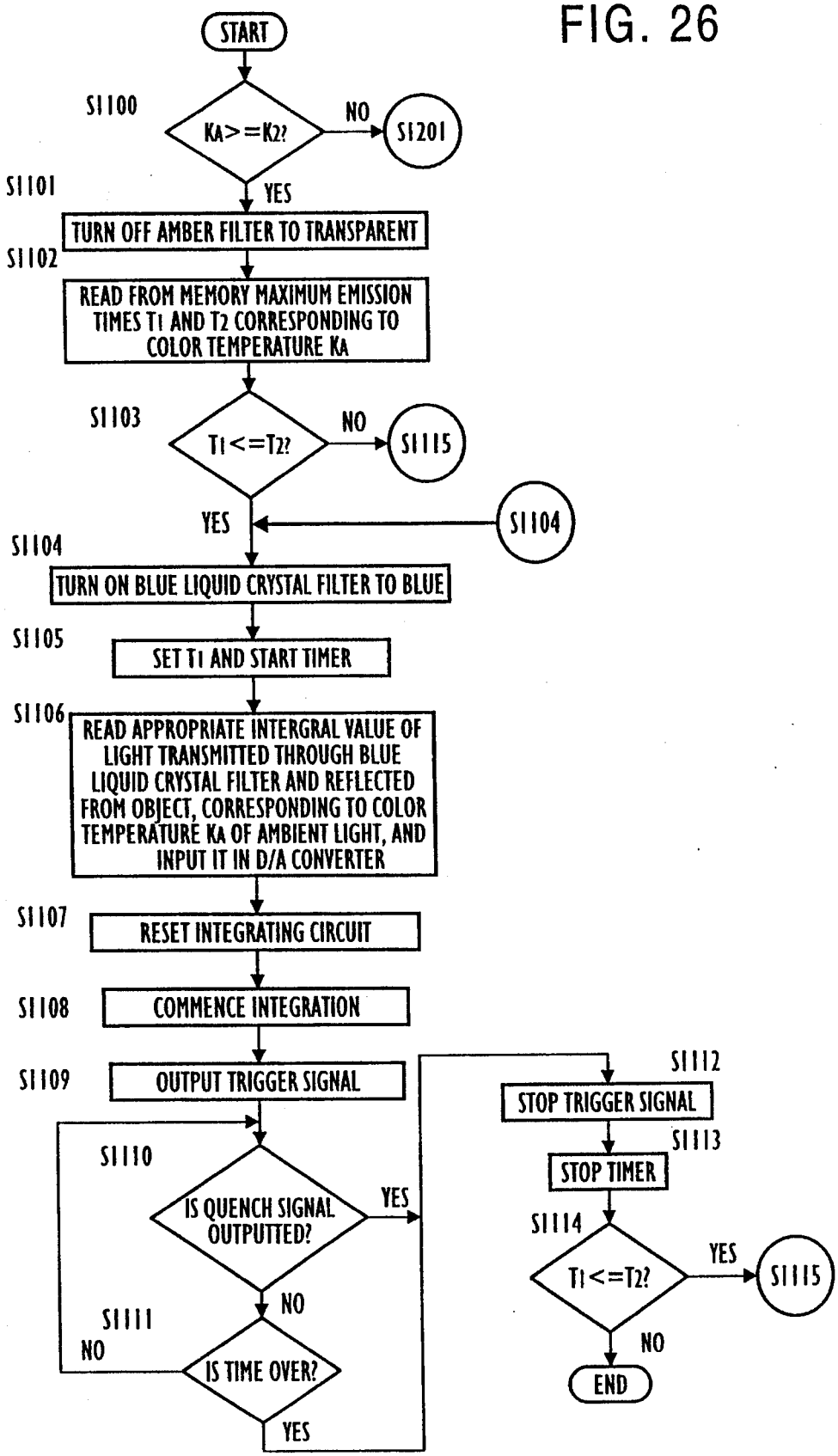
FIG. 26 is a flow chart of a strobe light emitting operation when a blue liquid crystal filter is turned blue.
Figure 28:
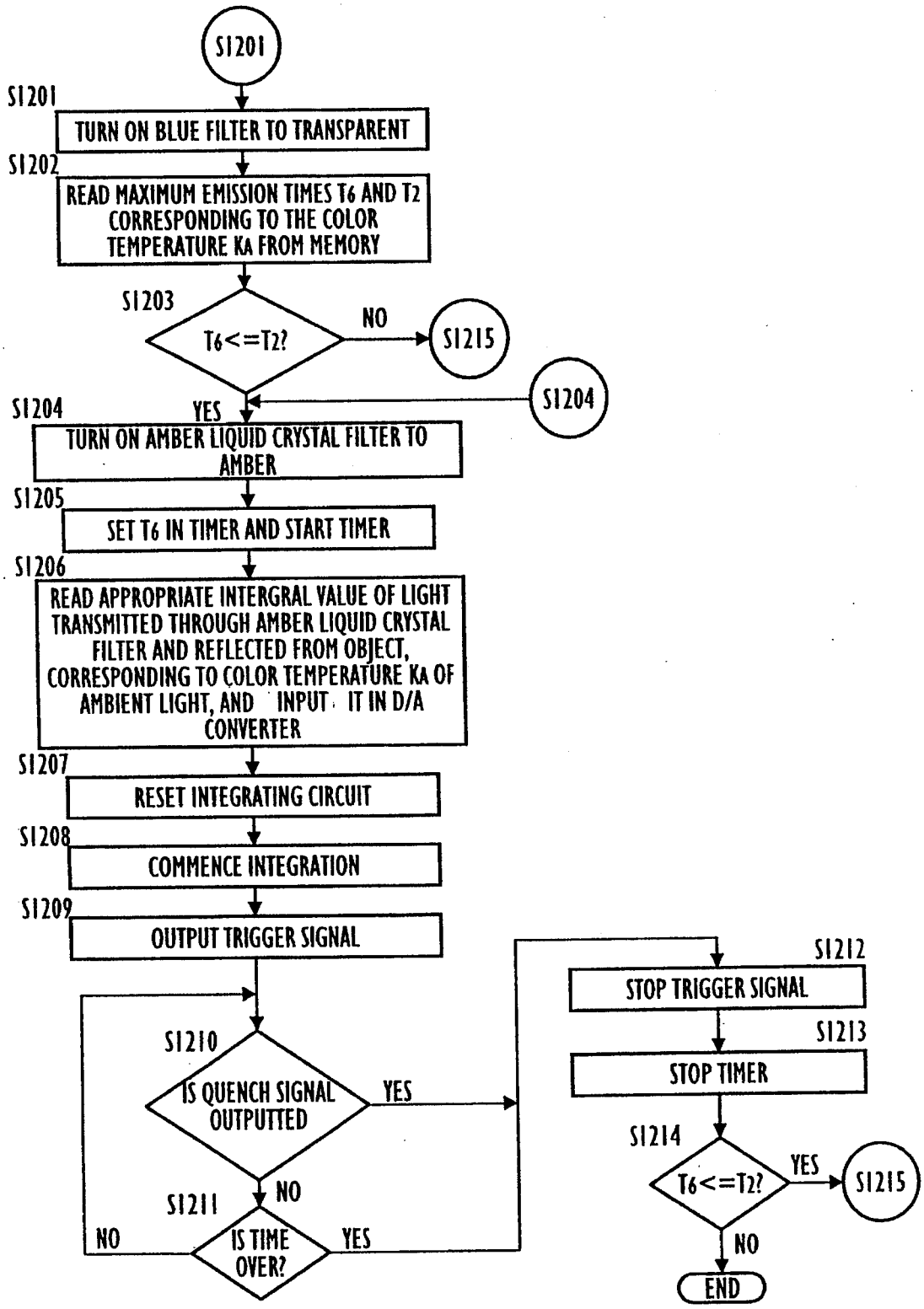
FIG. 28 is a flow chart of a strobe light emitting operation when an amber liquid crystal filter is turned amber.
Figure 27:
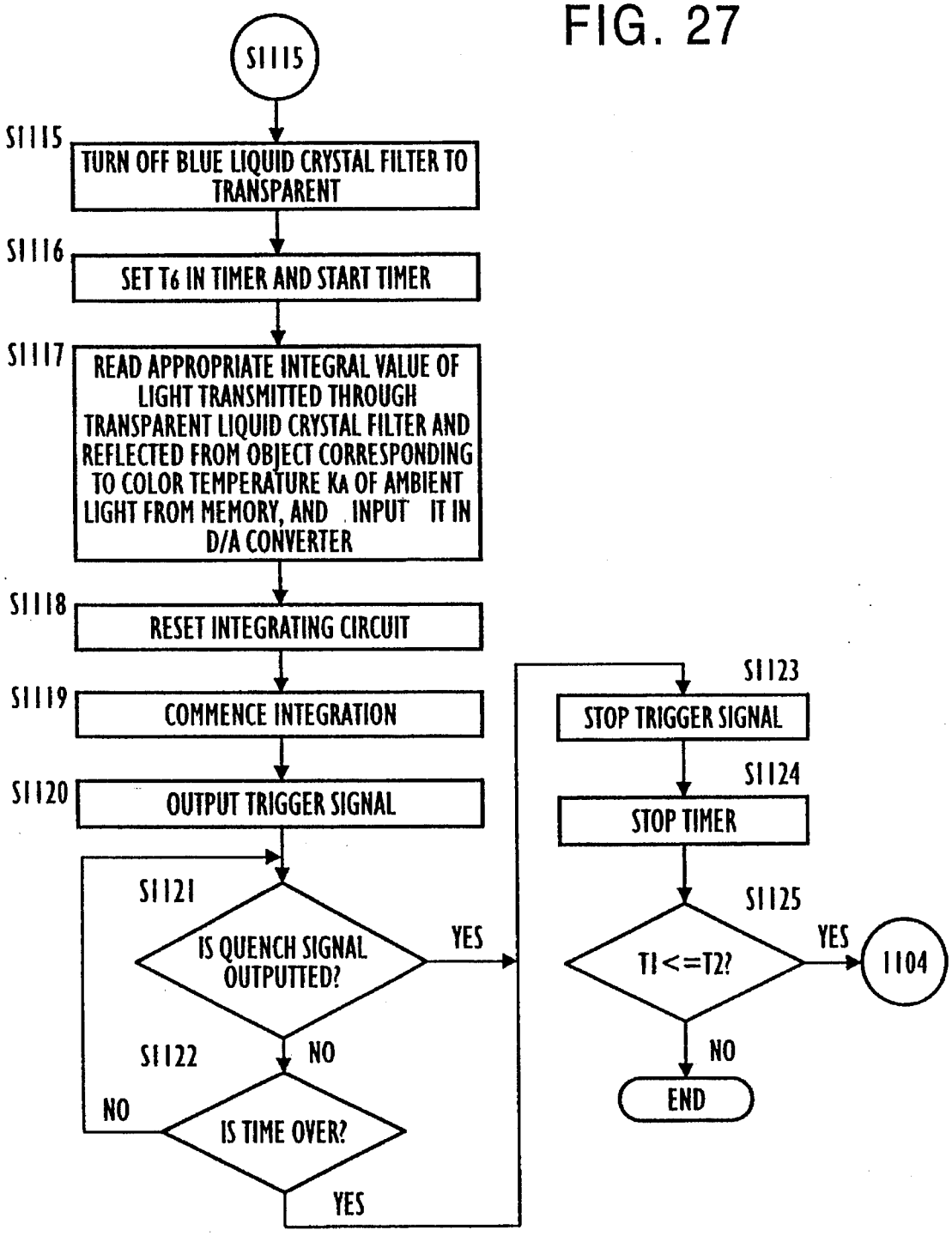
FIG. 27 is a flow chart of a strobe light emitting operation when a blue liquid crystal filter is turned transparent.
Figure 29:
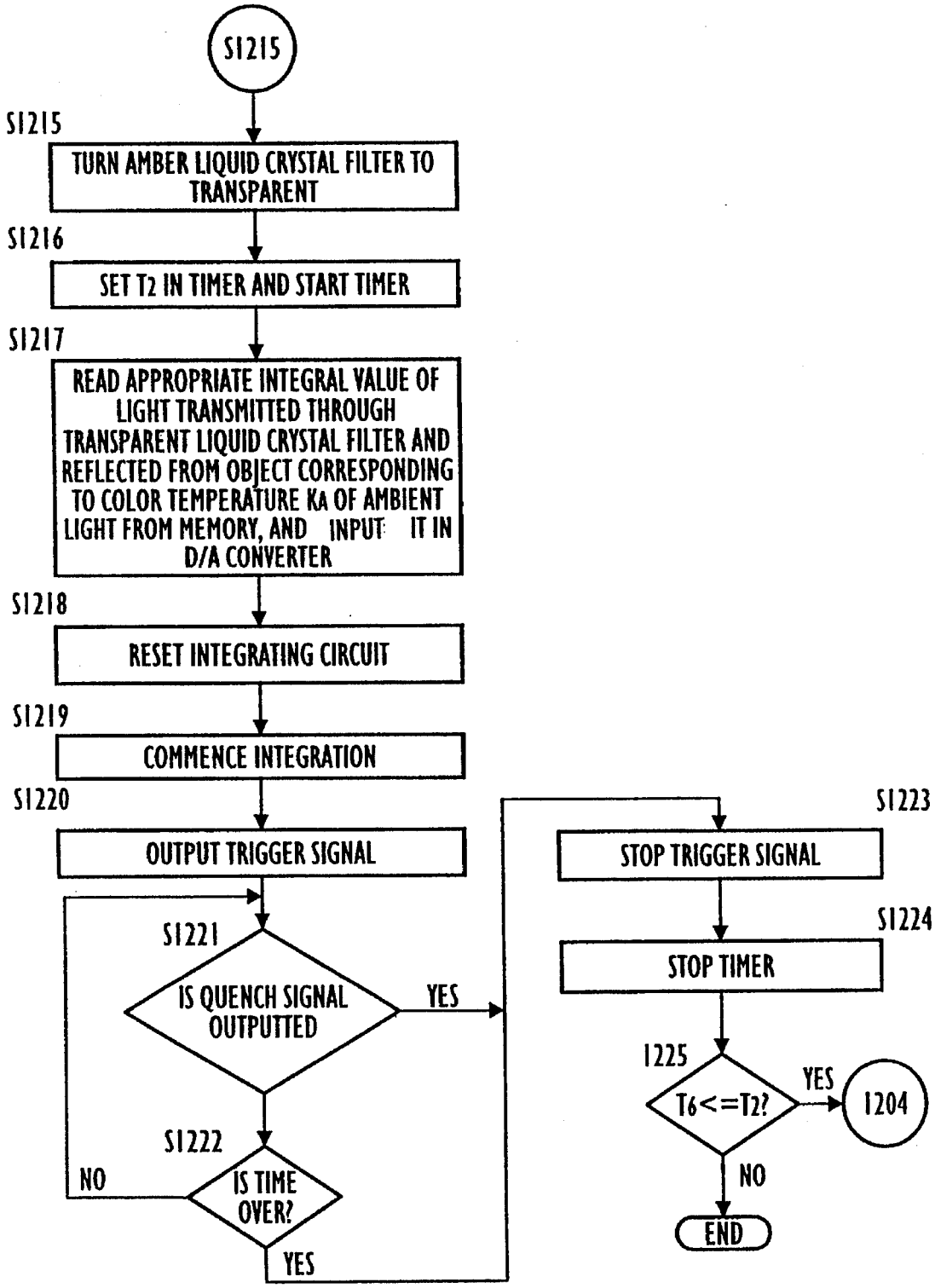
FIG. 29 is a flow chart of a strobe light emitting operation when an amber liquid crystal filter is turned transparent.

The operations at steps S1308 to S1314 are identical to those in steps S1107 to S1114 shown in FIG. 26. Namely, the integral value of the integrating circuit 24 is reset at step S1308, and thereafter, at step S1309, the integrating circuit 24 carries out the integration operation. At step S1310, trigger signal S4 for emission is outputted to cause the xenon tubes 155 and 156 to emit the strobe light. As a result, the quantity of light reflected from the object is increased, so that when the integral value outputted from the integrating circuit 24 reaches the optimum value, the quenching signal S3 is outputted from 25. Consequently, if the output of the quenching signal S3 is confirmed at step S1311, control proceeds to step S1313 to stop the output of the trigger signal S4 to thereby stop the emission of the strobe light from the xenon tube 151. If there is no quenching signal S3 at step S1311, control proceeds to step S1312 to check whether the time set in the timer circuit 28 is up. If the set time has not expired, control returns to step S1311 to judge the issuance of the quenching signal S3. If the set time has expired, the outputting of the trigger signal S4 is compulsively stopped at step S1313 to thereby stop the emission of the strobe light from the xenon tubes 155 and 156. Thereafter, the timer circuit 28 is deactivated at step S1314 and the program ends.

The same technical effects as the eighth and ninth embodiments are obtained in a tenth embodiment.

Figure 34:
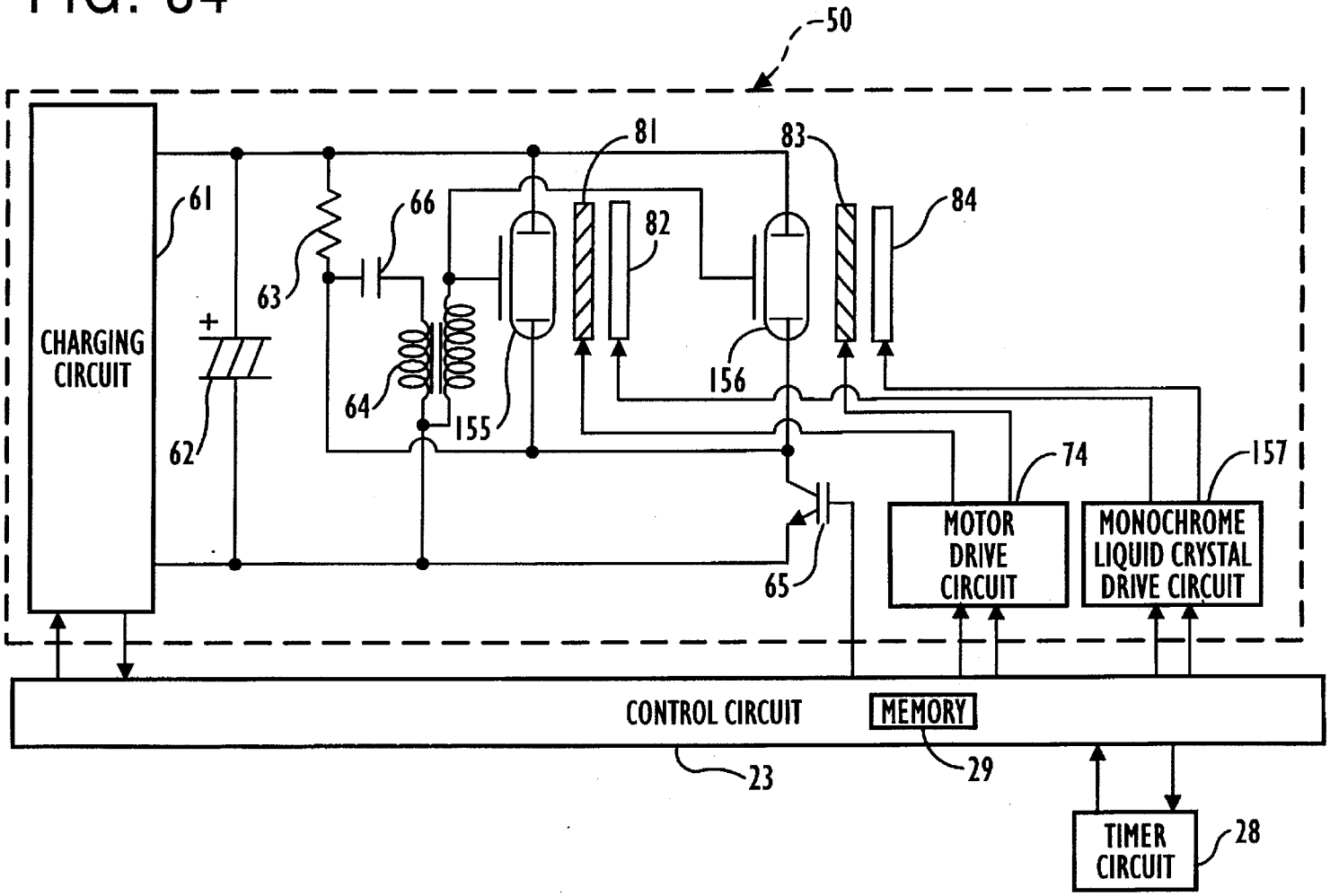
FIG. 34 is a circuit diagram of a tenth embodiment of a strobe apparatus according to the present invention.

FIG. 34 shows a block diagram of a strobe apparatus 50 according to a tenth embodiment of the present invention.

In the tenth embodiment, the xenon tubes 155 and 156 simultaneously emit strobed light, similar to the ninth embodiment. In the tenth embodiment, there is a first color filter 81 and a monochrome liquid crystal filter 82 in front of the first xenon tube 155. Similarly, there is a second color filter 83 and a monochrome liquid crystal filter 84 in front of the second xenon tube 156. The density of the monochrome liquid crystal filters 82 and 84 is controlled by the monochrome liquid crystal driving circuit 157, similar to the ninth embodiment. The color filters 81 and 83 are controlled by the motor driving circuit 74 and are provided with filter portions of predetermined colors.

Figure 35A:
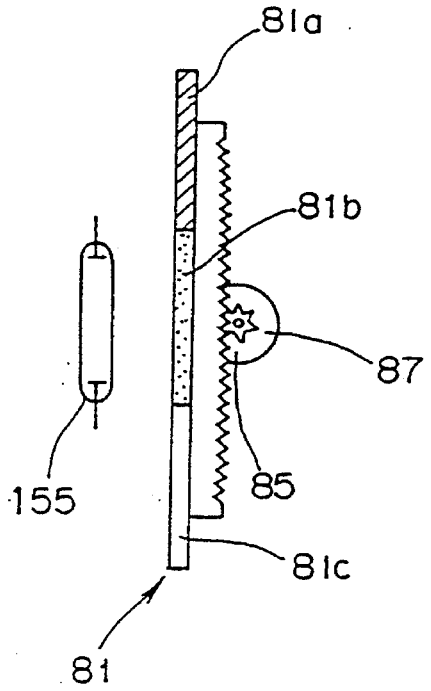
FIGS. 35A and 35B are a schematic view of color filters and xenon tubes in an eighth embodiment.
Figure 35B:
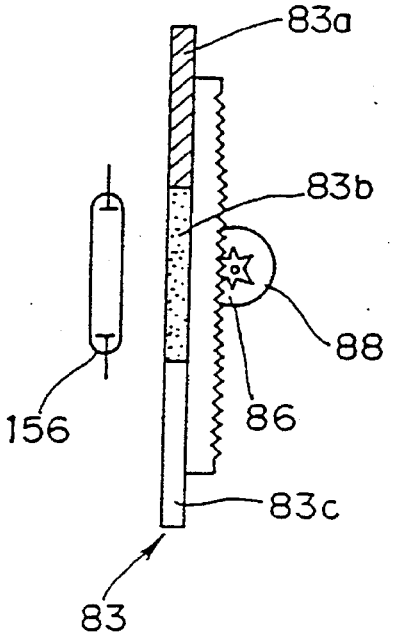

FIGS. 35A and 35B show the structures of the color filters 81 and 83.

The color filters 81 and 83 are driven by respective rack-opinion mechanisms 85 and 86. Namely, the pinions of the rack-pinion mechanisms 85 and 86 are secured to the drive shafts of the motors 87 and 88 which are controlled by the motor driving circuit 74 in accordance with the control signal of the controller 23.

The color filters 81 and 83 are each provided with three kinds of filter portions made of color films coated on transparent glass plates. Namely, the first color filter 81 comprises a first filter portion 81*a*, a third filter portion 81*b*, and a fifth filter portion 81*c*. The second color filter 83 comprises a second filter portion 83*a*, a fourth filter portion 83*b*, and a sixth filter portion 83*c*. The light transmitted through the first filter portion has the highest color temperature, and the light transmitted through the sixth filter portion has the lowest color temperature. The color temperature of the light transmitted through the filter portions is gradually reduced from the first filter portion toward the sixth filter portion, except in the second filter portion 83*a* which is transparent.

Figure 36:
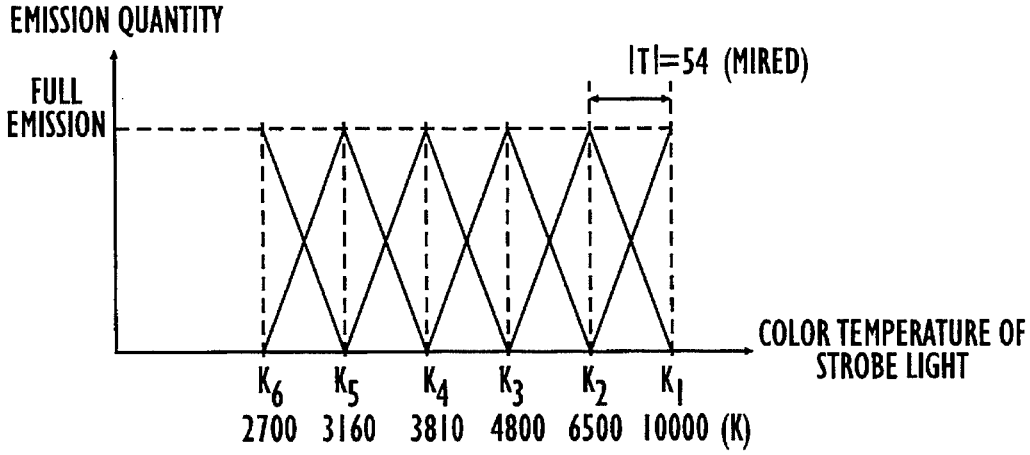
FIG. 36 is a diagram of the controllable range of the color temperature by six filter portions in the tenth embodiment.

FIG. 36 shows the controllable range for the color temperature of the strobe light for the first through sixth filter portions.

Namely, the color temperatures of the strobe light transmitted through the filter portions located in front of the xenon tubes are 10000° K., 6500° K., 4800° K., 3810° K., 3160° K., and 2700° K., respectively. Consequently, for example, if strobe light of 8000° K. is necessary, filters 81 and 83 are moved so that the first and second filter portions 81*a* and 83*a* are opposed to respective xenon tubes 155 and 156.

The differences of reciprocals of the color temperatures modified by the filter portions within the controllable range, that is, the differences of reciprocals of the upper and lower limits of the color temperatures are substantially identical and are around 54 mired. The reason why the controllable ranges by the respective filter portions are such that the differences of reciprocals of the upper and lower limits of the color temperatures are substantially identical is that the sensitivity to human eyes increases as the color temperature decreases. Namely, in the tenth embodiment, the controllable range reduces as the color temperature decreases to thereby increase the accuracy of the control of the color temperature.

Figure 37:
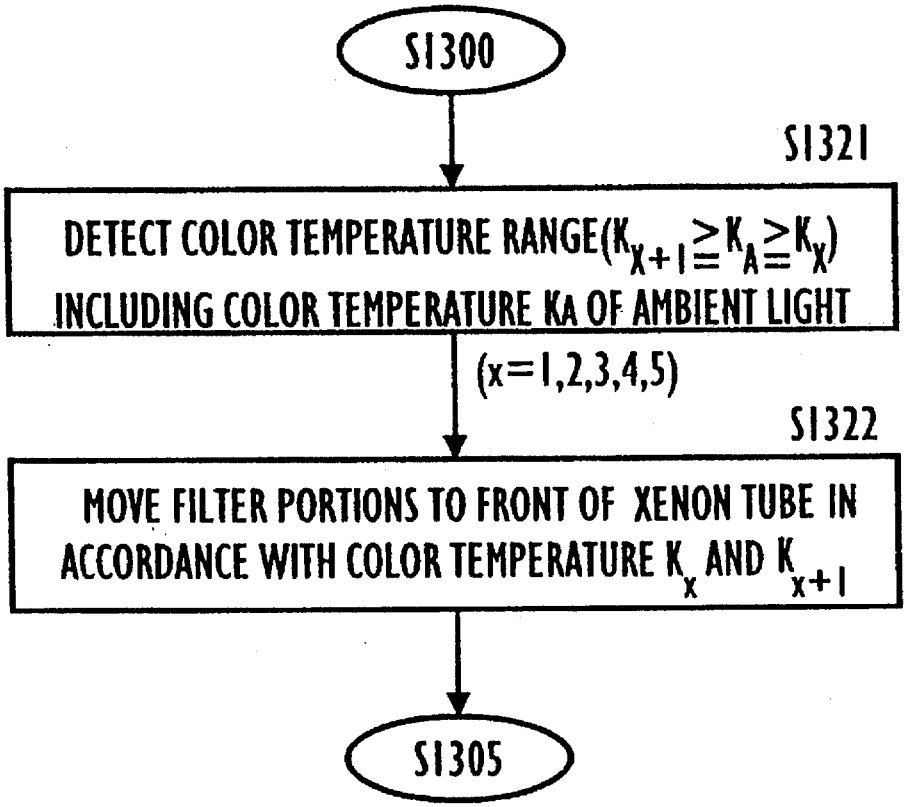
FIG. 37 is a flow chart of a main part of an emission control operation in the tenth embodiment.

The operation in the tenth embodiment is basically identical to the operation of the ninth embodiment. Namely, in the tenth embodiment, there are steps S1321 and S1322 between steps S1300 and S1305 in the flow chart shown in FIG. 37. The color temperature ($K_{x+1} \geqq K_A \geqq K_X$) including the color temperature $K_A$ of the ambient light is detected in accordance with the output of the color sensor 22 at step S1321. At step S1322, predetermined filter portions are moved to the front of the xenon tubes 155 and 156 in accordance with the color temperature range detected at step S1321. For instance, if the color temperature $K_A$ of the ambient light is 80000° K., the first filter portion 81*a* of the first filter 81 and the second filter portion 83*a* of the second filter 83 are moved to be opposed to the xenon tubes 155 and 156, respectively.

According to the tenth embodiment, the same technical effects as the seventh, eighth and ninth embodiments are obtained. In the tenth embodiment, unlike the previous embodiments, the controllable range of the resultant color temperature is split into finer ranges having the filter portions 81*a*, 83*a*, 81*b*, 83*b*, 81*c*, and 83*c* having different colors. The controllable ranges by the respective filter portions are set such that the differences of the reciprocals of the color temperatures are substantially identical. Consequently, it is possible to precisely control the color temperature, particularly when the color temperature is relatively low in comparison with the previous embodiments.

As can be understood from the above discussion, according to the present invention, in an arrangement in which a predetermined resultant color temperature is obtained by strobe lights having different colors in combination, if there is a difference in the emission between the strobe lights, a correct resultant color temperature can be obtained.

Figure 38:
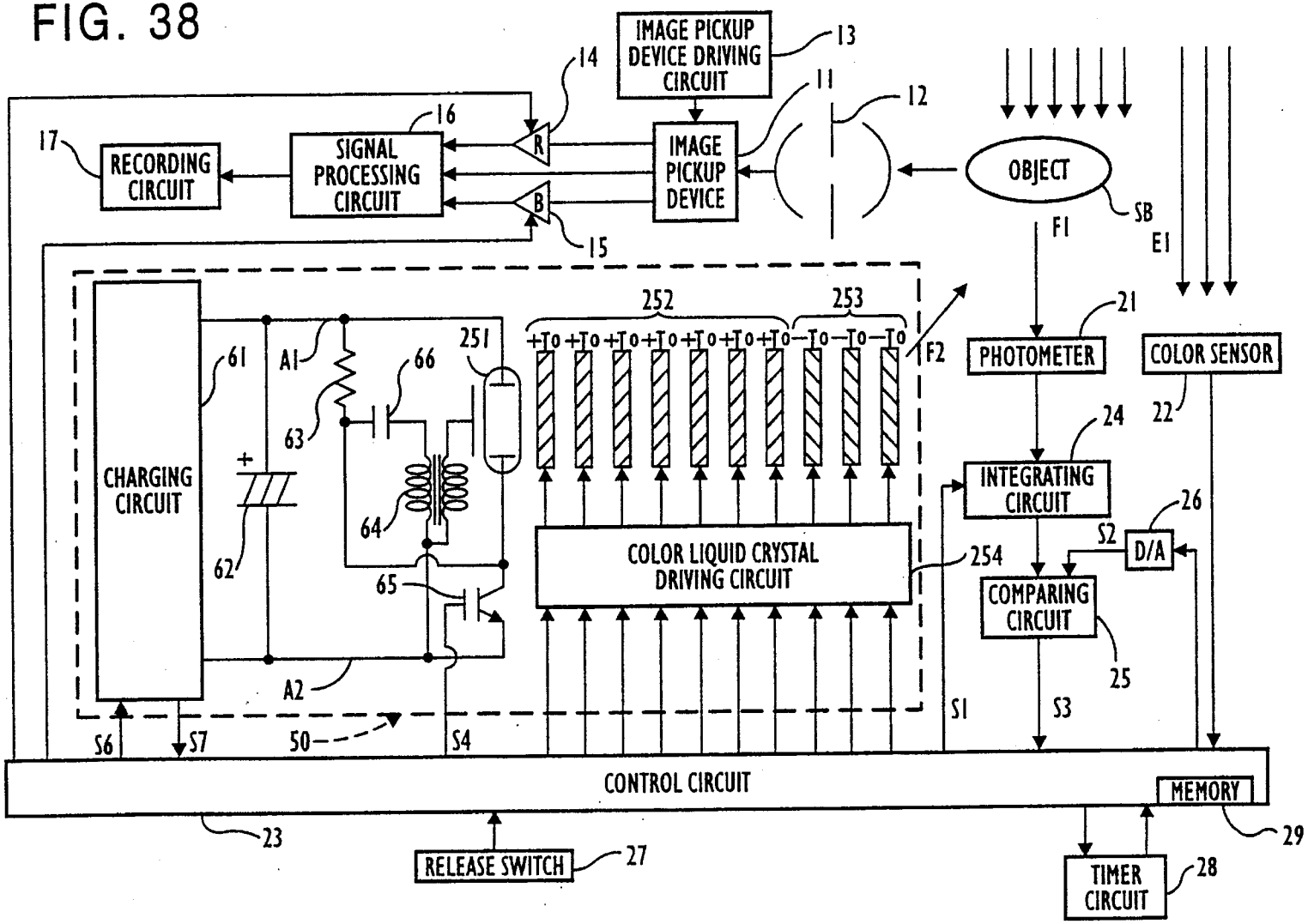
FIG. 38 is a circuit diagram of a still video camera to which a strobe apparatus according to an eleventh embodiment of the present invention is applied.

FIG. 38 shows an eleventh embodiment of the present invention. This embodiment has only one xenon tube 251 and two color liquid crystal filters groups 252 and 253.

The strobe apparatus 50 is connected to the control circuit (controller) 23 so that the commencement and completion of the emission of the strobe light by the xenon tube 251 of the strobe apparatus 50 can be controlled by the controller 23. In the illustrated embodiment, there is only one xenon tube 251. There are seven amber liquid crystal filters 252 and three blue liquid crystal filters 253 in front of the xenon tube 251. The amber liquid crystal filters 252 and the blue liquid crystal filters 253 are made of GH liquid crystals having amber and blue pigments incorporated therein, respectively. The voltages to be applied to the color filters 252 and 253 are controlled by a color liquid crystal driving circuit 254, so that the color temperature conversion properties of the color filters 252 and 253 can be controlled in accordance with the amplitude of the voltages. For instance, when the voltages are applied to the color filters 252 and 253, the latter are respectively amber and blue, and when no voltage is applied, the color filters 252 and 253 are transparent. The liquid crystal driving circuit 254 is actuated in response to the control signal outputted from the control circuit 23.

The amber liquid crystal filters 252 have the same color temperature conversion property ($+T_O$ mired). Similarly, the blue liquid crystal filters 253 have the same color temperature conversion property ($-T_O$ mired).

A sequence diagram of the emission of the strobe light in the eleventh embodiment is similar to the embodiment shown in FIG. 23. Note that in the emission control of the strobe light at D28, the voltage is applied to the electrodes of a specific amber liquid crystal filter 252 or a specific blue liquid crystal filter 253 to tint or color the same.

Figure 39:
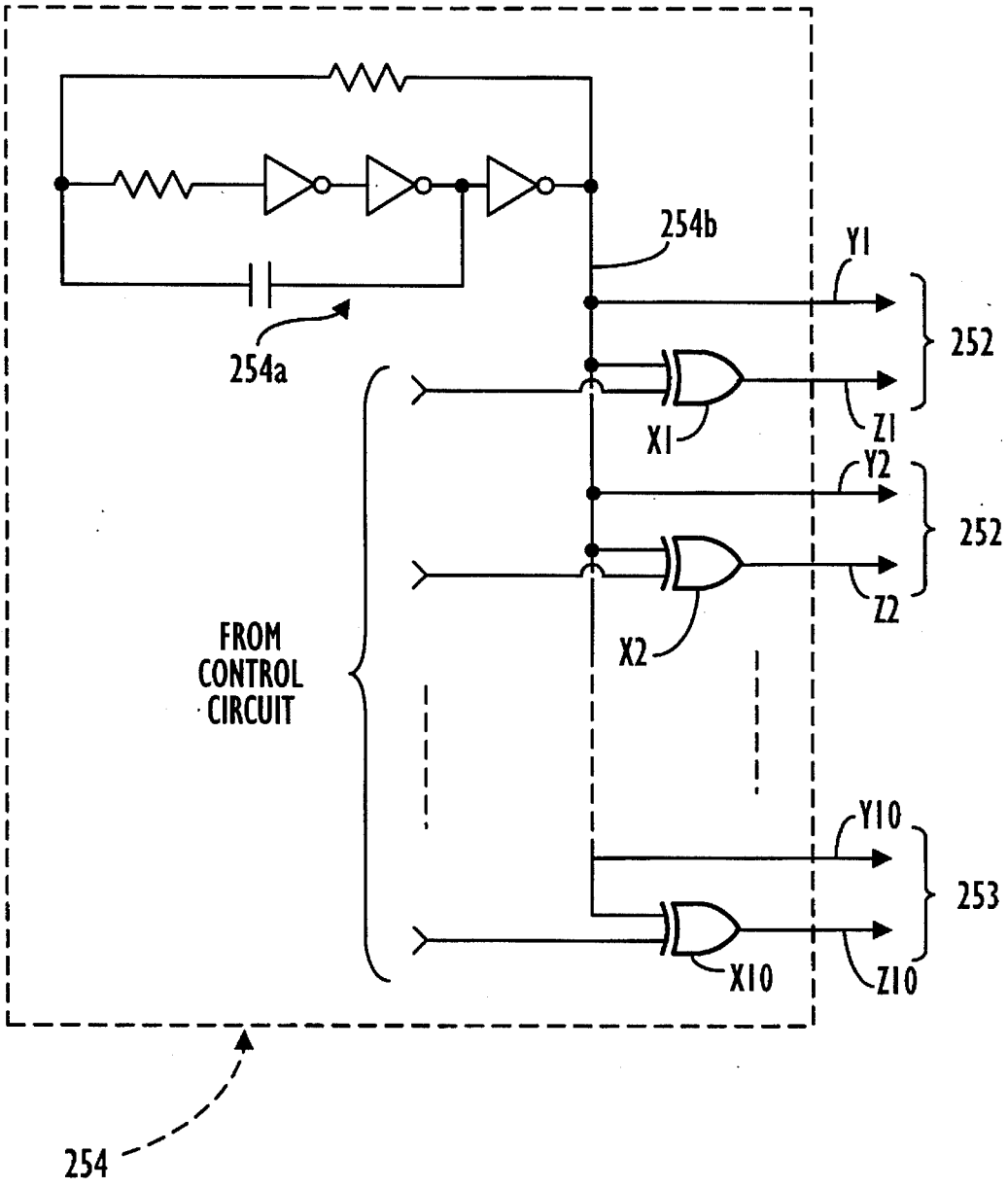
FIG. 39 is a circuit diagram of a color liquid crystal driving circuit according to the present invention.

FIG. 39 shows an internal structure of the color liquid crystal driving circuit 254. The coloring of the amber liquid crystal filters 252 and the blue liquid crystal filters 253 is controlled by the driving circuit 254.

Oscillator 254*a* comprises a plurality of inventors, a resistor, and a capacitor in combination. The signal line 254*b*, connected to the output terminal of the oscillator 254*a*, is connected to the first input terminals of EXOR circuits X1, X2, . . . X10, and to the seven amber liquid crystal filters 252 and the three blue liquid crystal filters 253 through the signal lines Y1, Y2, . . . Y10, respectively. Consequently, the rectangular wave signals, which vary at a predetermined frequency, i.e., signals "0" and "1" are alternately inputted to the EXOR circuits X1, X2, . . . X7, the amber liquid crystal filters 252 and X8, X9 and X10 of the blue liquid crystal filters 253. The control signal "0" or "1" is inputted to the second input terminals of the EXOR circuits X1, X2, . . . X10 from the control circuits 23. The output terminals of the EXOR circuits X1, X2, . . . X7 are connected to the amber liquid crystal filters 252 an X8, X9 and X10 to the blue liquid crystal filters 253 through the signal lines Z1, Z2, . . . Z10, respectively.

The EXOR circuit X1 outputs a signal whose level is identical to the level of the signal to be inputted to the first input terminal thereof when the control signal from the control circuit 23 is "0". When the control signal from the control circuit 23 is "1", the EXOR circuit X1 outputs a signal whose level is opposite the level of the signal to be inputted to the first input terminal thereof. Consequently, if the control signal is "0", the rectangular wave signals having the same phase are transmitted through signal lines Y1 and Z1, so that no voltage is applied to the electrodes of the amber liquid crystal filter 252, and thus, the filter 252 is transparent. Conversely, if the control signal is "1", the rectangular wave signals having opposed phases are transmitted through the signal lines Y1 and Z1, so that a voltage is applied to the electrodes of the amber liquid crystal filter 252, and thus, the filter group 252 becomes amber.

Similarly, if the control signal to be sent to EXOR circuit X10 is "0", the rectangular wave signals having the same phase are transmitted through the signal lines Y10 and Z10, so that no voltage is applied to the electrodes of the blue liquid crystal filter 253, and thus, the filter group 253 is transparent. Conversely, if the control signal is "1", the rectangular wave signals having opposed phases are transmitted through the signal lines Y10 and Z10, so that a voltage is applied to the electrodes of one blue liquid crystal filter 253, and thus, that filter 253 is blue.

Figure 40:
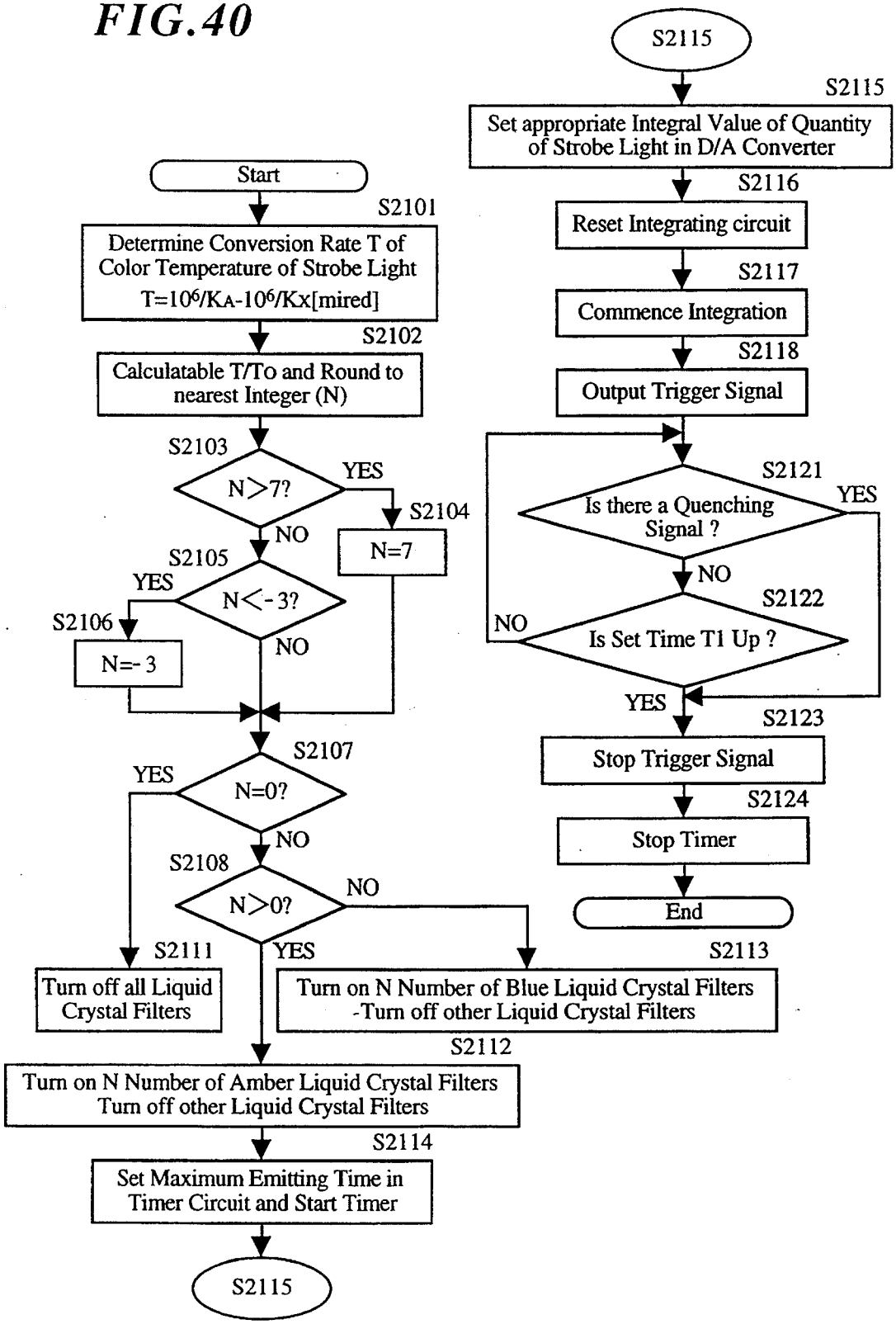
FIG. 40 is a flow chart of a strobe light emitting operation in the eleventh embodiment of the present invention.

FIG. 40 shows a flow chart of the control operations of the control circuit 23 to control the strobe emission of the eleventh embodiment.

At step S2101, the conversation rate T of the color temperature of the strobe light emitted from the strobe apparatus 50 is determined based on the color temperature $K_A$ of the ambient light E1 an the color temperature $K_X$ of the strobe light by the xenon tube 251, using the following equation (1):

$$T=10^6/K_A-10^6/K_X \text{ (mired)} \quad (1)$$

Namely, if the color temperature $K_A$ of the ambient light E1 is lower than the color temperature $K_X$ of the strobe light emitted by the xenon tube 251, the conversion rate T is a positive value. Conversely, if the color $K_A$ of the ambient light E1 is higher than the color temperature $K_X$ of the strobe light emitted by the xenon tube 251, the conversion rate T is a negative value.

At step S2102, the conversion rate T is divided by the conversion rate $T_0$ of the filters 252 and 253 and rounded to obtain an integer. That is:

$$T/T_0=N \quad (2)$$

Where N is the number of filters 252 and 253 necessary to balance the color temperature (positive value of N is for the amber filters and the negative value of N is for the blue filters).

At steps S2103 through S2106, the number N of the filters is limited to a value within −3 to 7. At step S2103, whether the number N is larger than 7 is checked. If the number N is not less than 7, control proceeds to step S2104 at which the number N is fixed to 7. If the number N is smaller than 7, whether the number N is smaller than −3 is checked at S2105. If the number N is not more than −3, control proceeds to step S2106 at which the number N is fixed to be −3.

At step S2107, whether the number N is 0 is checked. If N=0, control proceeds to step S2111 at which a zero voltage is applied to the liquid crystal filters 252 and 253, so that all of the filters are transparent. Namely, in this state, the strobe light emitted from the xenon tube 251 is made incident directly upon the object SB to be photographed without being modified in the color temperature.

If the number N is not 0 at step S2107, control proceeds to step S2108, at which it is determined whether N is positive. If N is a positive value, the color temperature $K_A$of the ambient light is lower than the color temperature $K_X$ of the strobe light emitted from the xenon tube 251. Consequently, control proceeds to step S2112 at which the voltages are applied to the N amber liquid crystal filters 252 to tint or color the filters in amber to thereby lower the color temperature of the strobe light through the filters. That is, the remaining (i.e., 7−N) amber liquid crystal filters 252 are turned transparent and all the blue liquid crystal filters 253 are also turned transparent.

If N is judged to be a negative value at step S2108, the color temperature $K_A$ of the ambient light is higher than the color temperature $K_X$ of the strobe light emitted from the xenon tube 251. Consequently, control proceeds to step S2113 at which the voltages are applied to the N (absolute value) blue liquid crystal filters 253 to tint or color the filters in blue. That is, the remaining (i.e., 3−N) blue liquid crystal filters 253 and all the amber liquid crystal filters 252 are turned transparent.

At step S2114, the maximum emission time of the xenon tube 251 is determined in view of the capacitance of the main capacitor 62, etc., and set in the timer circuit 28, so that the latter commences counting the time.

Thereafter, at step S2115, an appropriate integral value of the quantity of light emitted from the xenon tube 251 through the filters 252 and 253 and reflected by the object SB, corresponding to the color temperature $K_A$ of the ambient light is read from the memory 29 and inputted to the D/A converter 26.

At step S2116, the integral value outputted from the integrating circuit 24 is reset. Thereafter, at step S2117, the integration of the operation amplifier 24*a* in the integrating circuit 24 is performed in response to the integration commencement signal S1. At the same time as the integral operation, the trigger signal S4 is outputted to he IGBT 65 at step S2118. Consequently, the IGBT 65 is turned ON. Thus, the trigger voltage is applied to the trigger electrodes of the xenon tube 251, so that the latter emits the strobe light.

The quantity of light F1 to be reflected from the object SB is increased by the emission of the strobe light. Consequently, when the integral value outputted from the integrating circuit 24 is identical to the value of signal S2 (appropriate or optimum integral value), the quenching signal S3 is outputted from the comparator 25. If the output of the quenching signal S3 is confirmed at step S2121, the issuance of the trigger signal S4 for emission is stopped at step S2123. Consequently, the emission is stopped at step S2123. Consequently, the emission of the strobe light from the xenon tube 251 is stopped. If there is no quenching signal S3 at step S2121, control proceeds to step S2122 at which it is determined whether the time set in the timer circuit 28 has expired. If the set time has not expired, control is returned to step S2121 to judge the presence of the quenching signal S3. Conversely, if the set time has expired at step S2122, the control proceeds to step S2123 to compulsively stop the output of the trigger signal S4. Thereafter, the IGBT 65 is turned OFF and the emission of the strobe light from xenon tube 251 is stopped.

Thereafter, the timer circuit 28 is deactivated at step S2124 to terminate the program shown in FIG. 40.

As can be seen from the above discussion, the conversion rate T necessary to balance the color temperature of the strobe light emitted from the xenon tube 251 with the color temperature of the ambient light is obtained, so that a predetermined number of the color filters 252 and 253 corresponding to the conversion rate T thus obtained are tinted or colored. Consequently, one emission of the strobe light by the xenon tube 251 occurs through the colored or tinted filters 252 and 253. Namely, it is not necessary to emit the strobe light twice or more from the xenon tube to obtain a predetermined color temperature of the strobe light. Consequently, since one emission takes place for one photograph, the quantity of electric charge to be discharged from the trigger condenser 66 can be minimized. Moreover, it takes less time to control the single strobe emission. The single xenon tube does not cause a deviation of the illumination areas, as in the prior art.

Figure 41:
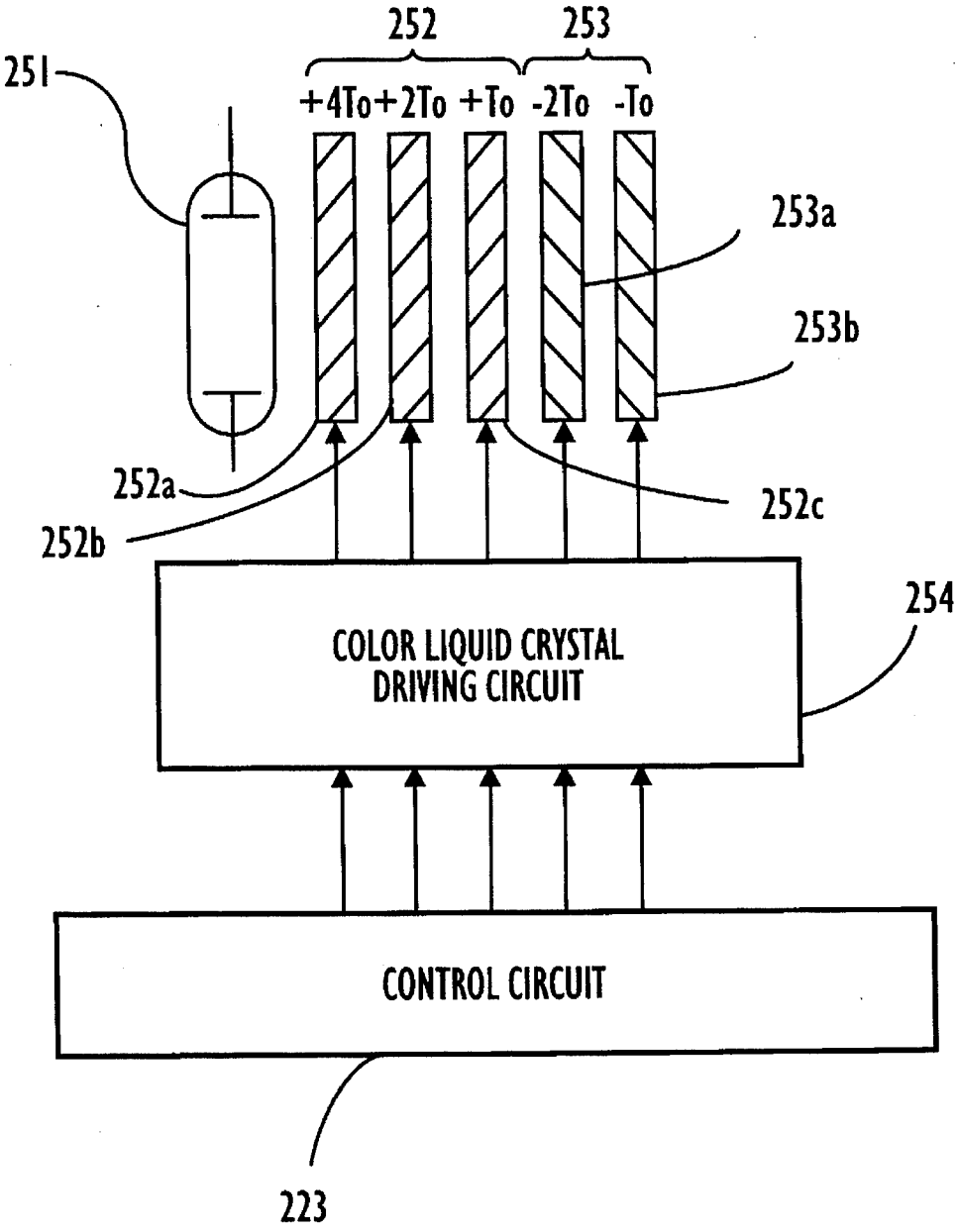
FIG. 41 is a circuit diagram of a main part of a twelfth embodiment of a strobe apparatus according to the present invention.

FIG. 41 shows the main part of a twelfth embodiment of the filter means. The elements of the strobe apparatus other than those illustrated in FIG. 41 are identical to the arrangement shown in FIG. 38.

The amber liquid crystal filters 252 comprise three filter elements 252*a*, 252*b* and 252*c*, and the blue liquid crystal filter 253 comprise two filter elements 253*a* and 253*b*, respectively. The conversion rates of the first, second and third filter elements 252*a*, 252*b* and 252*c* of the amber liquid crystal filter 252 are $4T_0$, $2T_0$, and $T_0$, respectively. The conversion rates of the first and second filter elements 253*a* and 253*b* of the blue liquid crystal filter 253 are $-2T_0$, and $-T_0$, respectively.

As can be seen from the foregoing, in the twelfth embodiment, the amber filter elements 252*a*, 252*b*, 252*c* and the blue filter elements 253*a* and 253*b* have different color temperature conversion properties or rates. For the amber liquid crystal filter 252, the three filter elements 252*a*, 252*b* and 252*c* in combination can selectively provide seven conversion rates of $T_0$, $2T_0$, $3T_0$, . . . $7T_0$. For the blue liquid crystal filter 253, the two filter elements 253*a* and 253*b* in combination can selectively provide three conversion rates of $-T_0$, $-2T_0$, and $-3T_0$.

Figure 42:
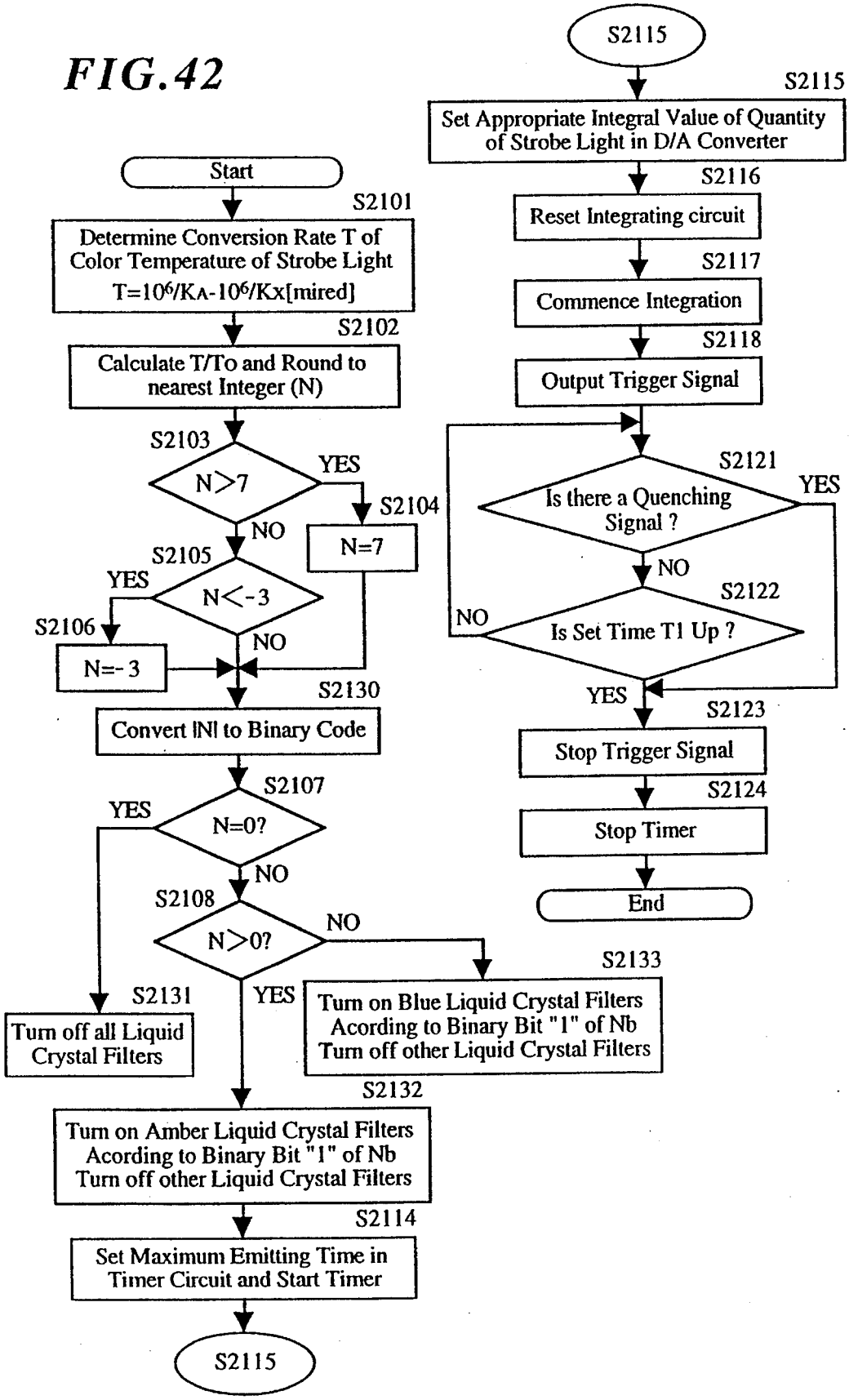
FIG. 42 is a flow chart of a strobe light emitting operation in the twelfth embodiment of the present invention.

FIG. 42 shows a flow chart of the operations of the strobe apparatus according to the twelfth embodiment. The control of filters 252 and 253 is basically identical to that in the eleventh embodiment. Accordingly, the following discussion will be directed only to a difference between the eleventh and twelfth embodiments.

After number N of the filters is limited to a value from −3 to 7 at steps S2103 through S2106, the absolute value of N of the filters is converted to a binary value Nb. For instance, when N is 5, Nb is represented by the three bits "101".

If N is 0 at step S2107 control proceeds to step S2131, at which no voltage is applied to the liquid crystal filters 252 and 253, so that the filters are turned transparent. Namely, the strobe light emitted from the xenon tube 251 is made incident directly upon the object SB without modifying the color temperature thereof by the filters 252 and 253.

If N is not 0 at step S2107, whether N is a positive value is checked at step S2108. If N is a positive value, the color temperature $K_A$ of the ambient light is lower than the color temperature of the strobe light emitted from the xenon tube 251. To reduce the color temperature of the strobe light by the filters, the voltage is selectively applied to the filter elements 252*a*, 252*b* and 252*c* corresponding to the binary bit Nb of "1" to tint or color the same with an amber color at step S2132 For example, if Nb is "101" the filter elements 252a and 252c are tinted or colored. The remaining filter element(s) and all the blue liquid crystal filter elements are transparent.

If N is a negative value at step S2108, the color temperature $K_A$ of the ambient light is higher than the color temperature of the strobe light emitted from the xenon tube 251. To increase the color temperature of the strobe light, the voltage is selectively applied to the filter elements 253a and 253b corresponding to the binary the bit Nb "1" to turn the same into a blue color at step S2133. For example, if Nb is "10", the filter element 253a is tinted or colored. The remaining filter element(s) and all the amber liquid crystal filter elements are transparent.

The operations subsequent to step S2114 are the same as those in the eleventh embodiment, and accordingly, no explanation thereof will be give below.

As can be understood from the foregoing, according to the twelfth embodiment, the number of filters through which the strobe light emitted from the xenon tube 251 is transmitted is reduced in comparison to the eleventh embodiment. Consequently, there is less attenuation of light by the filters, thus resulting in an increase in the quantity of light to be made incident upon the object SB per unit time. This reduces the emission time and the quantity of the electric charge to be discharged from the main capacitor 62. Hence, it takes less time to charge the main capacitor 62.

The present invention can be applied to a strobe apparatus in which no modulation of light by the photometer 21, the integrating circuit 24 and/or the comparing circuit 25, etc., is required.

Although the color temperature of the ambient light E1 is detected by the photometer 22 in the illustrated embodiments, it is possible to detect the color temperature of the ambient light E1 by processing the electric signals of an image obtained by the image pickup device 11.

Furthermore, the application of the present invention is not limited to a still video camera. For instance, the invention can be equally applied to a camera using a silver halide film.

As can be seen from the above discussion, according to the present invention, a strobe apparatus in which the quantity of electric charge to be discharged from a condenser is reduced, can be provided. Moreover, since the strobe control is completed by one emission of the strobe light, the strobe control requires less time to complete the operation. In addition to the foregoing, since a single xenon tube is used, there is no variation of light in the illumination area, which would otherwise occur when using two strobe lights.

Figure 43:
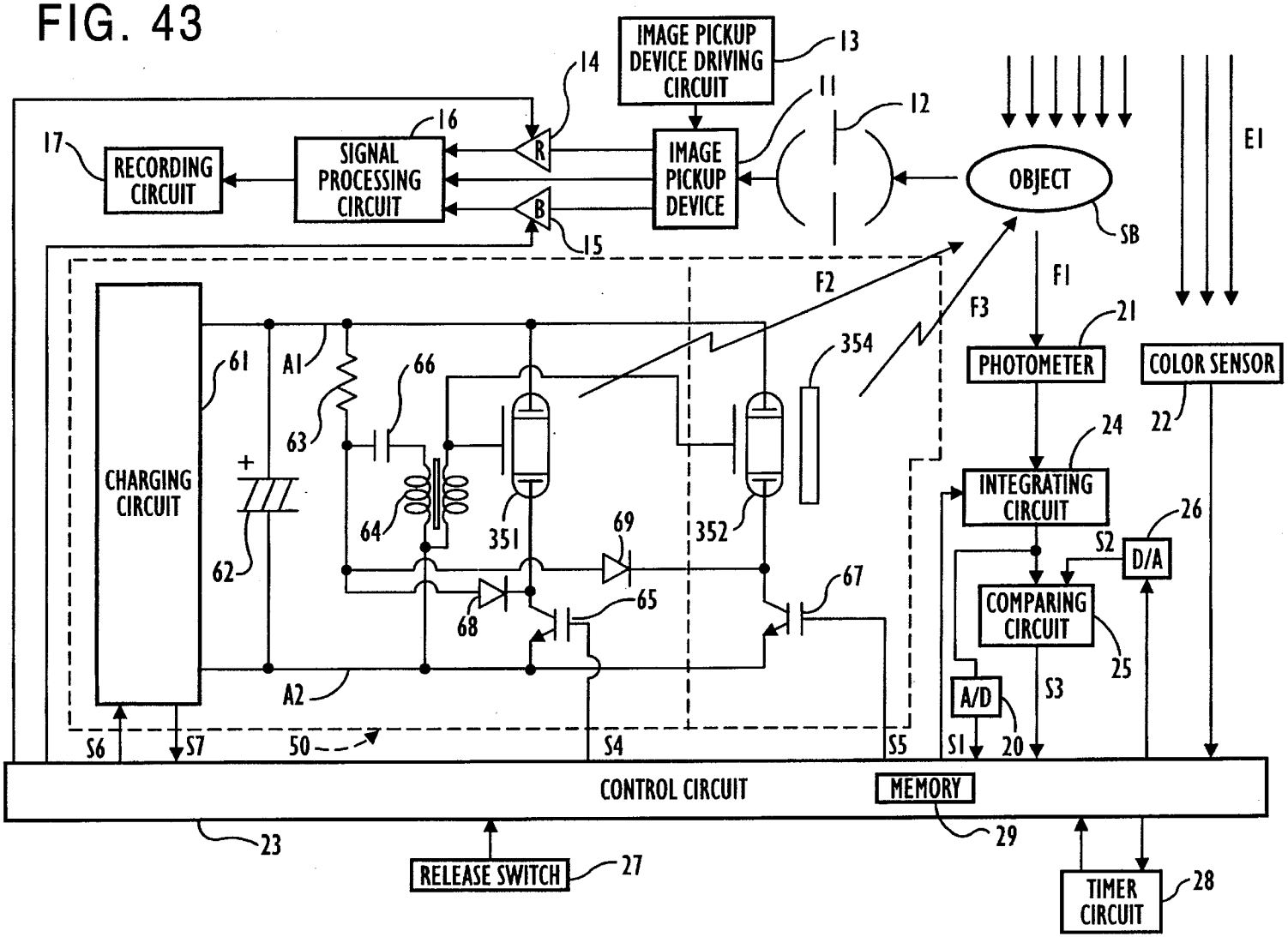
FIG. 43 is a block diagram of a still video camera to which a strobe apparatus according to a thirteenth embodiment of the present invention is applied.

FIG. 43 shows a thirteenth embodiment of the present invention. This embodiment has a detecting means for detecting a quantity of light reflected from an object to be photographed during a pre-emission of the strobe light from the xenon tube prior to a main emission of the strobe light from the xenon tube.

The integrating circuit 24 is connected to the control circuit 23 through the A/D converter 20, so that data of light reflected from the object SB to be photographed during the pre-emission can be inputted to the controller 23.

The strobe apparatus 50 has xenon tubes 351 and 352. An amber filter 354 is provided in front of the second xenon tube 352.

The cathodes of diodes 68 and 69 are connected to the cathodes of the xenon tubes 351 and 352 and the collectors of IGBTs 65 and 67, respectively. The bases of IGBTs 65 and 67 are connected to the controller 23.

Consequently, IGBTs 65 and 67 are turned ON in accordance with trigger signals S4 and S5 output from the controller 23, so that electric current flows from the collectors of IGBTs 65 and 67 to the emitter thereof. Consequently, electric charges are discharged from the trigger capacitor 66 through diodes 68 and 69. As a result, electric current flows into the low voltage coil of the trigger transformer 64, to thereby induce the trigger pulse in the high voltage coil thereof. The trigger pulse thus induced is applied to the trigger electrodes of the xenon tubes 351 and 352, so that the electric charges of the main capacitor 62 are discharged to cause the xenon tubes 351 and 352 to emit strobe lights F2 and F3.

Figure 44:
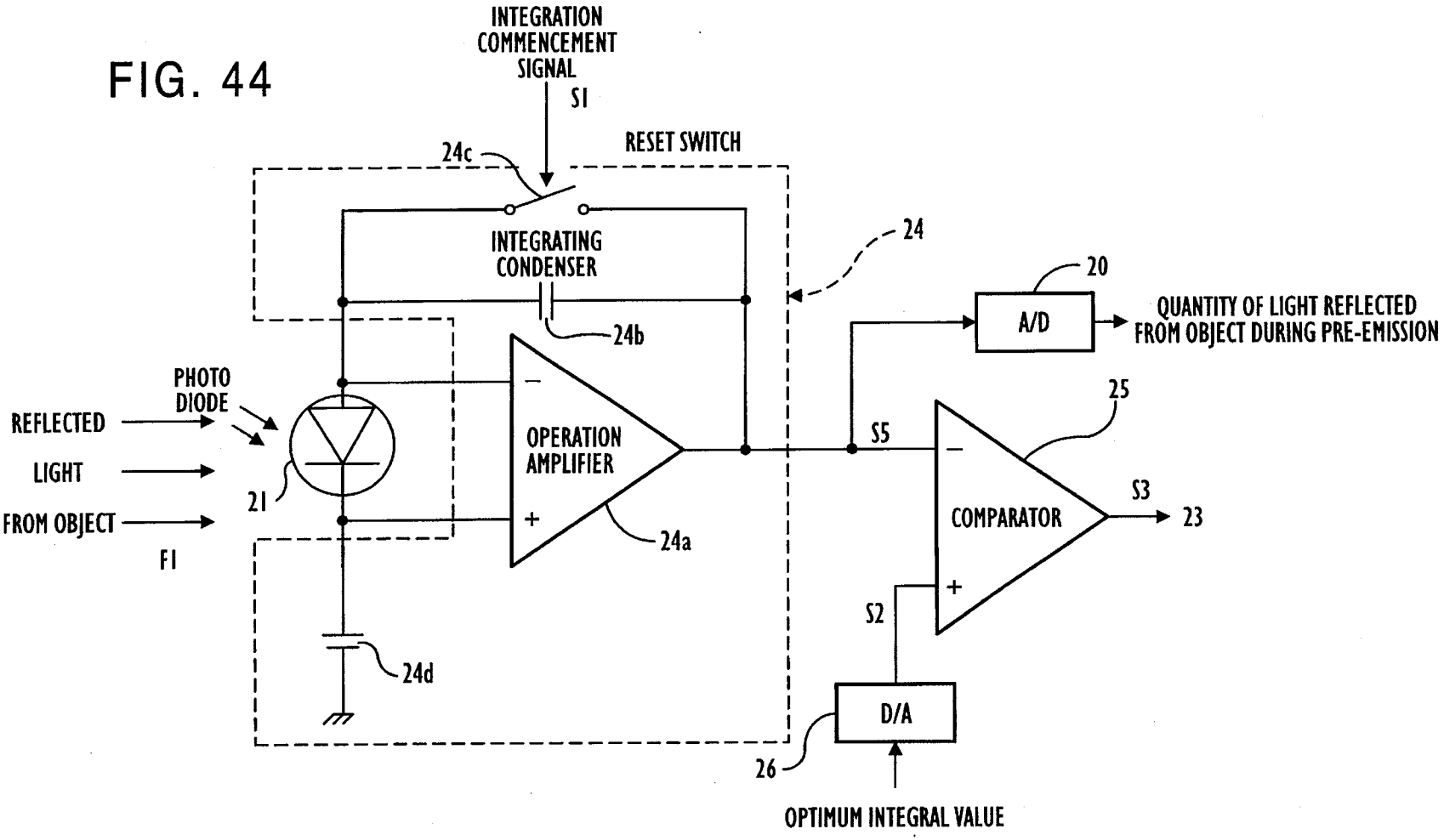
FIG. 44 is an explanatory view of a photometer, an integrating circuit and a comparing circuit, shown in FIG. 43.

FIG. 44 shows an electrical connection of the photometer 21, the integrating circuit 24, the comparator circuit 25, the D/A converter 26, and an A/D converter 20.

The output terminal of the operation amplifier 24a is connected to the inverting input terminal of comparator 25 and the A/D converter 20, which is in turn connected to the controller 23. The non-inverting input terminal of the comparator 25 is connected to the D/A converter 26. Comparator 25 compares the voltage of the output signal S2 of the D/A converter 26 with the voltage of the output signal S5 of the operation amplifier 24a. If the voltage of signal S5 is lower than the voltage of the signal S2, a quenching signal S3 is outputted from the comparator 25 to the control circuit 23. Note that the voltage of signal S2 is determined in accordance with digital data sent from the controller 23 to the D/A converter 26 in an optimum integral value setting operation which will be discussed hereinafter.

Figure 45:
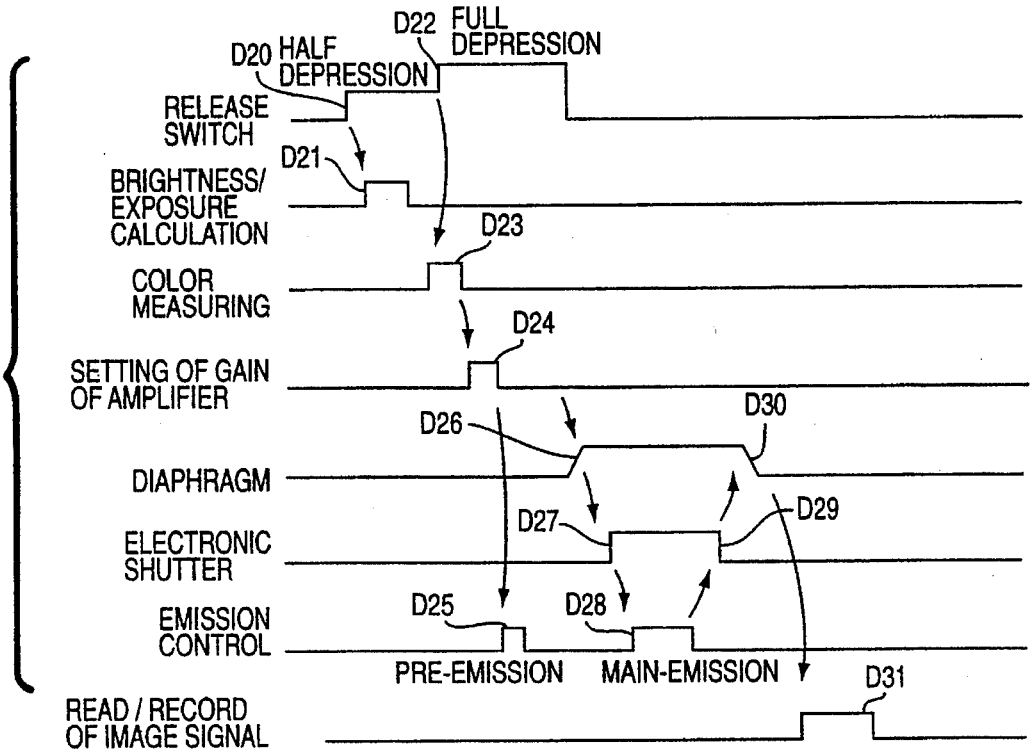
FIG. 45 is a sequence diagram of photographing operations of a still video camera shown in FIG. 43.

FIG. 45 shows a sequence diagram of the emission for the strobe light in the illustrated embodiment in FIG. 43. D21 through D24 are the same as the first embodiment illustrated in FIG. 5.

After D24, the first xenon tube 351 is activated to carry out a pre-emission. Namely, a predetermined quantity of strobe light is made incident upon the object SB, and the quantity of light reflected from the object SB is detected. Data on the quantity of the reflected light is used to correct the color temperature of the strobe light during the emission control of the xenon tubes 351 and 352 for the main exposure.

When a predetermined time has lapsed after the gain of amplifiers 14 and 15 has been set, and after the pre-emission is completed, the aperture of the diaphragm 12 is adjusted in accordance with the detection value of the photometer to thereby control the quantity of light reflected from the object SB and received by the image pickup device 11 (step D26). The time for accumulating the photoelectric signals of the image pickup device 11; i.e., the electronic shutter time is determined in accordance with the photometering data, and the accumulation of the electric charge is commenced (D27). At the same time as the commencement of the accumulation of the electric charge, the control of the strobe emission is commenced in accordance with the photometering data (step D28).

Upon completion of the photographing operation, the control circuit 23 controls the image pickup device driving circuit 13 to send a control signal to the image pickup device 11 to terminate the accumulation of the electric charge (D29) and close the diaphragm 12 (D30). Thereafter, the read control signal is outputted from the image pickup device driving circuit 13 to the image pickup device 11 to read the signal charges, such as transfer pulses, so that the signal charges accumulated in the image pickup device 11 are read as image signals and inputted to the signal processing circuit 16, where the image signals are converted to a predetermined format of image signals and recorded onto the recording medium (not shown) by the recording circuit 17 (D31).

Figure 46:
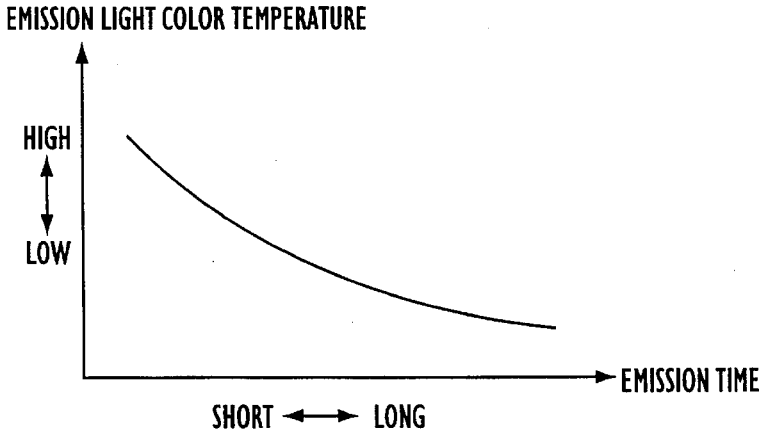
FIG. 46 is a diagram showing a relationship between an emission time of a xenon tube and a color temperature.

FIG. 46 shows a relationship between the emission time of a xenon tube and the color temperature of the strobe light emitted therefrom. As can be seen from FIG. 46, there is a tendency that the color temperature increases as the emission time decreases. Accordingly, the color temperature can be precisely controlled by the control of the emission time, as follows.

As mentioned above with reference to FIG. 45, the pre-emission is performed prior to the main emission to detect the quantity of light reflected from the object SB. Since the quantity of the reflected light in the pre-emission is in proportion to the brightness of the object, the quantity of the strobe light to be emitted in the main emission decreases as the quantity of the reflected light increases. Therefore, the color temperature of the strobe light tends to increase. In view of this, according to the illustrated embodiment, the emission time of the second xenon tube 352 provided behind the amber filter 354 increases and the emission time of the first xenon tube 351 decreases as the quantity of the reflected light in the pre-emission increases.

Figure 47:
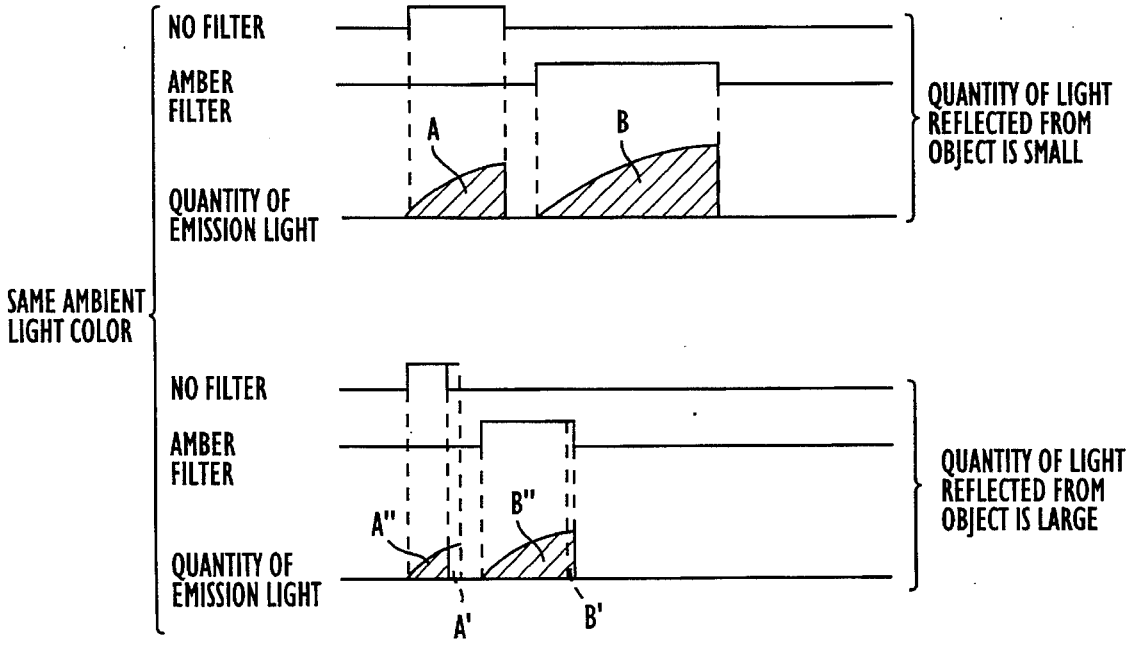
FIG. 47 is a graph showing a variation of an emission time for each xenon tube in accordance with a change in the quantity of light reflected from an object to be photographed.

FIG. 47 shows a variation of the emission time of the xenon tubes 351 and 352 depending on the change of the quantity of the light reflected from the object SB, on the assumption that the color temperature of the ambient light is constant.

It is assumed here that the quantity of the strobe light emitted from the xenon tube 351 having no filter provided in front of the same is "A" and the quantity of the strobe light emitted from the xenon tube 352 having the amber filter 354 provided in front thereof is "B", when the quantity of the light reflected from the object SB is relatively small. When the quantity of light reflected from the object SB is increased, the quantities "A" and "B" of the strobe lights to be emitted from the xenon tubes 351 and 352 are reduced to A' and B', respectively, if no correction of the color temperature by the adjustment of the emission time is carried out. The ratio A'/B' is equal to the ratio A/B. Contrary to this, according to the present invention, the quantity of the strobe light from the first xenon tube 351 is reduced to A" and the quantity of the strobe light from the second xenon tube 352 is increased to B", respectively, so that the ratio A"/B" is smaller than the ratio A/B.

The ratio A"/B" satisfies the following relationship:

$$A''+B''=A'+B'$$

The resultant color temperature of the strobe lights emitted from the first and second xenon tubes 351 and 352 is identical to the color temperature of the ambient light E1. Namely, the sum of the quantities of the strobe lights from the xenon tubes is determined in accordance with the quantity of light reflected from the object, regardless of the correction of the color temperature according to the present invention.

Figure 48:
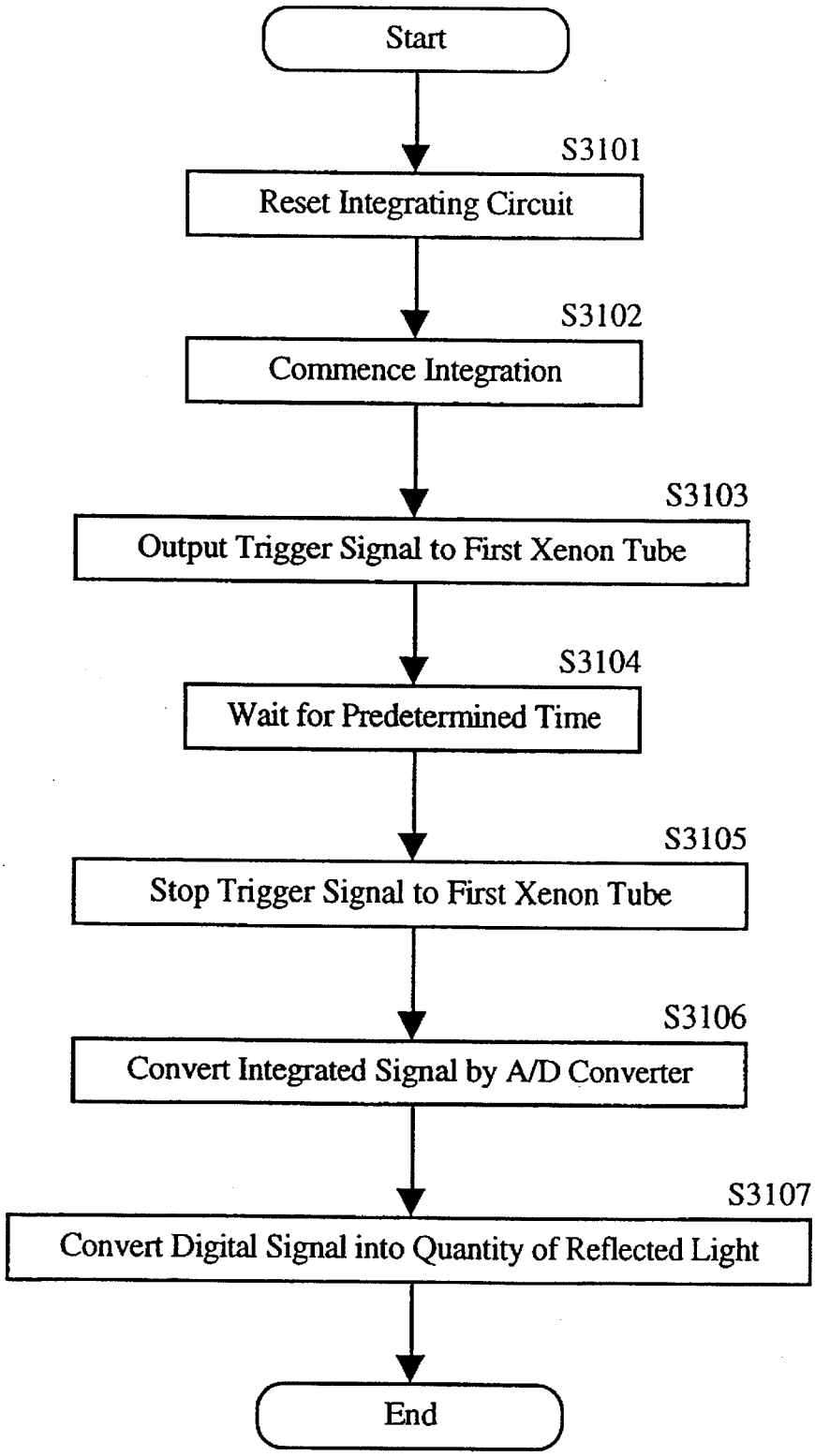
FIG. 48 is a flow chart of the control operation for a pre-emission in the thirteenth embodiment.

FIG. 48 shows a flow chart of the control operation for the pre-emission according to the thirteenth embodiment.

At step S3101, the integral value outputted from the integrating circuit 24 is reset. Thereafter, at step S3102, the integration of the operation amplifier 24*a* in the integrating circuit is performed in response to the integration commencement signal S1. At the same time as the integral operation, the trigger signal S4 is outputted to IGBT 65 at step S3103. Consequently, IGBT 65 is turned ON. Thus, the trigger voltage is applied to the trigger electrodes of the first xenon tube 351, so that the latter emits strobe light.

At step S3104, no operation is performed until the predetermined time lapses. After the lapse of the predetermined time, control proceeds to step S3105 to stop the issuance of the trigger signal S4, to thereby stop the emission by the xenon tube 351. Thus, the pre-emission is effected for a predetermined time. During the pre-emission, an electric charge corresponding to the quantity of light reflected from the object SB is accumulated in the integral capacitor 24*a* of the integrating circuit 24. At step S3106, the signal corresponding to the charge is converted to digital data by the A/D converter 20. The digital signal is converted into the quantity of reflected light at step S3107. Hence, the program ends.

As can be seen from the above discussion, in the illustrated embodiment, the first xenon tube 351 having no color temperature converting filter provided in front of the same is used to emit the strobe light for the pre-emission. Namely, only the xenon tube that can emit the largest quantity of strobe light per unit time towards the object SB, that is, only the xenon tube 351 that has the highest emission efficiency is used for the pre-emission. Consequently, data on the light reflected from the object can be easily obtained, so that the quantity of strobe light for the main emission can be precisely predicted.

Figure 49:
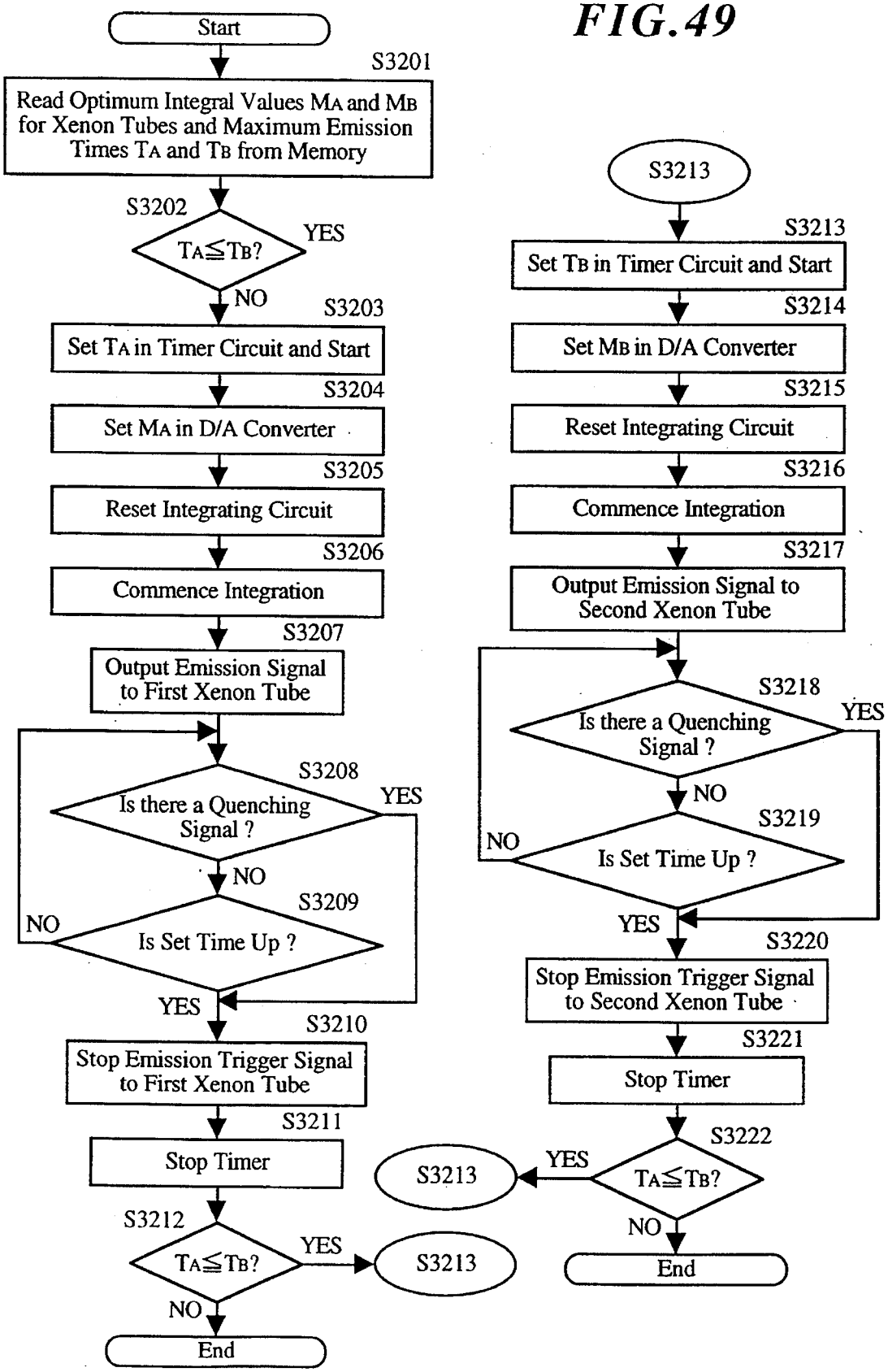
FIG. 49 is a flow chart of the control operation for a main emission in the thirteenth embodiment.

FIG. 49 shows a flow chart of the emission control (D28 in FIG. 45) for the main emission.

At step S3201, an optimum (appropriate) integral value $M_A$ and $M_B$ for each of the xenon tubes 351 and 352 and the maximum emission times $T_A$ and $T_B$ are read from the memory 29 in accordance with color temperature data of the ambient light E1 and quantity data of the reflected light from the object detected at step S3107 in FIG. 48. The maximum emission time $T_A$ refers to a maximum time in which the first xenon tube 351 can emit the strobe light, and the maximum emission time $T_B$ refers to a maximum time in which the second xenon tube 352 can emit the strobe light, respectively. As will be apparent from the discussion below, the emission is first effected by the xenon tube whose maximum emission time is shorter than the maximum emission time of the other xenon tube at step S3202. The reason that the order of the emissions is selected as mentioned above is that if the xenon tube whose maximum emission time is longer than the maximum emission time of the other xenon tube emits the strobe light first, a larger quantity of the electric charge is discharged from the main capacitor 62, thus resulting in a faster consumption of the voltage of the main capacitor 62. This makes it impossible for the remaining xenon tube to emit strobe light.

At step S3202, the maximum emission time $T_A$ of the first xenon tube 351 is compared with the maximum emission time $T_B$ of the second xenon tube 352. If $T_A$ is smaller than $T_B$, control proceeds to step S3203 (steps S3203 to S3212) to effect the emission by the first xenon tube 351 prior to the emission by the second xenon tube 352. If $T_A$ is larger than $T_B$, control proceeds to step S3213 to effect emission of strobe light by the second xenon tube 352.

At step S3203, the maximum emission time $T_A$ is set in the timer circuit 28, and the timer commences the counting operation. At step S3204, the optimum integral value $M_A$ for the color temperature of the ambient light E1 is set in the D/A converter 26.

At step S3205, the integral value output from the integrating circuit 24 is reset. Thereafter, at step S3206, the integration of the operation amplifier 24*a* in the integrating circuit 24 is performed in response to the integration commencement signal S1. At the same time as the integral operation, the trigger signal S4 is outputted to the IGBT 65 at step S3207. Consequently, the IGBT 65 is turned ON. Thus, the trigger voltage is applied to the trigger electrodes of the first xenon tube 351, so that the latter emits the strobe light F2.

Consequently, the quantity of light reflected from the object SB is increased, so that when the integral value outputted from the integrating circuit 24 reaches the value of the signal S2 (optimum or appropriate integral value), the quenching signal S3 is outputted from the comparator 25. If the issuance of the quenching signal S3 is confirmed at step S3208, control proceeds to step S3210 to stop the output of the trigger signal S4 to thereby stop the emission of the strobe light by the first xenon tube 351. If there is no quenching signal S3 at step S3208, whether the time set in the timer circuit 28 has lapsed is checked at step S3209. If the set time has not expired, control is returned to step S3208 to check the issuance of the quenching signal S3. If the set time has expired, the output of the trigger signal S4 is completely stopped at step S3210. Thereafter, IGBT 65 is turned OFF and the xenon tube 351 no longer emits the strobe light.

Thereafter, the timer circuit 28 is activated at step S3211. Thereafter, at step S3212, the maximum emission time $T_A$ of the first xenon tube 351 is compared again with the maximum emission time $T_B$ of the second xenon tube 352. It is assumed here that $T_A$ is smaller than $T_B$. Accordingly, in the illustrated embodiment, the operations at steps S3213 to S3222 are performed to cause the second xenon tube 352 to emit the strobe light. Thereafter, the program ends. Note that the operations at steps S3213 to S3222 are the same as those at steps S3203 to S3212 mentioned above, and accordingly, no detailed explanation thereof will be given herein.

Contrary to the foregoing, if the maximum emission time $T_B$ of the second xenon tube 352 is shorter than the maximum emission time $T_A$ of the first xenon tube 351, the operations at steps S3213 to S3222 are effected and thereafter, the operations at steps S3203 to S3212 are executed.

As can be seen from the foregoing, in the illustrated embodiment, since the resultant color temperature of the strobe lights emitted from the xenon tubes 351 and 352 is controlled, taking into account the change in the color temperature depending on the emission times of the xenon tubes 351 and 352, it is possible to make the resultant color temperature identical to the color temperature of the ambient light, thus a natural color of the image can be obtained. Moreover, since the detecting means for detecting the quantity of light reflected from the object SB during the pre-emission is constituted by the existing strobe modulation circuit (integrating circuit 24, comparator 25, and D/A converter 26, etc.), no substantial modification of the circuitry of the still video camera is necessary.

Figure 50:
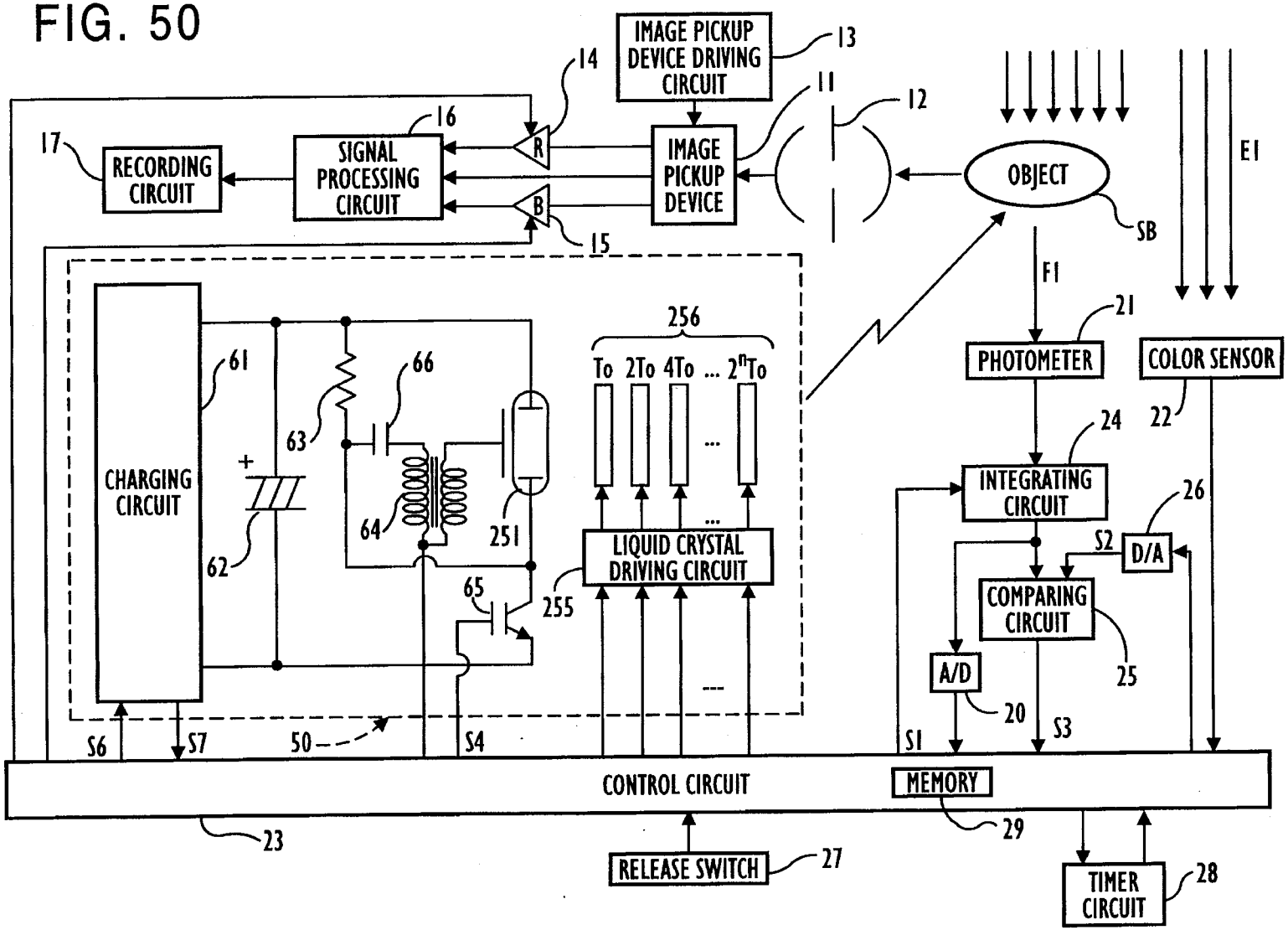
FIG. 50 is a block diagram of the still video camera to which a strobe apparatus according to the fourteenth embodiment of the present invention is applied.

FIG. 50 shows a fourteenth embodiment of the present invention. In this embodiment, there is only one xenon tube 251 and one color filter 256 provided in front of the xenon tube 251. The color filter 256 comprises a plurality of liquid crystal filter elements. The color filter 256 is driven by the liquid crystal driving circuit 255, so that the filter elements are selectively turned transparent or amber. The color temperature conversion property (degree of conversion or convertibility) of the filter elements is selected such that the filter element farthest from the xenon tube 251 has the highest degree of conversion and the degree of conversion is reduced toward the filter element closest to the xenon tube 251. Namely, if the color temperature of the strobe light transmitted through the first filter element closest to the xenon tube 251 is $T_0$, the color temperature of the strobe light transmitted through the second filter element adjacent thereto is $2T_0$, the color temperature of the strobe light transmitted through the third filter element adjacent to the second filter element is $4T_0$. Namely, the degree of conversion is increased by $2^n$ toward the n-th filter element farthest from the xenon tube 351. The color temperature of the strobe light transmitted through the n-th filter element is $2^nT_0$. Consequently, the resultant color temperature of the strobe light can be linearly selected from the consecutive values of $T_0$, $2T_0$, $3T_0$, . . . $nT_0$ by appropriately combining the filter elements to be used.

Other structure of the fourteenth embodiment shown in FIG. 50 is identical to that of the thirteenth embodiment shown in FIG. 43.

Figure 51:
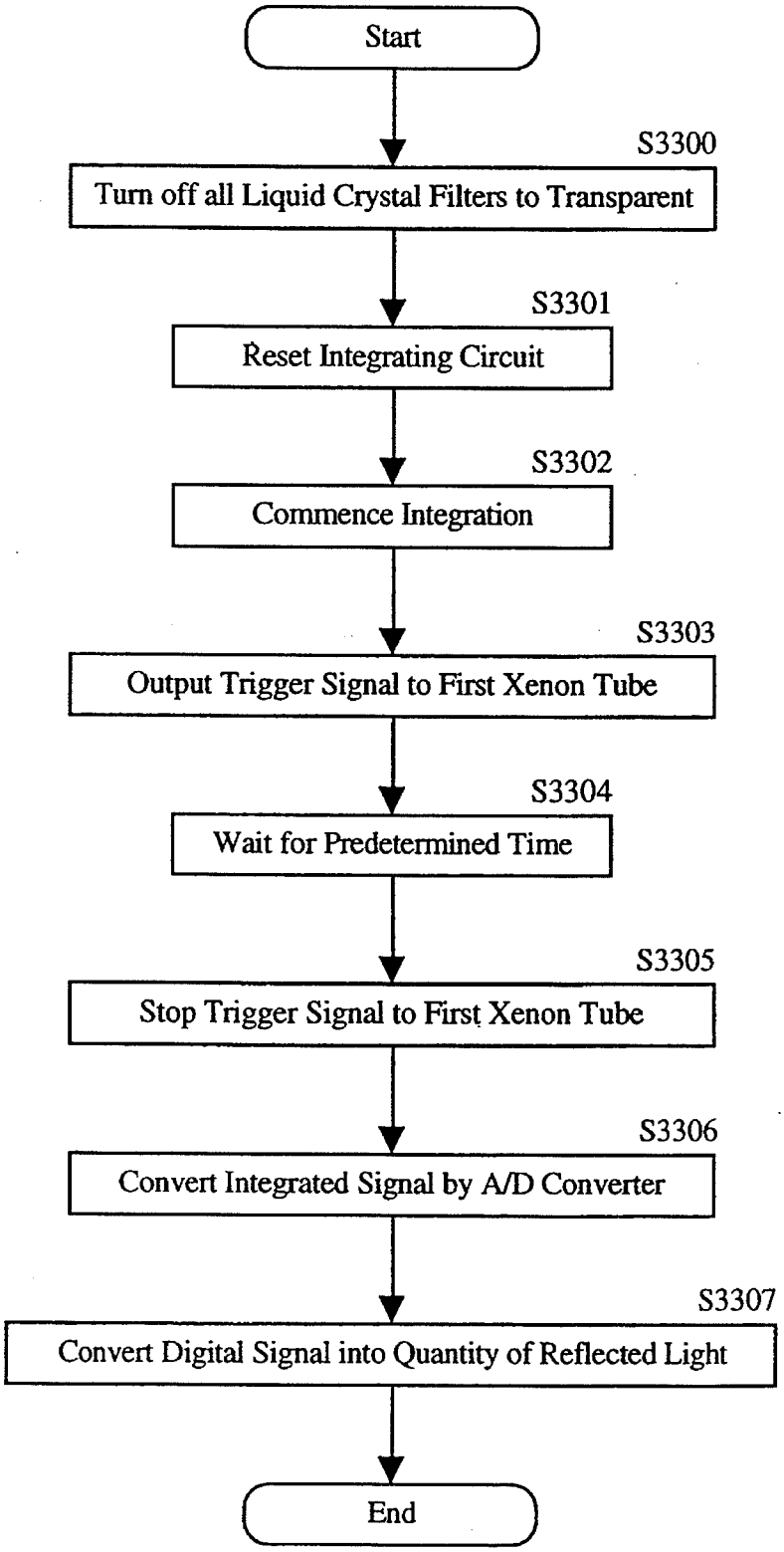
FIG. 51 is a flow chart of a control operation for a pre-emission in the fourteenth embodiment.
Figure 52:
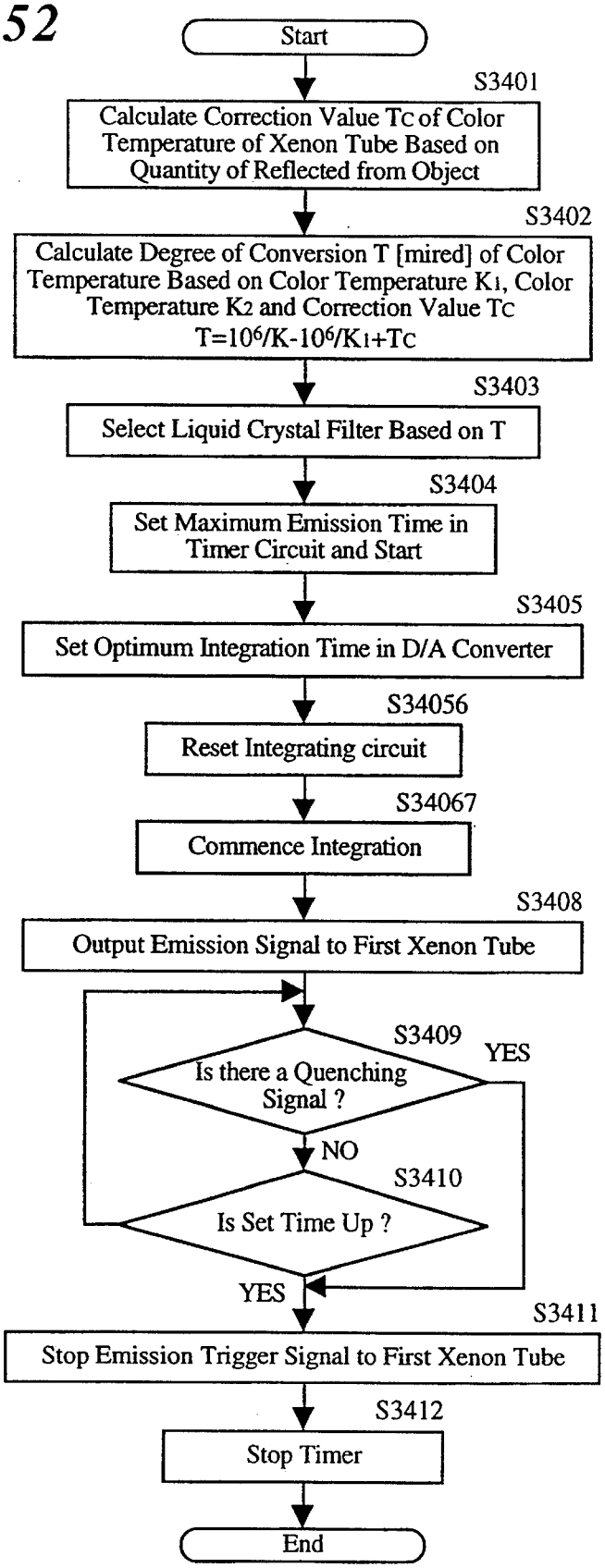
FIG. 52 is a flow chart of a control operation for a main emission in the fourteenth embodiment.

FIG. 51 shows a flow chart of the pre-emission control in the fourteenth embodiment.

At step S3300, all of the liquid crystal filter elements of the color filter 356 are turned transparent. Namely, in this state, the pre-emission is effected. The quantity of light reflected from the object SB during the pre-emission is detected. The operations at steps S3301 to S3307 are identical to those at steps S3101 to S3107 mentioned above, and accordingly, no explanation therefor is given herein.

FIG. 51 shows a flow chart of the control operation for the main emission in an arrangement according to the fourteenth embodiment.

At step S3401, the correction value Tc (mired) of the color temperature of the xenon tube 351 is calculated based on the quantity of light reflected S from the object SB, detected in the pre-emission. Namely, the correction value is given as:

$$T_c = k \cdot S \ (k>0) \tag{3}$$

Where k is a coefficient of proportionality.

As can be seen from the equation above, the correction value is in proportion to the quantity of the reflected light.

In the fourteenth embodiment, the amber liquid crystal filter is provided in front of the xenon tube 251 so that the color temperature of the strobe light emitted from the xenon tube 251 can be reduced. Moreover, the color temperature of the strobe light increases as the emission time of the xenon tube 251 decreases. Consequently, the degree of correction of the color temperature must be increased in the direction to decrease (i.e., the direction to increase the degree of conversion of the color temperature) as the quantity of the reflected light (i.e., as the emission time of the xenon tube 251 decreases). Namely, the degree of conversion T (mired) of the color temperature is calculated based on the color temperature $K_1$ when the strobe light is fully emitted from the xenon tube 251 without using the color filter, the color temperature $K_2$ of the ambient light, and the correction value $T_C$ of the color temperature, using the following equation:

$$T = 10^6/K_2 - 10^6/K_1 + T_C \tag{4}$$

At step S3403, the liquid crystal filter elements are selected in accordance with the degree of conversion T thus obtained. For instance, when the degree of conversion T is about $5T_0$, the liquid crystal filter elements having the degrees of conversion of $T_0$ and $4T_0$ are selected.

At step S3404, the maximum emission time of the xenon tube 251 is set in the timer circuit 28, so that the timer circuit commences the time counting operation. The operations at steps S3405 to S3412 are identical to those at steps S3204 to S3211.

The same technical effects as those in the thirteenth embodiment can be expected in the fourteenth embodiment.

In the fourteenth embodiment, although the amber liquid crystal filter is provided in front of the xenon tube 251, it is possible to additionally provide a blue liquid crystal filter in front of the xenon tube 251. In this alternative, equation (4)

mentioned above can be used, provided that the degree of conversion T is a negative value or a positive value, the blue liquid crystal filter or the amber liquid crystal filter is selectively used, respectively.

Although the color temperature of the ambient light E1 is detected by the photometer 21 in the illustrated embodiments, it is possible to detect the color temperature of the ambient light by processing the image signal obtained from the image pickup device 11.

The present invention is not limited to a still video camera and can be applied to, for example, a camera using a halide film.

As can be understood from the above discussion, according to the present invention, the color temperature of the strobe light can be precisely controlled, independently of the emission time of the light emitting tube.

Figure 53:
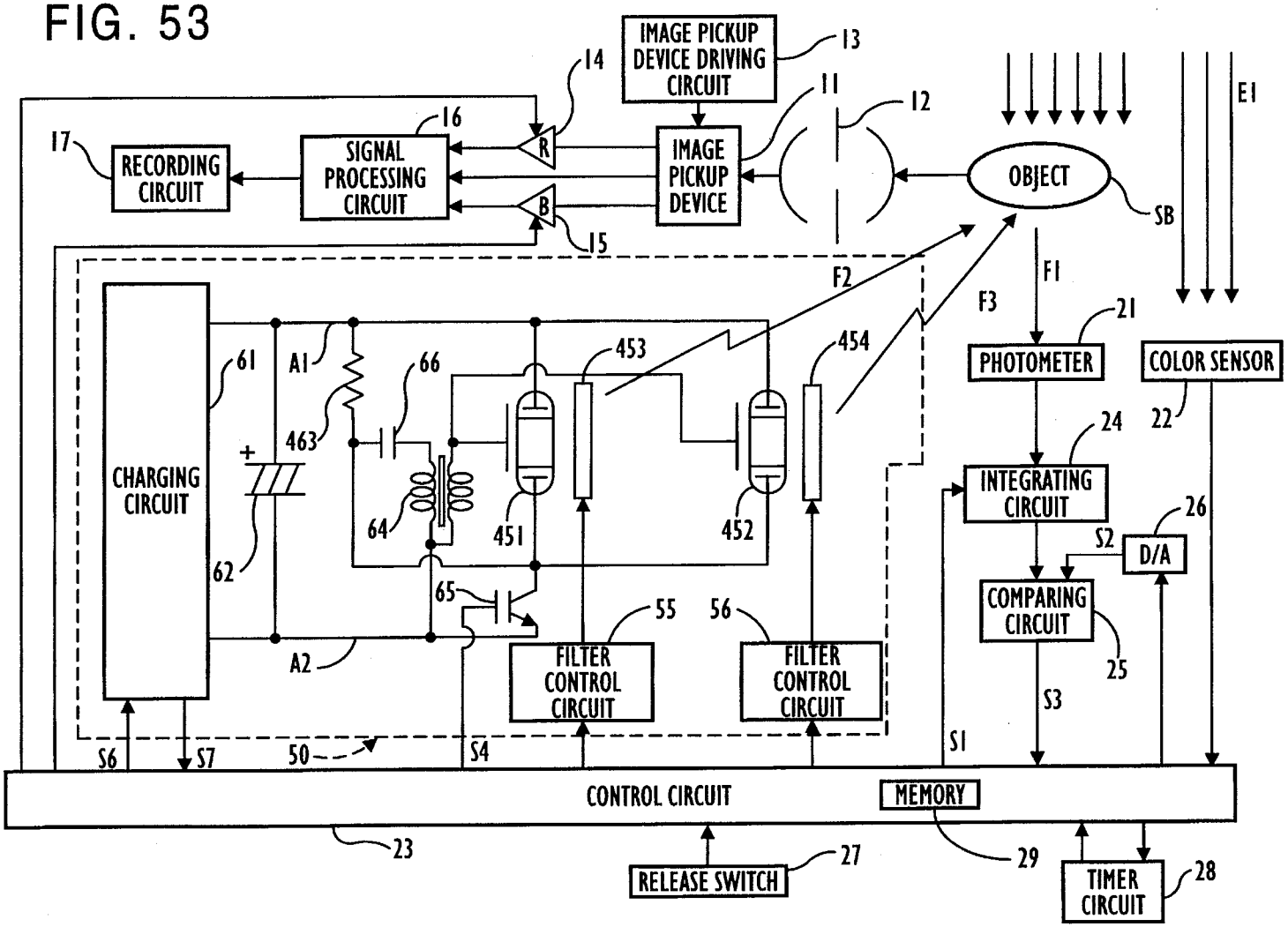
FIG. 53 is a circuit diagram of a still video camera to which a strobe apparatus according to the fifteenth embodiment of the present invention is applied.

FIG. 53 shows a fifteenth embodiment of the present invention. In this embodiment, the strobe apparatus 50 includes first and second xenon tube 451 and 452, with filters 453 and 454, respectively.

Figure 54:
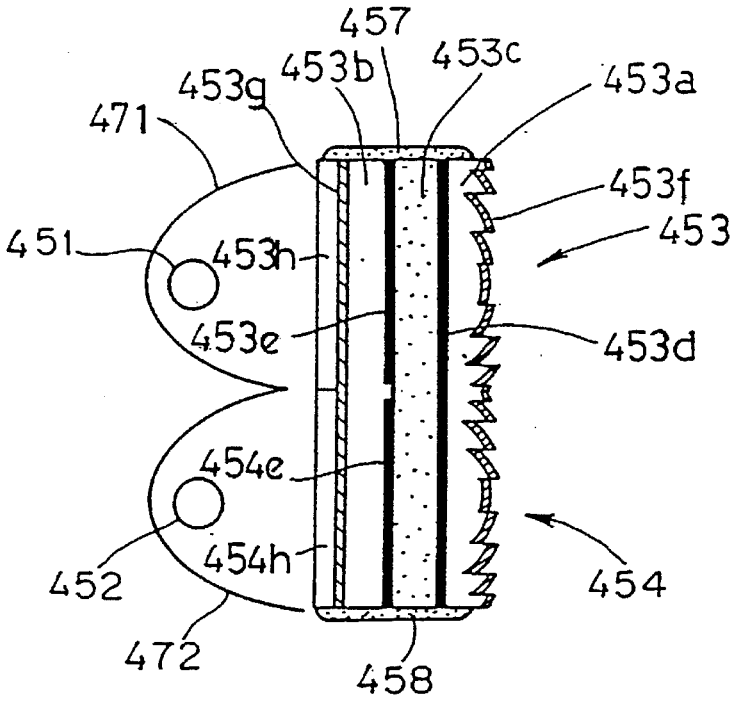
FIG. 54 is a schematic view of the xenon tubes, first and second filters in the fifteenth embodiment.

FIG. 54 schematically shows an internal structure of the first and second filters 453 and 454. The first and second filters 453 and 454 which are integral are comprised of two transparent substrates 453*a* and 453*b* and a monochrome liquid crystal 453*c* enclosed between the transparent substrates 453*a* and 453*b*. The transparent substrate 453*a* is provided on the inner surface thereof with a transparent electrode 453*d* which lies on the filters 453 and 454 to constitute a common electrode to both the filters 453 and 454. The other transparent substrate 453*b* is provided on the inner surface thereof with two transparent electrodes 453*e* and 454*e* for the first and second filters 453 and 454, respectively. Namely, the density of the first filter 453 is determined in accordance with the voltage between the transparent electrodes 453*e* and 453*d*, and the density of the second filter 454 is determined in accordance with the voltage between the transparent electrodes 454*e* and 453*d*, respectively.

The outer surface of the transparent substrate 453*a* is in the form of a Fresnel lens, that is, the transparent substrate 453*a* constitutes a Fresnel lens. The Fresnel lens surface is provided with a polarizing film 453*f* adhered thereto. The transparent substrate 453*b* is provided on the outer surface thereof with a planar polarizing film 453*g*. The polarizing film 453*f* is provided on the surface thereof adjacent to the xenon tube 451 with a blue filter 453*h* and on the surface adjacent to the xenon tube 452 with an amber filter 454*h*, respectively.

The transparent substrates 453*a* and 453*b* are each made of a glass plate. The ends of the transparent substrates 453*a* and 453*b* are connected to the corresponding ends of the filters 453*h* and 454*h* by epoxy resin adhesives 457 and 458, respectively.

The xenon tubes 451 and 452 extend in parallel. There are reflectors 71 and 72 behind the respective xenon tubes 451 and 452 to surround the same.

The monochrome liquid crystal 453*c* is in the form of a TN liquid crystal whose density varies in accordance with the voltage applied between the electrodes. Consequently, when the densities of the portions of the liquid crystal 453*c* corresponding to the filters 453 and 454 are determined to be predetermined values, if the xenon tubes 451 and 452 are activated to emit strobed light, the composite color temperature of strobe lights F2 and F3 is controlled, so that the resultant strobe light whose color temperature is substantially identical to the color temperature of the ambient light E1 can be obtained to thereby prevent an unnatural color of the photographed object image from being reproduced. Moreover, the Fresnel lenses provided in front of the xenon tubes 451 and 452 ensure that strobe lights F2 and F3 are emitted toward the object SB to be photographed.

Instead of the filters 453 and 454 which are integrally formed, as shown in FIG. 54, it is possible to connect separate filters 453 and 454.

Alternatively, the monochrome liquid crystal 453*c* can be replaced with guest-host type blue and amber liquid crystals. In this alternative, the blue filter 453*h* and the amber filter 454*h* can be dispensed with. Moreover, in this alternative, it is necessary to provide a separator to isolate the blue liquid crystal and the amber liquid crystal from one another and to independently actuate the xenon tubes 451 and 452 to independently emit strobe lights.

Figure 55:
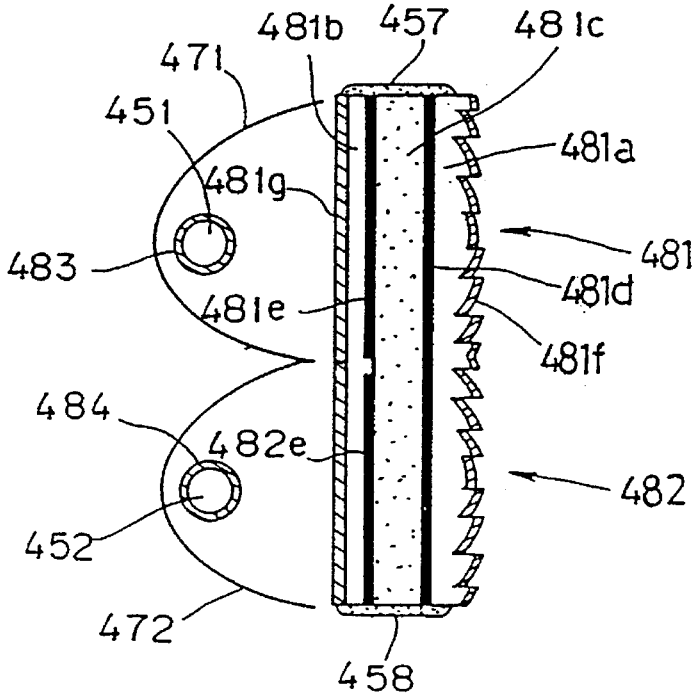
FIG. 55 is a schematic view of the xenon tubes and first and second liquid crystal cells according to a sixteenth embodiment of the present invention.

FIG. 55 shows a sixteenth embodiment of the strobe apparatus. In the fifteenth embodiment, there are first and second liquid crystal—cells 481 and 482 in front of the xenon tubes 451 and 452. The xenon tubes 451 and 452 are respectively coated with blue and amber filters 483 and 484. The circuit structure of the second embodiment is identical to that of the first embodiment.

The monochrome liquid crystal 481*c* is enclosed between the two transparent substrates 481*a* and 481*b*. The transparent substrate 481*a* is provided on the inner surface thereof with a transparent electrode 481*d* common to both the filters 483 and 484. The other transparent substrate 481*b* is provided on the inner surface thereof with two transparent electrodes 481*e* and 482*e* for the first and second filters 483 and 484, respectively. The outer surface of the transparent substrate 481*a* is in the form of a Fresnel lens. The Fresnel lens surface is provided with a polarizing film 481*f* adhered thereto. The transparent substrate 481*b* is provided on the outer surface thereof with a planar polarizing film 481*g*.

The monochrome liquid crystal 481*c* is in the form of a TN liquid crystal whose density varies in accordance with the voltage applied between the electrodes. The operation of the liquid crystal 481*c* is the same as that of the first embodiment, and accordingly, no detailed explanation therefor is given herein.

Figure 56:
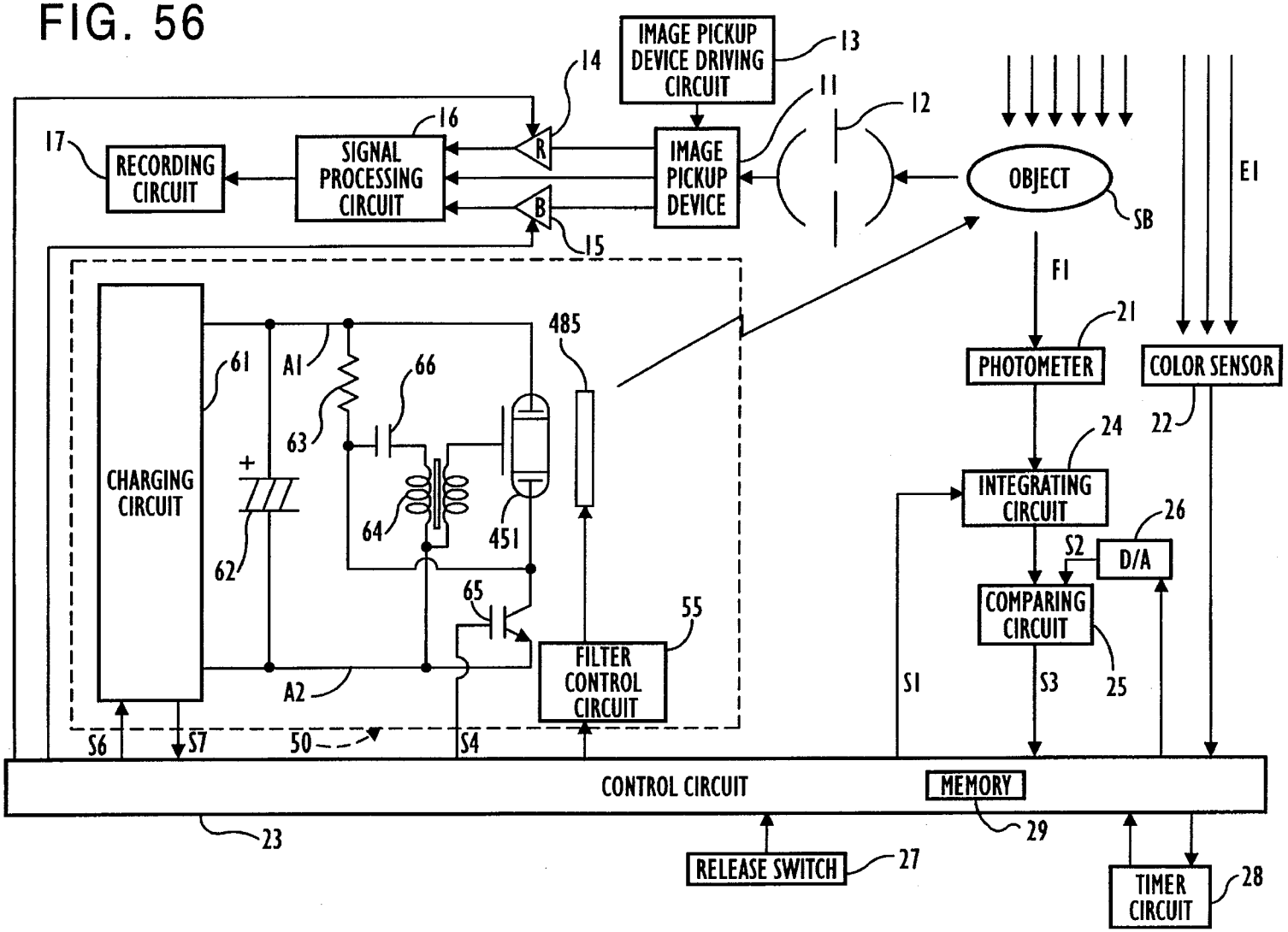
FIG. 56 is a circuit diagram of a still video camera to which a strobe apparatus according to a seventeenth embodiment of the present invention is applied.

FIG. 56 shows a block diagram of a still video camera to which a strobe apparatus according to a seventeenth embodiment is applied.

In the seventeenth embodiment, there is one xenon tube 451 and one filter 485. Other circuit structure of this embodiment is the same as the fifteenth and sixteenth embodiments.

Figure 57:
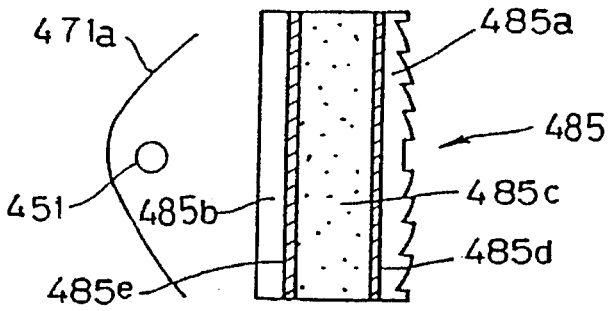
FIG. 57 is a schematic view of a filter according to the seventeenth embodiment.

FIG. 57 shows the filter 485 in the seventeenth embodiment. The filter 485 is made of two transparent glass (or plastic) substrates 485*a* and 485*b* and a White Taylor type guest-host liquid crystal 485*c* enclosed therebetween. The transparent substrates 485*a* and 485*b* are respectively provided on the inner surfaces thereof with transparent electrodes 485*d* and 485*e*. The transparent substrate 485*a* constitutes a Fresnel lens.

The guest-host liquid crystal 485*c* used in the seventeenth embodiment is colored with a predetermined color, when no voltage is applied between the electrodes 485*d* and 485*e*. Conversely, when the voltage is applied between the electrodes 485*d* and 485*e*, the liquid crystal 485*c* becomes transparent. Consequently, the color temperature of the strobe light can be controlled to be substantially identical to the color temperature of the ambient light E1 by the successive emission of the strobe light in the colored state and transparent state of the filter 485, to thereby obtain the same technical effects as the first and second embodiments.

Figure 58:
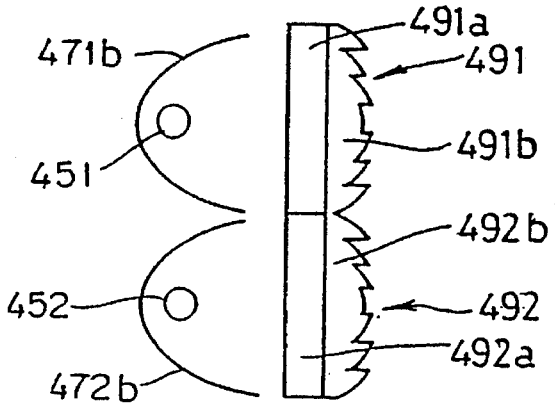
FIG. 58 is a schematic view of a filter according to an eighteenth embodiment; and, FIG. 59 is a schematic view of a filter according to a nineteenth embodiment.

FIG. 58 shows an eighteenth embodiment of the present invention, in which first and second filters 491 and 492 are provided in front of xenon tubes 451 and 452. The first filter 491 is made of a plastic plate consisting of a planar blue filter 491*a* and a Fresnel lens 491*b* provided on the surface of the blue filter 491*a*. The second filter 492 is similar in construction to the first filter 491, i.e., it comprises a planar amber filter 492*a* and a Fresnel lens 492*b*.

Unlike the liquid crystal, filters 491 and 492 need no circuit to control the color or density of the filter. Namely, in the eighteenth embodiment, control of the color temperature of the strobe light is carried out by the independent control of the emission time of the xenon tubes 451 and 452.

Figure 59:
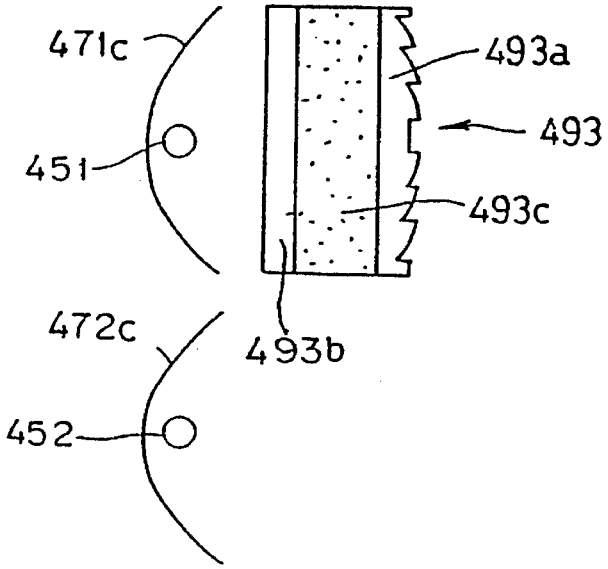

FIG. 59 shows a nineteenth embodiment of the present invention, in which one filter 493 is provided in front of the first xenon tube 451, and no filter is provided in front of the second xenon tube 452. The filter 493 comprises two transparent glass (or plastic) substrates 493*a* and 493*b* and a White Taylor type guest-host liquid crystal 493*c* enclosed therebetween. The transparent substrate 493*a* constitutes a Fresnel lens. Unlike the seventeenth embodiment, there is no transparent electrode on the inner surfaces of the transparent substrates 493*a* and 493*b*. Namely, the filter 493 is continuously in a colored state, and accordingly, the control of the color temperature of the strobe light is carried out by successively emitting the strobe light from the xenon tubes 451 and 452 for a predetermined time.

In the nineteenth embodiment, it is possible to provide filters in front of the xenon tubes 451 and 452, respectively.

The color temperature conversion filters are not limited to those in the above mentioned embodiments.

As can be seen from the above discussion, according to the present invention, strobe light whose color temperature is balanced with that of ambient light is emitted towards an object to be photographed, so that an object image to be formed has a natural color.

I claim:

1. A strobe apparatus having light emitting means which emits a strobe light and a color temperature converting means for varying a color temperature of the strobe light emitted from the light emitting means comprising:

first color temperature detecting means for detecting a color temperature of said strobe light after being reflected from an object;

second color temperature detecting means for detecting a color temperature of ambient light reflected from said object; and, color temperature control means for controlling said color temperature of said strobe light in accordance with said color temperature of said strobe light detected by said first color temperature detecting means, so that said color temperature of said strobe light incident upon said object to be photographed is substantially identical to said color temperature of said ambient light detected by said second color temperature.

2. A strobe apparatus according to claim 1, wherein said first color temperature detecting means and said second color temperature detecting means comprise a same color temperature sensor.

3. A strobe apparatus according to claim 2, wherein said light emitting means comprises: a plurality of light emitting tubes, and quantity control means for controlling a quantity of light emitted from each said light emitting tube; wherein said color temperature converting means further comprise means to vary a color temperature of each said light emitting tube; and wherein said quantity control means further controls the resultant color temperature of said strobe light.

4. A strobe apparatus according to claim 3, wherein said quantity control means controls each varied color temperature light from each said light emitting tube to be incident upon said object to be photographed.

5. A strobe apparatus according to claim 2, said light emitting means comprising a single light emitting tube, said color temperature control means controls said color temperature of said strobe light emitted from said single light emitting tube to control said color temperature of said strobe light incident upon said object to be photographed.

6. A strobe apparatus according to claim 1, said light emitting means comprising a plurality of light emitting tubes, said color temperature converting means further comprises means to vary said color temperature of said strobe light emitted from said plurality of light emitting tubes, and said color temperature control means independently controls an emission time of said emitted strobe light from said plurality of light emitting tubes to control said resultant color temperature thereof.

7. A strobe apparatus according to claim 1, said light emitting means comprising a single light emitting tube, said color temperature converting means converts said color temperature to a plurality of color temperatures during said emission of said strobe light by said single light emitting tube, and said color temperature control means independently controls a converting time, and a color temperature, of said plurality of color temperatures to control said color temperature of said strobe light incident upon said object to be photographed.

8. A strobe apparatus according to claim 1, wherein said first color temperature detecting means detects said color temperature of said strobe light before an exposure occurs.

9. A strobe apparatus according to claim 8, wherein said light emitting means emits a pre-emission to light before exposure eliminate a red-eye phenomenon.

10. A strobe apparatus according to claim 9, wherein said first color temperature detecting means detects a color temperature of said strobe light during said pre-emission to eliminate a red-eye phenomenon.

11. The strobe apparatus according to claim 1, said first color temperature detecting means detecting color temperature of said strobe light during an emission of said strobe light.

12. A strobe apparatus having light emitting means for emitting strobe light, said apparatus comprising:

first color temperature detecting means for detecting a color temperature of strobe light incident upon an object to be photographed and a color temperature of light reflected from said object during the emission of the strobe light;

second color temperature detecting means for detecting a color temperature of ambient light incident on said object; and, color temperature control means for controlling a color temperature of strobe light in accordance with the color temperature of said strobe light detected by said first color temperature detecting means, so that said color temperature of said strobe light incident upon said object is substantially identical to said color temperature of said ambient light.

13. A strobe apparatus having a light emitting apparatus which emits a strobe light comprising:

first color temperature control means for controlling a color temperature of said strobe light emitted from said light emitting apparatus between a first upper limit of said color temperature and a first lower limit of said color temperature;

second color temperature control means for controlling said color temperature of said strobe light emitted from said light emitting apparatus between a second upper limit of said color temperature, substantially the same as said first lower limit of said color temperature, and a second lower limit of said color temperature;

color temperature detecting means for detecting a color temperature of ambient light reflected from an object; and composite color temperature control means for controlling a plurality of values of said color temperature to be determined by said first and second color temperature control means in accordance with said color temperature of said ambient light, and for adjusting a quantity of said strobe light to be emitted from said light emitting apparatus, so that a resulting color temperature of said strobe light obtained through said color temperature control means is substantially identical to said color temperature of said ambient light.

14. A strobe apparatus according to claim 13, wherein said first lower limit of said color temperature and said second upper limit of said color temperature are selected to be a value substantially the same as said strobe light color temperature emitted from said light emitting tube.

15. A strobe apparatus according to claim 13, wherein a difference between reciprocals of said first upper limit of said color temperature and said first lower limit of said color temperature is substantially identical to a difference between reciprocals of said second upper limit of said color temperature and said second lower limit of said color temperature.

16. A strobe apparatus according to claim 13, wherein said first color temperature control means and said second color temperature control means comprise a plate filter including an amber filter portion, a blue filter portion and a transparent portion.

17. A strobe apparatus according to claim 16, further comprising, a driving mechanism to move said plate filter to locate said amber filter portion, said blue filter portion and said transparent portion separately in front of said light emitting tube, when said light emitting tube is emitting light.

18. A strobe apparatus according to claim 13, wherein said light emitting apparatus comprises a first and a second xenon tube, a monochrome liquid crystal filter and a blue liquid crystal filter in front of said first xenon tube, an amber liquid crystal filter and a monochrome liquid crystal filter in front of said second xenon tube.

19. A strobe apparatus according to claim 18, each of said liquid crystal filters are controlled by said composite color temperature control means through liquid crystal control means.

20. A strobe apparatus having a single light emitting tube which emits a strobe light and a color temperature detecting means for detecting a color temperature of ambient light reflected from an object comprising:

a plurality of filters which are provided in front of said light emitting tube such that said filters are parallel and in line with each other so that light emitted from said light emitting tube travels through all of said filters sequentially to vary said color temperature of said strobe light emitted from said light emitting tube; and color temperature control means for controlling specific ones of said plurality of filters to vary a color temperature thereof in accordance with said color temperature of said ambient light, so that a color temperature of said strobe light after being transmitted through said specific ones of said plurality of filters is substantially identical to said color temperature of said ambient light.

21. A strobe apparatus according to claim 20, said filters comprising a plurality of amber liquid crystal filters which have a same color temperature conversion property and which can be selectively transparent or amber.

22. A strobe apparatus according to claim 20, said filters comprising a plurality of blue liquid crystal filters which have a substantially same color temperature converting property and which can be selectively transparent or blue.

23. A strobe apparatus according to claim 20, said filters comprising a plurality of amber liquid crystal filters which have a substantially same color temperature converting property and which can be selectively transparent or amber, and an a plurality of blue liquid crystal filters which have a substantially same color temperature converting property and which can be selectively transparent or blue.

24. A strobe apparatus according to claim 20, said filters comprising a plurality of amber liquid crystal filters which have different color temperature converting properties and which can be selectively transparent or amber.

25. A strobe apparatus according to claim 20, said filters comprising a plurality of blue liquid crystal filters which have different color temperature converting properties and which can be selectively transparent or blue.

26. A strobe apparatus according to claim 20, said filters comprising a plurality of amber liquid crystal filters which have different color temperature converting properties and which can be selectively transparent or amber, and a plurality of blue liquid crystal filters which have different color temperature converting properties and which can be selectively transparent or blue.

27. A strobe apparatus having a light emitting tube which emits a strobe light and a color temperature converting means provided in front of said light emitting tube for varying said color temperature of said strobe light emitted from said light emitting tube, said apparatus comprising:

detecting means for detecting a quantity of light reflected from an object to be photographed during a pre-emission of said strobe light from said light emitting tube prior to a main emission of said strobe light from said light emitting tube;

color temperature detecting means for detecting a color temperature of ambient light reflected from an object; and, color temperature controlling means for controlling said color temperature converting means, so that said color temperature of said strobe light in said main emission is substantially identical to said color temperature of said ambient light, in accordance with said detected quantity of light reflected from said object and said detected color temperature of said ambient light.

28. A strobe apparatus according to claim 27, wherein said color temperature controlling means controls said color temperature converting means, so that the color temperature of said strobe light decreases as said quantity of said reflected light increases.

29. A strobe apparatus according to claim 27, further comprising a plurality of light emitting tubes, a particular light emitting tube of said plurality emitting a largest quantity of light per unit time toward said object to be photographed is used for said pre-emission.

30. A strobe apparatus according to claim 27, further comprising first and second light emitting tubes, said first light emitting tube has no filter and said second light emitting tube has a filter to vary a color temperature of said strobe light emitted from said second light emitting tube.

31. A strobe apparatus according to claim 30, wherein said first light emitting tube is used for said pre-emission.

32. A strobe apparatus according to claim 27, wherein said light emitting tube has a plurality of filters, provided in front of said light emitting tube, to vary a color temperature of said strobe light emitted from said light emitting tube.

33. A strobe apparatus according to claim 31, said filters comprising a plurality of amber liquid crystal filters which have different color temperature converting properties and which can be selectively transparent or amber.

34. A strobe apparatus according to claim 32, said filters comprising a plurality of blue liquid crystal filters which have different color temperature converting properties and which can be selectively transparent or blue.

35. A strobe apparatus having light emitting means which emit a strobe light toward an object to be photographed, said apparatus comprising;

color temperature detecting means for detecting a color temperature of ambient light reflected from the object;

a color temperature conversion filter which varies a color temperature of said strobe light in accordance with said color temperature detected by said color temperature detecting means; and a Fresnel lens provided on a surface of said color temperature conversion filter.

36. A strobe apparatus according to claim 35, wherein said color temperature conversion filter is provided with a liquid crystal having a substrate on which said Fresnel lens is provided.

37. A strobe apparatus according to claim 35, further comprising two light emitting tubes, said two light emitting tubes including a substrate on which a color filter, a liquid crystal filter and said Fresnel lens are provided.

38. A strobe apparatus according to claim 35, further comprising two light emitting tubes each surrounded by a blue and an amber filter and each of said two light emitting tubes are provided with a liquid crystal filter having a substrate on which said Fresnel lens is provided.

39. A strobe apparatus according to claim 35, comprising a light emitting tube and a color crystal filter lens to vary said color temperature of said strobe light emitted from said light emitting tube, and having a substrate on which said Fresnel lens is provided.

40. A strobe apparatus according to claim 35, comprising two light emitting tubes, a blue and an amber filter in front of said two light emitting tubes, respectively, each said filter having a substrate on which said Fresnel lens is provided.

41. A strobe apparatus according to claim 35, comprising two light emitting tubes, one of said light emitting tubes has a color liquid crystal filter having a substrate on which said Fresnel lens is provided.

* * * * *

UNITED STATES PATENT AND TRADEMARK OFFICE

CERTIFICATE OF CORRECTION

PATENT NO. : 5,583,397

DATED : December 10, 1996

INVENTOR(S) : Kimiaki OGAWA

It is certified that error appears in the above-indentified patent and that said Letters Patent is hereby corrected as shown below:

Cover Page: in section [56], "References Cited", "U.S. PATENT DOCUMENTS", column 2, line 3, change "Hiyadera" to ---Miyadera---.

At column 42, lines 31-32 (claim 9, lines 2-3), change "to light before exposure" to ---light before exposure to ---.

Signed and Sealed this

Seventeenth Day of June, 1997

Bruce Lehman

*Attest:*

BRUCE LEHMAN

*Attesting Officer*

*Commissioner of Patents and Trademarks*